US009692189B2

(12) United States Patent
Lin

(10) Patent No.: US 9,692,189 B2
(45) Date of Patent: Jun. 27, 2017

(54) SAFE SOCKET AND USE THEREOF

(71) Applicant: Shenzhen SKT Electrical Technology CO., Ltd., Shenzhen, Guangdong (CN)

(72) Inventor: Shifeng Lin, Shenzhen (CN)

(73) Assignee: SHENZHEN SKT ELECTRICAL TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/028,713

(22) PCT Filed: Oct. 11, 2014

(86) PCT No.: PCT/CN2014/088398

§ 371 (c)(1),
(2) Date: Apr. 11, 2016

(87) PCT Pub. No.: WO2015/051765

PCT Pub. Date: Apr. 16, 2015

(65) Prior Publication Data

US 2016/0261079 A1 Sep. 8, 2016

(30) Foreign Application Priority Data

Oct. 12, 2013 (CN) ..... 2013 1 0475980
Sep. 26, 2014 (CN) ..... 2014 1 0500141

(51) Int. Cl.
*H01R 13/713* (2006.01)
*H01R 13/703* (2006.01)
(Continued)

(52) U.S. Cl.
CPC ..... *H01R 13/713* (2013.01); *H01R 13/521* (2013.01); *H01R 13/703* (2013.01);
(Continued)

(58) Field of Classification Search
CPC ..... H01R 13/4534; H01R 13/4532; H01R 13/4536; H01R 2103/00; H01R 13/7032; H01R 13/53
(Continued)

(56) References Cited

U.S. PATENT DOCUMENTS 4,707,042 A * 11/1987 Haden ..... H01R 13/7036 439/137
6,015,307 A * 1/2000 Chiu ..... H01R 13/71 200/51.09
(Continued)

FOREIGN PATENT DOCUMENTS

CN 201266742 Y 7/2009
CN 201312047 Y 9/2009
(Continued)

*Primary Examiner* — Gary Paumen
(74) *Attorney, Agent, or Firm* — Raymond Y Chan; David and Raymond Patent Firm

(57) ABSTRACT

A safety socket includes one or multiple socket bodies. A socket body has a live wire receptacle and a neutral wire receptacle, and includes a live wire connection circuit, a neutral wire connection circuit, and a locking and controlling mechanism. When the live wire pin and the neutral wire pin of a power plug are respectively inserted into the live wire receptacle and the neutral wire receptacle of the socket body, the locking and controlling mechanism is activated and is switched to the operating state so as to connect the live wire connection circuit and the neutral wire connection circuit. When the locking and controlling mechanism is in the idle state, the live wire connection circuit and the neutral wire connection circuit are disconnected. The safety socket can effectively prevent electric shock and is water-proof, thereby preventing electric shock accidents and ensuring the safe usage of the safety socket.

32 Claims, 35 Drawing Sheets

(51) Int. Cl.

| | |
|---|---|
| ***H01R 13/707*** | (2006.01) |
| ***H01R 13/52*** | (2006.01) |
| *H01R 103/00* | (2006.01) |
| *H01R 13/453* | (2006.01) |
| *H01R 24/78* | (2011.01) |
| *H01R 25/00* | (2006.01) |

(52) U.S. Cl.
CPC ..... *H01R 13/707* (2013.01); *H01R 13/4536* (2013.01); *H01R 24/78* (2013.01); *H01R 25/006* (2013.01); *H01R 2103/00* (2013.01)

(58) Field of Classification Search
USPC ..... 439/188, 181, 137, 138; 200/51 R, 200/51.09, 51.11
See application file for complete search history.

(56) References Cited

U.S. PATENT DOCUMENTS 7,445,472 B1 * 11/2008 Huang ..... H01R 13/4536 439/138
7,588,447 B1 * 9/2009 Ni ..... H01R 13/4534 439/137
2010/0081306 A1 * 4/2010 Bowering ..... H01R 13/652 439/188
2011/0263145 A1 * 10/2011 Kim ..... H01R 13/4534 439/137
2012/0142204 A1 * 6/2012 Eberhard ..... H01R 13/70 439/188
2012/0252241 A1 * 10/2012 Projkovski ..... H01R 13/7036 439/188
2013/0280931 A1 * 10/2013 Weeks ..... H05K 5/02 439/137

FOREIGN PATENT DOCUMENTS

CN 103414063 A 11/2013
CN 103474826 A 12/2013

* cited by examiner

A-A

A

B

SAFE SOCKET AND USE THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an electrical outlet, and more particular to a safety socket which is waterproof and effectively prevents electric shocks.

Description of Related Arts

A socket, which is also known as a convenience receptacle, a switch socket, and etc., is an electrical device providing a power interface for an electric appliance. A common socket is a two-hole jack socket, a three-hole jack socket or a four-hole jack socket. When the pins of an electric appliance plug insert into the jacks of a socket, the electric circuit between the electric appliance and the power source is connected by the socket, so that the electric appliance works in a normal state under the power supply of the power source.

However, the conventional sockets are often ignored their risks regarding security, especially the problems of waterproof and electric shock. For example, people may insert electrical conductive objects into the socket jacks inadvertently; as the child has a strong curiosity and is active and naughty, he or she may insert conductive objects such as nails and cooper wire into the socket jacks while these actions are very dangerous that may result in getting electric shock.

On the other hand, as the general sockets have no waterproof effect, the power will be automatically on when water get into the socket jack and thus people may get electric shock accidents while they touch the sockets. Therefore, there is no socket that can be safely used in wet and water environment on sale in the market. More specifically, as the sockets have jacks contacting with the outside surroundings, an electric leakage accident may occurs when a conductive liquid such as water, oil, chemical reagents gets into the jacks. In other words, the conventional sockets are not suitable for use in wet and damp environments such as kitchens, bathrooms and so on because, in these wet and damp environments, water may easily exist in the socket jacks. Moreover, such conventional sockets are not suitable for use in outdoor environment because the outdoor environment makes the sockets easy exposure to moisture. Even though, when the sockets are installed in the indoor environment, the children may splash water into the socket jacks while playing. In this circumstance, the sockets with water inside are dangerous enough to cause electric shock accidents.

The current protective measure is to provide waterproof containers for the power sockets, wherein the waterproof containers seal the socket jacks of the power sockets inside when the power sockets are not in use, so as to prevent water or other liquids from getting into the jacks. It is not only inconvenience to use, but also when people forget to close it up or open it accidentally that may still results in exposure of the jacks, the water still may get into the jacks and cause accident hazards. In other words, there is no completely secure ways to prevent the current power sockets from electric shock accidents caused by water entering the socket jacks.

SUMMARY OF THE PRESENT INVENTION

An object of the present invention is to provide a safety socket, which can effectively solve the prevention of electric shock and/or waterproof problem, that can prevent electric shock so as to ensure the safety use of the safety socket.

Another object of the present invention is to provide a safety socket that, when an electrical conductive object is inserted into any receptacle of the safety socket of the present, the conductive object will not be connected to the electric circuit with the power supply so as to prevent electric shock accidents.

Another object of the present invention is to provide a safety socket, wherein only when all the pins (two, three or four pins) of an appliance plug are simultaneously inserted into the corresponding two, three or four receptacles of the safety socket, the electric circuit between the safety socket and the power supply will be electrically connected, so as to prevent any the electric shock accident.

Another object of the present invention is to provide a safety socket, wherein the safety socket provides a locking and controlling mechanism that, only when a standard appliance plug is inserted into the respective receptacle of the safety socket, the locking and controlling mechanism will be activated to respectively connect a live wire connection circuit and a neutral connection circuit and to connect the electric circuit between the appliance plug and the power supply.

Another object of the present invention is to provide a safety socket that, when an electrical conductive object is inserted into any one of the receptacles of the safety socket, the locking and controlling mechanism will not be activated, such that the conductive object will not connect to the power supply via the safety socket so as to prevent electric shock accident.

Another object of the present invention is to provide a safety socket that, when an electrical conductive object is inserted into any one of the receptacles of the safety socket, such as a live wire receptacle corresponding to the live wire connection circuit, the locking and controlling mechanism provides a self-locking mechanism that, when other electrical conductive object is inserted into a neutral receptacle corresponding to the neutral wire connection circuit, the self-locking mechanism prevents a connection of the electric circuit between the power supply and the safety socket.

Another object of the present invention is to provide a safety socket, wherein the self-locking mechanism of the locking and controlling mechanism can further prevent other electrical conductive objects being inserted into other receptacles of the safety socket. For example, when an electrical conductive object is inserted into the live wire receptacle, other conductive object will be prevented by the locking and controlling mechanism from being inserted into the neutral wire receptacle, so that other conductive object cannot be fully inserted into the neutral wire receptacle to prevent the connection of the electric circuit between the power supply and the safety socket.

Another object of the present invention is to provide a safety socket, wherein when two or more electrical conductive objects are inserted into two or more receptacles of the safety socket one after another, because of the self-locking mechanism of the locking and controlling mechanism, the electric circuit between the power supply and the safety socket will be disconnected, wherein only when the standard power plug pins are simultaneously inserted into the corresponding receptacles of the safety socket, the electric circuit between the power supply and the safety socket will be connected.

Another object of the present invention is to provide a safety socket, wherein only when a standard appliance plug is inserted into the receptacle of the safety socket and the sizes of the pins are suitable to activate the locking and controlling mechanism, the electric circuit between the power supply and the safety socket will be connected. Or else, even if the receptacles of the safety socket are simultaneously inserted with a plurality of electrical conductive objects other than the pins of the standard appliance plug, the electric circuit between the power supply and the safety socket will not be connected by the safety socket to prevent electric shocks accident because these dimensions and sizes of such conductive objects are insufficient to activate the locking and controlling mechanism.

Another object of the present invention is to provide a safety socket, wherein only when two pins of an appliance plug are simultaneously inserted into the two receptacles of the safety socket, the plug pins can respectively connect the corresponding live wire connection circuit and the neutral wire connection circuit, such that the appliance plug and the power supply are electrically connected.

Another object of the present invention is to provide a safety socket, wherein when the safety socket is a three-hole jacks socket, and only when the live wire pin and the neutral wire pin of the appliance plug are respectively and simultaneously inserted into the live wire receptacle and the neutral wire receptacle, the pins of the appliance plug can respectively connect the live wire connection circuit and the neutral wire connection circuit, such that the appliance plug and the power supply are electrically connected by the safety socket. Or that when an earth pin of the appliance plug is inserted into a corresponding earth wire receptacle, a locking control unit is activated in response to the inserting action of the earth pin of the appliance plug, such that only when three pins of the appliance plug are simultaneously inserted into the three receptacles of the safety socket, the live wire and the neutral wire plug pin respectively can connect the corresponding live wire connection circuit and the neutral wire connection circuit.

Another object of the present invention is to provide a safety socket having a live wire connection circuit and a neutral wire connection circuit. In one embodiment, the whole circuit structure of the live wire connection circuit is disposed with a first live wire connection switch and a second live wire connection switch and the whole circuit structure of the neutral wire connection circuit is disposed with a first neutral wire connection switch and a second neutral wire connection switch, wherein the locking and controlling mechanism comprises a first locking control unit and a second locking control unit that, only when the locking and controlling mechanism is activated in response to the inserting action of the plug pins, the first locking control unit switches on the first live wire connection circuit and the first neutral wire connection circuit, and the second locking control unit switches on the second live wire connection circuit and the second neutral wire connection circuit, that the live wire connection circuit and the neutral wire connection circuit can be connected.

Another object of the present invention is to provide a safety socket, wherein only when one electrical conductive object is inserted into one receptacle of the safety socket such as the live wire receptacle, the first locking control unit switches on the first live wire connection switch and the first neutral wire connection switch but the second locking control unit switches off the second live wire connection switch and the second neutral wire connection switch, such that the live wire connection circuit and the neutral wire connection circuit are disconnected to further prevent electric shock accidents.

Another object of the present invention is to provide a safety socket, wherein only when two locking control units of the locking and controlling mechanism are simultaneously activated, the corresponding circuits are connected; otherwise, a first activated locking control unit will further prevent the other locking and control unit being activating so as to form the self-locking mechanism to prevent electric shock accident.

Another object of the present invention is to provide a safety socket, wherein each of the receptacles is provided with a protecting assembly disposed on the position adjacent to receptacle opening of each receptacle to seal the receptacle opening to prevent access to water or other conductive liquid.

Another object of the present invention is to provide a safety socket, wherein the protecting assembly further comprises a reset mechanism that, when the respective plug pin pushes to open a protecting member of the protecting assembly to enter a receptacle of the safety socket and when the plug pins are away from the receptacle, the protecting member can close the receptacle opening. And the reset mechanism can be implemented by a reset spring and, only when the force is big enough, the protecting member can be pushed to open, such that when a child pushes the protecting member using an iron wire, the protecting member cannot be pushed to open if the pushing force is not strong enough, such that electric shock accident is accordingly prevented.

Another object of the present invention is to provide a safety socket, wherein the protecting member of the protecting assembly further forms a jack slot having a matched size with a standard appliance plug pin. Thus, only when a standard appliance plug pin is inserted into the jack slot and the pushing force is big enough that the standard appliance plug pin can be inserted into the receptacle of the safety socket.

Another object of the present invention is to provide a safety socket, wherein a socket shell of the safety socket has an isolation cavity having waterproof configuration between the isolation cavity and the receptacles of the safety socket so that water or other electrical conductive liquid within receptacles will not enter into the isolation cavity to connect the circuits of the safety socket, thereby preventing any electric shock.

Another object of the present invention is to provide a safety socket, wherein when water or other electrical conductive liquid enters into any of the receptacles of the safety socket, as the circuit connection switches of the safety socket are received in the isolation cavity, such that the circuit connection switches will not be switched on and the safety socket can be used in wet and water environment.

Another object of the present invention is to provide a safety socket which is arranged to provide with a drain structure, wherein even though any water or other electrical conductive liquid enters into any of the receptacles of the waterproof socket, the water or other electrical conductive liquid will be rapidly discharged, thereby effectively removing the security risks of electric shock because of the short circuit.

Another object of the present invention is to provide a safety socket which is a waterproof socket different from such retaining function of the prior art providing a drainage function according to the present invention, wherein the water or other electrical conductive liquid could be rapidly discharged and thus ensuring usage safety.

Another object of the present invention is to provide a safety socket, wherein each of the receptacles is also provided with a water port such that water entering into the receptacles would discharge out of the safety socket. The safety socket further comprises a drainage arrangement adapted for guiding water or other conductive fluid within the receptacle to reach the water port to flow out of the safety socket.

Another object of the present invention is to provide a safety socket, wherein all elements and components except the receptacles and the drainage structure of the whole waterproof socket are completely sealed, so that outside water under normal condition cannot enter the inside of the safety socket.

Another object of the present invention is to provide a safety socket, which has a simple structure and low cost, and is easy to use and suitable for mass production.

Additional advantages and features of the invention will become apparent from the description which follows, and may be realized by means of the instrumentalities and combinations particular point out in the appended claims.

According to the present invention, the foregoing and other objects and advantages are attained by a safety socket, which comprises:

one or more socket body having two or more receptacles isolated with each other, and comprising a live wire connection circuit, a neutral wire connection circuit and a locking and controlling mechanism, wherein the locking and controlling mechanism is activated to an operation state when two or more pins of an appliance plug are inserted into the corresponding receptacles of the socket body, and that the live wire connection circuit and the neutral wire connection circuit are disconnected when the locking and controlling mechanism is in an idle state so as to prevent electric shock accident.

Preferably, the receptacles of the socket body include a live wire receptacle, a neutral wire receptacle and an earth wire receptacle, and that the pins of the appliance plug include a live wire pin, a neutral wire pin and an earth wire pin. When the live wire pin, the neutral wire pin and the earth wire pin of the appliance plug are respectively and simultaneously inserted into the corresponding live wire receptacle, the neutral wire receptacle and the earth wire receptacle, the locking and controlling mechanism is activated by the earth wire pin inserted into the earth wire receptacle to connect the live wire connection circuit and the neutral wire connection circuit.

Preferably, an action hole is provided in a sidewall of the earth wire receptacle, wherein the locking and controlling mechanism comprises a pushing element, an actuating element and a reset element. A first end of the pushing element transverses the action hole and extends to the earth wire receptacle to be driven by the earth wire pin. A second end opposite to the first end of the pushing element is connected to the actuating element or is integrally formed. The actuating element connects the live wire connection circuit and the neutral wire connection circuit in the operation state. The reset element is connected to the pushing element or the actuating element such that when the earth wire pin moves away from the earth wire receptacle, the locking and controlling mechanism is switched to the initial idle state.

Preferably, the socket body comprises a live wire connection switch controlling connection and disconnection of the live wire connection circuit and a neutral wire connection switch controlling connection and disconnection of the neutral wire connection circuit. The actuating element of the locking and controlling mechanism simultaneously switches on the live wire connection switch and the neutral wire connection switch under the action of the pushing element so as to connect the live wire connection circuit with the neutral wire connection circuit.

Preferably, the actuating element comprises a connector element and two actuating blocks connected to two sides of the connector element, wherein each the two actuating blocks has an actuating surface applying pushing force to act on the live wire connection switch and the neutral wire connection switch so as to connect the live wire connection circuit and the neutral wire connection circuit.

Preferably, a receiving slot is provided in each of the actuating blocks and an inside wall of the receiving slot forms the actuating surface, wherein each of the live wire connection switch and the neutral wire connection switch has two switch elements accommodated in the corresponding receiving slot, and that an contacting end portion of one switch element of the two switch elements is adapted to move under actions of the actuating element and to contact to an contacting end portion of the other switch element so as to switch on the corresponding connection switch.

Preferably, the contacting end portions of the two switch elements of each the live wire connection switch and the neutral wire connection switch respectively have a conductive protrusion, wherein the position of one conductive protrusion of the switch element is higher than the position of the other conductive protrusion of the switch element, such that one of the contacting end portion of the switch element rotates under action of the actuating surface, in such a manner that the conductive protrusions of the two switch elements contact with each other to form a point-to-point contacting configuration.

Preferably, an upper wall of the receiving slot forms an inclined guiding surface and one contacting end portion of the switch element slides along the inclined guiding surface under action of the actuating surface, rendering the two switch elements in contact with each other.

Preferably, each of the live wire connection switch and the neutral wire connection switch is a micro-move switch.

Preferably, the reset element is a reset spring, wherein when the earth wire pin is inserted into the earth wire receptacle, the reset spring is compressed or stretched under action of the pushing element and/or the actuating element, and that when the earth wire pin is moved away from the earth wire receptacle, the pushing element and the actuating element return to their initial idle state under an elastic restoring force of the reset spring.

Preferably, the first end of the pushing element further has a sloped surface having a size and position which is adapted to be pushed when the earth wire pin of the appliance plug is inserted into the earth wire receptacle so as to further drive the pushing element to move in the action hole to activate the locking and controlling mechanism.

Preferably, the live wire connection switch and the neutral wire connection switch are respectively disposed on two sides of the earth wire receptacle and isolated with each other by a side wall of the earth wire receptacle so as to prevent a short circuit between the live wire connection switch and the neutral wire connection switch.

Preferably, an isolation cavity is formed on the outside of two or more receptacles of the safety socket, wherein the socket body further comprises a sealing member to prevent water or other conductive liquid in the earth wire receptacle entering the isolation cavity via the action hole.

Preferably, the isolation cavity is separately defined by the socket body, or the safety socket further comprises a socket shell assembled with the socket body to form the isolation cavity.

Preferably, the sealing member comprises a sealer which is fixed to the outside of the earth wire receptacle and comprises a sealing body that a through-hole is provided in the middle of the sealing body, wherein the through-hole is positioned corresponding to the action hole of the earth wire receptacle, and that the size and the shape of the through-hole are arranged corresponding to the size and the shape of the pushing element, so as to enable the pushing element crossing through the through-hole tightly and seamlessly.

Preferably, the outer side wall of the earth wire receptacle forms a locating slot concaving inwardly and the sealing member further comprises a fixator comprising a fixator body that an opening is formed in the middle of the fixator body, wherein the opening allows the pushing element to penetrate through and the fixator body is fixed to the outer side wall of the earth wire receptacle to seal the locating slot, such that the sealer is securely and tightly mounted in the locating slot.

Preferably, the sealer and the fixer are made of silicone material, wherein each of the peripheral walls of each receptacle is made of insulating and heat-resistant material selected from the group consisting of ceramic, mica and bakelite.

Preferably, the two or more receptacles of the socket body include a live wire receptacle and a neutral wire receptacle, and the two or more pins of the appliance plug include a live wire pin and a neutral wire pin, wherein when the live wire pin and the neutral wire pin of the appliance plug are respectively and simultaneously inserted into the corresponding live wire receptacle and the neutral wire receptacle, the locking and controlling mechanism is activated by the live wire pin inserted into the live wire receptacle and the neutral wire pin inserted into the neutral wire receptacle to electrically connect the live wire connection circuit and the neutral wire connection circuit.

Preferably, the locking and controlling mechanism comprises two locking control units, wherein a live wire action hole is provided in a sidewall of the live wire receptacle, and a neutral wire action hole is provided in a sidewall of the neutral wire receptacle. The two locking control units are respectively positioned and mounted through the live wire action hole and the neutral wire action hole, wherein when the live wire pin and the neutral wire pin of the appliance plug are respectively and simultaneously inserted into the live wire receptacle and the neutral wire receptacle, the live wire pin and the neutral wire pin simultaneously activate the two locking control units, such that only when the two locking control units are simultaneously activated, the live wire connection circuit and the neutral wire connection circuit are electrically connected.

Preferably, each of the two locking control units comprises a pushing element having a sloped surface on one end and penetrating through the live wire action hole or the neutral wire action hole, an actuating element mounted on the pushing element or integrally formed and connecting the live wire connection circuit and the neutral wire connection circuit in the operation state, and a reset element mounted on the pushing element or the actuating element, wherein when the live wire pin and the neutral wire pin of the appliance plug are respectively and simultaneously inserted into the live wire receptacle and the neutral wire receptacle, the live wire pin and the neutral wire pin respectively push the pushing elements to move so as to further drive the actuating elements to move, such that the two locking control units are in their operation state, and that when the live wire pin and the neutral wire pin of the appliance plug are moved away from the live wire receptacle and the neutral wire receptacle, the two locking control units are in their initial idle state under the reset effect of the reset elements.

Preferably, the socket body comprises two sets of live wire connection switch and neutral wire connection switch, wherein in the operation state, the actuating elements of the two locking control units respectively switch on the two sets of live wire connection switch and neutral wire connection switch so as to electrically connect the live wire connection circuit and the neutral wire connection circuit.

Preferably, each of the reset elements is a reset spring, wherein when the live wire pin and the neutral wire pin of the appliance plug are respectively inserted into the live wire receptacle and the neutral wire receptacle, the reset springs are compressed or stretched under actions of the pushing elements and/or the actuating elements, and that when the live wire pin and the neutral wire pin of the appliance plug are respectively moved away from the live wire receptacle and the neutral wire receptacle, the pushing elements and the actuating elements return to their initial idle state under the elastic restoring forces of the reset springs.

Preferably, the connection switches of the two sets of live wire connection switch and neutral wire connection switch are micro-move switches or conduct plates or columns which are connected to corresponding circuits by means of point contact or surface contact.

Preferably, the locking and controlling mechanism further comprises a braking unit, wherein when the two locking control units are simultaneously started, the braking unit allows the two locking control units to work in a normal working state, and that when only one of the two locking control units is started, the braking unit prevents other locking control unit from operating so as to ensure a disconnection of the live wire connection circuit and the neutral wire connection circuit to prevent electric shock accident.

Preferably, the braking unit comprises a braking element, a restraining element and a rotating shaft, wherein the braking element is adapted for linear motions under the mutual actions of the two actuating elements when switching to their operation state. When the live wire pin and the neutral wire pin of the appliance plug are respectively removed away from the live wire receptacle and the neutral wire receptacle, the braking element returns to its initial idle state under the reset effect of the restraining element. When only one of the two locking control units is started, the braking element rotates around the rotating shaft and prevents the other locking control unit from operating so as to ensure a disconnection of the live wire connection circuit and the neutral wire connection circuit to prevent electric shock accident.

Preferably, two effect surfaces are provided on two ends of the braking element, wherein each of the two actuating elements comprises a actuating body, and that the actuating body respectively applies acting forces on the two effect surfaces, rendering the braking element to move along a vertical direction or a horizontal direction.

Preferably, the two effect surfaces are sloped surfaces and are provided on the same side of the braking element, wherein the actuating bodies of the two actuating elements are provided on the same side of the braking element and adapted to apply acting forces on the two effect surfaces along the same and parallel directions.

Preferably, the two effect surfaces are sloped surfaces and are provided on opposite sides of the braking element, wherein the actuating bodies of the two actuating elements are provided on two opposite sides of the braking element and adapted to apply acting forces on the two effect surfaces along parallel but opposite directions.

Preferably, each of the actuating elements respectively comprises a staring element such that one of the two starting elements is used to simultaneously switch on and switch off one set of live wire connection switch and neutral wire connection switch, and the other one of the two starting elements is used to simultaneously switch on and switch off the other set of live wire connection switch and neutral wire connection switch.

Preferably, the staring elements are arranged to be adapted for pressing the corresponding connection switch to switch on the corresponding connection switch, or that each of the staring elements further comprises two starting arms extending from the corresponding staring element, wherein the two starting arms are adapted to be operated by pressing to switch on the corresponding live wire connection switch and neutral wire connection switch.

Preferably, the actuating element further comprises a connection element connecting the staring element and the actuating body so as to form a three-section structure while the reset element is mounted on the actuating body.

Preferably, the connection switch is installed on the starting element, wherein a displacement is formed under the driven of the starting element during the movement of the starting element so as to connect to the corresponding connection circuit.

Preferably, the positions of the actuating bodies of the each two actuating elements are provided that, when only one locking control unit of the two locking control units is started, one actuating body of the locking control unit applies on one of the effect surfaces so that the braking element rotates clockwise or counterclockwise around the rotating shaft, such that the other effect surface and the actuating body of the other locking control unit are in a dislocation state, so that the braking element prevents the other locking control unit starting.

Preferably, the braking unit further comprises an installing element, wherein the installing element forms a retaining groove for receiving the braking element and retaining the braking element in position, so as to enable the braking element to be adapted for movement in the retaining groove only.

Preferably, the installing element comprises a base portion and two flanks extending from the base portion, wherein the retaining groove is formed between the base portion and the two flanks and a guiding groove is formed in each of the flanks, wherein two ends of the rotating shaft respectively extend to the guiding groove so as to adapt for movement in the guiding groove, wherein the restraining element is a restraining spring having one end connected with the base portion of the installing element and another end connected with the braking element.

Preferably, the locking and controlling mechanism further comprises a braking unit connecting to the two locking control units, wherein when the live wire pin and the neutral wire pin of the appliance plug are respectively inserted into the corresponding live wire receptacle and the neutral wire receptacle at the same time, the two locking control units are activated by the live wire pin and the neutral wire pin to drive the braking unit to switch to a working state so as to connect the live wire connection circuit and the neutral wire connection circuit, wherein when only one of the two locking control units is started, the other locking control unit connected to the braking unit prevents the locking control unit from operating so as to prevent electric shock accident.

Preferably, each of the two locking control units has a pushing member, an actuating member and a reset member, the pushing member having a sloped surface at one end thereof and penetrating through the live wire action hole or the neutral wire action hole, the actuating member mounting on the pushing member or being integrally formed with the pushing member, the reset member mounting on the pushing member or the actuating member. The actuating member is used to connect the live wire connection circuit with the neutral wire connection circuit in the operation state, wherein when the live wire pin and the neutral wire pin of the appliance plug are respectively inserted into the live wire receptacle and the neutral wire receptacle at the same time, the live wire pin and the neutral wire pin respectively push the pushing members to move so as to further drive the actuating members to move, such that the two locking control units are in the operation state, and that when the live wire pin and the neutral wire pin of the appliance plug are removed away from the live wire receptacle and the neutral wire receptacle, the two locking control units are in the initial idle state under the reset effect of the reset members.

Preferably, the socket body comprises a live wire connection switch and a neutral wire connection switch, wherein in the operation state, one actuating element switches one set of the live wire connection switch and the neutral wire connection switch while the other actuating element switches the other set of the live wire connection switch and the neutral wire connection switch, so as to connect the live wire connection circuit with the neutral wire connection circuit.

Preferably, the braking unit comprises a positioning member and two connection members, wherein one end of each of the connection members is pivotally mounted to the positioning member, and the other end of each of the connection members is respectively pivotally mounted to the actuating member.

Preferably, the socket body further comprises a guide member having a guide groove, wherein the guide member integrally protrudes from the outer side wall of the respective receptacle of the socket body, wherein the positioning member is adapted for sliding in the guide groove of the guide member.

Preferably, each of the connection members comprises a connecting end portion and a coupling end portion, wherein the two connecting end portions are assembled by the positioning member and each of the connecting end portions forms a blocking joint groove, wherein the actuating member has an installing member provided in the end portion, wherein the installing members are respectively received in the blocking joint grooves and are connected with the corresponding coupling end portions by a pivot member.

Preferably, an isolation cavity is formed outside of two or more receptacles of the socket body of the safety socket, wherein the socket body further comprises a sealing member to prevent water or other electrical conductive liquid entered the earth wire receptacle from entering into the isolation cavity via the live wire action hole or the neutral wire action hole.

Preferably, the isolation cavity is separately defined by the socket body, or the safety socket further comprises a socket shell assembled with the socket body to form the isolation cavity.

Preferably, each the pushing elements/members are formed with grooves, wherein the sealing member comprises sealing rings which are respectively provided in the grooves and located within the corresponding live wire action hole and the neutral wire action hole so as to tightly and closely contact to the inner surfaces of the live wire action hole and the neutral wire action hole respectively.

Preferably, the sealing rings are sealing silicone rings.

Preferably, a side of each of the outer side walls of the live wire receptacle and the neutral wire receptacle, adjacent to these of the isolation cavity, forms a fixation groove, wherein the sealing member comprises sealing rings respectively mounted on the fixation grooves and the inner surfaces of of the sealing rings are tightly and closely in contact with the outer surface of the pushing element.

Preferably, the sealing member further comprises a fixing member comprising a fixing member body, wherein two openings are formed in the middle of the fixing member body. The two openings respectively allow the pushing element/the pushing member to penetrate through, wherein the fixing member is fixed to outer side walls of the live wire receptacle and the neutral wire receptacle to seal the corresponding fixation grooves such that the sealing rings are tightly, firmly and closely mounted in the fixation grooves.

Preferably, the sealing rings and the sealing member are made of silicone materials, wherein each of the peripheral walls of each receptacle is made of insulating and heat-resistant material selected from the group consisting of ceramic, mica and bakelite.

Preferably, each of the receptacles is provided with a protecting assembly disposed on the position adjacent to the receptacle openings of each receptacle to seal the receptacle openings in a protecting position and to open the receptacle openings in an working position such that the pins of the appliance plug are inserted into the corresponding receptacles.

Preferably, the protecting assembly comprises a protecting member, a rotation shaft and a reset member, wherein the protecting member is adapted to rotate around the rotation shaft so as to switch between the protecting position and the working position, wherein when the pins of the appliance plug are removed away from the receptacles, the resetting effect of the reset member makes the protecting assembly to switch back to the protecting position from the working position.

Preferably, the protecting assembly further comprises a mounting member comprising a main body section having a mounting concave groove to receive the protecting member, wherein the protecting member comprises a protecting body and a base portion. The protecting body is fixedly connected to or integrally extends from the base portion and the base portion further has perforations and mounting grooves. The rotation shaft penetrates through the perforations and is assembled with the base portion, such that the protecting member is adapted to rotate around the rotation shaft for rotational motion.

Preferably, the reset member is a reset torsion spring and comprises a spring body having a center hole, wherein the reset member is assembled to the mounting grooves of the base portion so as to correspond the center hole of the spring body to the perforations of the rotation shaft, such that the rotation shaft penetrates through the perforations of the base portion and the center hole of the spring body, so as to assemble with the base portion and the reset member.

Preferably, the reset member further comprises a first presser foot extending integrally from the spring body and a second presser foot, wherein in the protecting position, the first presser foot applies a pressure on the inner surface of the protecting body to prevent electrical conductive objects pulling the protecting body to open. When the live wire pin of the appliance plug contacts the protecting body and the pushing force is sufficient to overcome the pressure applied by the first presser foot, the second presser foot presses against the inner walls of the receptacles and the protecting body switches from the protecting position to the working position. When the pins of the appliance plug are moved away from the receptacles, the stress of the reset member stored is released, so that the protecting body moves back to its original protecting position by the pressing of the first presser foot on the protecting body.

Preferably, the protecting body is further hook-shaped and has a jack slot, wherein when an electrical conductive object is inserted into the respective receptacle of the safety socket, the hook-shaped protecting body makes the conductive object to be remained in the jack slot and prevents the conductive object entering into the receptacles so as to further prevent electric shock accident.

Preferably, each of the receptacles is also formed with a water port such that water entering the receptacles will be discharged out of the safety socket, wherein the water port and the corresponding action hole are provided on the opposite sides of the receptacles, or the two adjacent sides thereof.

Preferably, each of the receptacles is also formed with a water port such that water entering into receptacles will be discharged out of the safety socket.

Preferably, the safety socket further comprises one or more drainage arrangements, each of which comprises one or more guide portions each having a guide channel adapted for guiding water or other electrical conductive fluid entering the respective receptacle and reaching the water port to flow out of the safety socket.

Preferably, each of the water ports is formed in the bottom end of the side wall of the respective receptacle and located at the same side of the respective receptacle.

Preferably, each of the water ports is formed on the peripheral wall of the respective receptacle and is disposed adjacent to the corresponding receptacle opening of the respective receptacle, where the safety socket is used as a wall socket.

Preferably, the safety socket further comprises one or more drainage portions provided or protruded from the outer side walls of the receptacles, wherein one end of the drainage arrangement connects to the drainage portion such that water or other electrical conductive liquid entered the receptacle is adapted for entering the drainage portion via the water port and then entering into the guide channel of the drainage arrangement to discharge out of the safety socket from the other end of the drainage arrangement.

Preferably, a socket shell of the safety socket, positioned adjacent to the water port, comprises a supporting portion and a fixed portion, wherein an installing hole is formed between the support portion and the fixed portion for installing the drainage arrangement.

Preferably, the drainage arrangement further comprises an installing portion, wherein a groove, having a size and shape matching with the fixed portion is provided, wherein the installing portion is received in the groove. The drainage arrangement also comprises a positioning portion, wherein a neck slot is formed between the guide portions and the positioning portion, wherein the neck slot has a shape and size matching with the support portion, such that the support portion is adapted to be received in the neck slot formed between the positioning portion and the pushing element.

Preferably, water or other electrical conductive liquid entered in the receptacle in a first direction is discharged out of the safety socket in a second direction, wherein the first direction and the second direction are perpendicular to each other.

Preferably, the safety socket further comprises one or more chargeable USB terminal elements for connecting with one or more intelligent digital devices by one or more USB data cables for providing power to the intelligent digital devices.

Preferably, the safety socket further comprises a socket shell and a circuit board, wherein the socket shell and the socket body form the isolation cavities of the socket body where the isolation cavities are not communicating with each other. The circuit board is received in the isolation cavity and each of the USB terminal elements has a USB receptacle and one or more pins connected to the circuit board, wherein each of the USB terminal elements is integrally formed in the socket shell and the USB receptacles and the isolation cavities are not communicating with each other so as to prevent water or other electrical conductive liquid from entering into the isolation cavities via the receptacles and the USB receptacles.

Preferably, each of the intelligent digital devices is selected from the group consisting of mobile phone, tablet computer, personal digital assistant, MP3, MP4, mobile power, and digital camera.

According to other aspect of the present invention, the foregoing and other objects and advantages are also attained by a safety socket comprising one or more socket bodies, wherein each of the socket bodies comprises at least:

a live wire connection circuit, a first live wire connection switch and a second live wire connection switch adapted for connecting or disconnecting with the live wire connection circuit, a neutral wire connection circuit, a first neutral wire connection switch and a second neutral wire connection switch adapted for connecting or disconnecting with the neutral wire connection circuit, and a locking and controlling mechanism comprising a first locking control unit and a second locking control unit, wherein when the first locking control unit and the second locking control unit are activated at the same time, the first locking control unit switches on the first live wire connection switch and the first neutral wire connection switch and, simultaneously, the second locking control unit switches on the second live wire connection switch and the second neutral wire connection switch, so that the live wire connection circuit and the neutral wire connection circuit are electrically connected to ensure a normal working condition of the socket body.

Preferably, the socket body further has a live wire receptacle and a neutral wire receptacle, wherein a live wire action hole is provided in a sidewall of the live wire receptacle and a neutral wire action hole is provided at a sidewall of the neutral wire receptacle. The first locking control unit is positioned and mounted through the live wire action hole and the second locking control unit is positioned and mounted through the neutral wire action hole, wherein when the live wire pin and the neutral wire pin of the appliance plug are respectively and simultaneously inserted into the live wire receptacle and the neutral wire receptacle, the live wire pin activates the first locking control unit and the neutral wire pin activates the second locking control unit, such that the live wire connection circuit and neutral wire connection circuit are electrically connected only when the two locking control units are simultaneously activated.

Preferably, the first locking control unit comprises a first pushing element, a first actuating element and a first reset element, wherein the first pushing element penetrates through the live wire action hole and the first actuating element is mounted on the first pushing element or is integrally formed with the first pushing element. The first reset element is mounted on the first pushing element or the first actuating element. The second locking control unit comprises a second pushing element, a second actuating element and a second reset element, wherein the second pushing element penetrates through the neutral wire action hole and the second actuating element is mounted on the second pushing element or is integrally formed with the second pushing element. The second reset element is mounted on the second pushing element or the second actuating element. The first and second actuating elements are adapted for connecting the live wire connection circuit and the neutral wire connection circuit in the operation state, wherein when the live wire pin and the neutral wire pin of the appliance plug are respectively inserted into the live wire receptacle and the neutral wire receptacle at the same time, the live wire pin pushes the first pushing element to move so as to further drive the first actuating element to move, rendering the first locking control unit in the operation state, and that the neutral wire pin pushes the second pushing element to move so as to further drive the second actuating element to move, rendering the second locking control unit is in the operation state, wherein when the live wire pin and the neutral wire pin of the appliance plug are removed away from the live wire receptacle and the neutral wire receptacle, the first and second locking control units respectively return to their initial idle state under the reset effects of the first and second reset elements.

Preferably, the first actuating element further comprises a first staring element and the second actuating element further comprises a second starting element, wherein the first starting element is used to simultaneously switch on or switch off the first live wire connection switch and the first neutral wire connection switch, while the second starting element is used to simultaneously switch on or switch off the second live wire connection switch and the second neutral wire connection switch.

Preferably, each of the first and second reset elements is a reset spring, wherein when the live wire pin and the neutral wire pin of the appliance plug are respectively inserted into the live wire receptacle and the neutral wire receptacle, the reset springs are compressed or stretched under actions of the pushing elements and/or the actuating elements, and when the live wire pin and the neutral wire pin of the appliance plug are respectively removed away from the live wire receptacle and the neutral wire receptacle, the pushing elements and the actuating elements return to their initial idle state under elastic restoring forces of the reset springs.

Preferably, each of the connection switches of the first and the second live wire connection switches and neutral wire connection switches is micro-move switch or is conduct plate or column which is connected to corresponding circuits by means of point contact or surface contact.

Preferably, the locking and controlling mechanism further comprises a braking unit, wherein when the first and second locking control units are simultaneously started, the braking unit allows the first and second locking control units to work in a normal working state, wherein when only one of the first and the second locking control unit is started, the braking unit prevents the other locking control unit from operating so as to ensure the disconnection of the live wire connection circuit and the neutral wire connection circuit to prevent electric shock accident.

Preferably, the braking unit comprises a braking element, a restraining element and a rotating shaft, wherein the braking element is adapted to move linearly under the actions of the first and second actuating elements when the braking element switches to the operation state. And, when the live wire pin and the neutral wire pin of the appliance plug are respectively removed away from the live wire receptacle and the neutral wire receptacle, the braking element returns to its initial idle state under the reset effect of the restraining element. When only one of the first and second locking control units is started, the braking element rotates around the rotating shaft and prevents the other locking control unit from operating so as to ensure the disconnection of the live wire connection circuit and the neutral wire connection circuit to prevent electric shock accident.

Preferably, the braking element has two ends providing a first effect surface and a second effect surface respectively, wherein each of the first and second actuating elements comprises a first actuating body and a second actuating body respectively, wherein the first and second actuating bodies respectively apply acting forces on the first and second effect surfaces to render the braking element moving along a vertical direction or a horizontal direction.

Preferably, each of the first and second effect surfaces is sloped surface positioned at the same side of the braking element, while the first and second actuating bodies are positioned at the same side of the braking element and are adapted for applying acting forces on the first and second effect surfaces along the same direction parallelly.

Preferably, each of the first and second effect surfaces is sloped surface positioned at opposite sides of the braking element, while the first and second actuating bodies are positioned at two opposite sides of the braking element and are adapted to apply acting forces on the first and second effect surfaces along opposite directions parallelly.

Preferably, the locking and controlling mechanism further comprises a braking unit, wherein the first and second locking control units are connected to the braking unit, wherein when the live wire pin and the neutral wire pin of the appliance plug are respectively and simultaneously inserted into the corresponding live wire receptacle and the neutral wire receptacle, the first and second locking control units are activated by the live wire pin and the neutral wire pin respectively to drive the braking unit to switch to a working state so as to electrically connect the live wire connection circuit and the neutral wire connection circuit, wherein when only one of the first and second locking control units is started, the other locking control unit connected to the braking unit prevents the locking control unit to operate so as to prevent electric shock accident.

Preferably, the first locking control unit comprises a first pushing member, a first actuating member and a first reset member, wherein the first pushing member penetrates through the live wire action hole and the first actuating member is mounted on the first pushing member or is integrally formed with the first pushing member. The first reset member is mounted on the first pushing member or the first actuating member. The second locking control unit comprises a second pushing member, a second actuating member and a second reset member, wherein the second pushing member penetrates through the neutral wire action hole and the second actuating member is mounted on the second pushing member or is integrally formed with second pushing member, wherein the second reset member is mounted on the second pushing member or the second actuating member. The first and second actuating members are adapted for electrically connecting the live wire connection circuit with the neutral wire connection circuit in the operation state, wherein when the live wire pin and the neutral wire pin of the appliance plug are respectively and simultaneously inserted into the live wire receptacle and the neutral wire receptacle, the live wire pin pushes the first pushing member to move so as to further drive the first actuating member to move, such that the first locking control unit is in the operation state, wherein the neutral wire pin pushes the second pushing member to move so as to further drive the second actuating member to move, such that the second locking control unit is in the operation state. When the live wire pin and the neutral wire pin of the appliance plug are removed away from the live wire receptacle and the neutral wire receptacle, the first and second locking control units respectively return to their initial idle state under the reset effects of the first and second reset members.

Preferably, the braking unit comprises a positioning member and first and second connection members, wherein each end of the first and second connection members is pivotally mounted to the positioning member, and each other end of the first and second connection members is respectively pivotally mounted to the actuating member.

Preferably, the socket body further comprises a guide member having a guide groove, wherein the guide member integrally protrudes from the outer side wall of one of the receptacles of the socket body, and the positioning member is adapted for sliding in the guide groove of the guide member so as to switch between the idle state and the operation state.

Preferably, the socket body has two above mentioned receptacles, or that the socket body further has an earth wire receptacle to form a three-receptacle socket body.

According to other aspect of the present invention, the foregoing and other objects and advantages are also attained by an application method of a safety socket, wherein the safety socket comprises one or more socket bodies for connecting an appliance plug of an electric appliance to a power supply, each of the socket bodies comprising at least a live wire receptacle, a neutral wire receptacle, a live wire connection circuit, a neutral wire connection circuit, and a locking and controlling mechanism having an idle state, a self-locking state and an operating state, wherein the application method comprises the following steps:

(A) disconnecting the live wire connection circuit and the neutral wire connection circuit when the locking and controlling mechanism is in the ideal state;

(B) when an electrical conductive object is independently inserted into only one of the live wire receptacle and the neutral wire receptacle that activates the corresponding locking and controlling mechanism to its self-locking state, preventing the live wire connection circuit and the neutral wire connection circuit from connecting by the locking and controlling mechanism so as to prevent electric shock; and (C) when a live wire pin and a neutral wire pin of the appliance plug of the electric appliance are respectively inserted into the live wire receptacle and the neutral wire receptacle at the same time that activates the locking and controlling mechanism to its operation state, electrically connecting the live wire connection circuit and the neutral wire connection circuit by the locking and controlling mechanism, so as to electrically connect the electric appliance with the power supply for normally functioning under the electrical power supply of the power supply through the socket body.

Preferably, in the step (A), when no electrical conductive object or any other object is inserted into the live wire receptacle and the neutral wire receptacle, the locking and controlling mechanism is in the idle state.

Preferably, in the step (A), when an electrical conductive object is inserted into the live wire receptacle or the neutral wire receptacle but the shape, size and pushing force magnitude of the conductive object is unable to activate the locking and controlling mechanism, the locking and controlling mechanism is remained in the idle state to prevent any electric shock accident.

Preferably, the locking and controlling mechanism comprises a first and a second locking control unit and a braking unit, wherein when the first and second locking control units are simultaneously activated, the braking unit is in the operation state and electrically connects the live wire connection circuit and the neutral wire connection circuit, wherein when only one of the first and second locking control units is activated, the step (B) further comprises a step of: activating locking control unit acting on the braking unit to switch to the self-locking state and preventing the other locking control unit from operating so as to prevent electric shock accident.

Preferably, the step (B) further comprises a step of: making the braking element of the braking unit to perform rotation movement when only one of the first and second locking control units is activated, so as to render the braking element and the other locking and control unit in a dislocation state to prevent the other locking and control unit being activated.

Preferably, the step (C) further comprises a step of: making the braking element of the braking unit to perform a linear motion when the first and second locking control units are simultaneously activated, so as to switch the braking element to the operation state to allow the first and second locking control units to electrically connect the live wire connection circuit and the neutral wire connection circuit.

Preferably, the step (C) further comprises a step of: making the braking element of the braking unit to perform a linear motion along a vertical direction or a horizontal direction when the first and second locking control units are activated at the same time.

Preferably, the step (C) further comprises a step of: when the live wire pin and neutral wire pins are respectively and simultaneously inserted into the corresponding live wire and neutral wire receptacles of the socket body, pushing a first pushing element of the first locking control unit and a second pushing element of the second locking control unit by the live wire pin and the neutral wire pin respectively and moving the first and the second pushing element respectively in the live wire action hole of the sidewall of the live wire receptacle and the neutral wire action hole of the sidewall of the neutral wire receptacle, so as to respectively drive a first actuating element of the first locking control unit and a second actuating element of the second locking control unit to electrically connect the live wore connection circuit and the neutral wire connection; wherein the step (C) further comprises a step of: when the live wire pin and the neutral wire pin of the appliance plug are removed away from the live wire receptacle and the neutral wire receptacle, rendering the first and second locking control units returning to their initial idle state from the operation state.

Preferably, the step (C) further comprises a step of: simultaneously switching on the first live wire connection switch and the first neutral wire connection switch by the first locking control unit and the second live wire connection switch and the second neutral wire connection switch by the second locking control unit, such that the switching on of the first and second neutral wire connection switches electrically connects the neutral wire connection circuit, and the switching on of the first and second neutral wire connection switches electrically connects the neutral wire connection circuit.

Preferably, the step (B) further comprises a step of: in the self-locking state, switching off the first live wire connection switch, the first neutral wire connection switch, the second live wire connection switch, and the second neutral wire connection switch by the first and second locking control units, such that the live wire connection circuit is disconnected with the neutral wire connection circuit.

Preferably, the step (B) further comprises a step of: in the self-locking state, switching on the first live wire connection switch and the first neutral wire connection switch while switching off the second live wire connection switch and the second neutral wire connection switch, or switching on the second live wire connection switch and the second neutral wire connection switch while switching off the first live wire connection switch and the first neutral wire connection switch.

Preferably, the step (B) further comprises a step of: enabling the sizes, shapes and positions of the first pushing element located in the live wire action hole and the second pushing element located in the neutral wire action hole to be arranged in such a manner that, only when the live wire pin and the neutral wire pin of the appliance plug are respectively inserted into the corresponding live wire receptacle and the neutral wire receptacle, the first pushing element located in the live wire action hole and the second pushing element located in the neutral wire action hole are able to be pushed to be activated.

Preferably, the step (C) further comprises a step of: applying acting forces on the braking element along opposite and parallel directions by the first and second actuating elements, rendering the braking element to move in a direction perpendicular to the moving directions of the first and second actuating elements.

Preferably, the locking and controlling mechanism comprises a first locking control unit, a second locking control unit and a braking unit, wherein the first locking control unit is assembled with the second locking control unit by the braking unit. When the first locking control unit and the second locking control unit are activated simultaneously, the braking unit is in the operation state to electrically connect the live wire connection circuit and the neutral wire connection circuit. When only one of the first and second locking control units is activated, the step (B) further comprises a step of: preventing the locking control unit from being activated by the braking unit by the other locking control unit, ensuring the braking unit in the self-locking state to prevent electric shock accident.

Preferably, in the step (C), a positioning member switches to the operation state from the idle state along a moving direction, wherein when the first and second locking control units are activated simultaneously, the acting force generated by each of the first and second locking control units cancels the component forces along perpendicular directions thereof, so as to push or pull the positioning member of the braking unit to move, that ensures each of the first and second locking control units generates enough displacement to electrically connect the live wire connection circuit and the neutral wire connection circuit.

Preferably, in the step (B), when a first pushing member of the first locking control unit tends to move in the corresponding action hole of the sidewall of the respective receptacle to drive a first actuating member to move the positioning member, a second actuating member of the second locking control unit connected to the braking unit makes the positioning member being unable to normally move along the moving direction, such that the positioning member is unable to generate enough displacement, ensuring the first and second actuating members are unable to generate enough displacement normally to electrically connect the live wire connection circuit and the neutral wire connection circuit.

Preferably, the step (C) further comprises a step of: switching the first and the second locking control unit to the idle state from the operation state when the live wire pin and the neutral wire pin of the appliance plug are removed away the corresponding live wire receptacle and the neutral wire receptacle.

Preferably, the application method of the safety socket further comprises a step of: preventing water or other liquid in the live wire receptacle and the neutral wire receptacle entering into the isolation cavity of the safety socket via the corresponding action holes.

Preferably, the application method of the safety socket further comprises a step of: discharging out water or other liquid in the live wire receptacle and the neutral wire receptacle Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
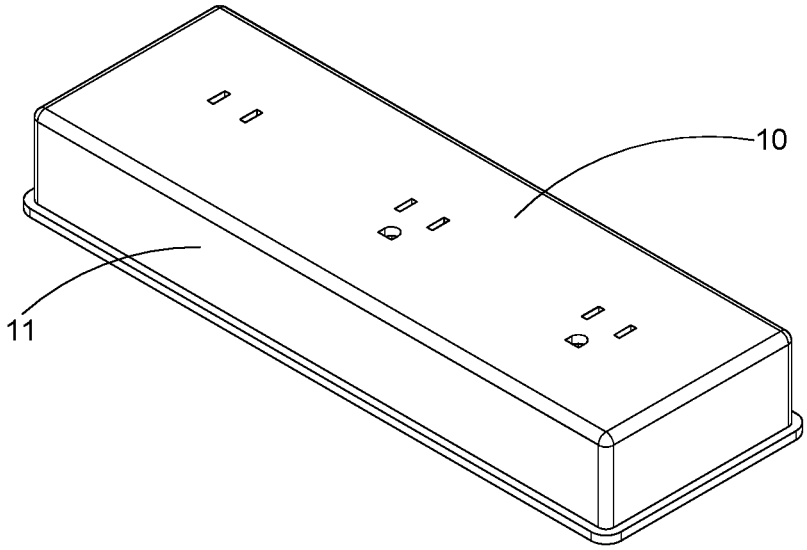
FIG. 1A is a schematic views of a safety socket according to a preferred embodiment of the present invention.
Figure 1B:
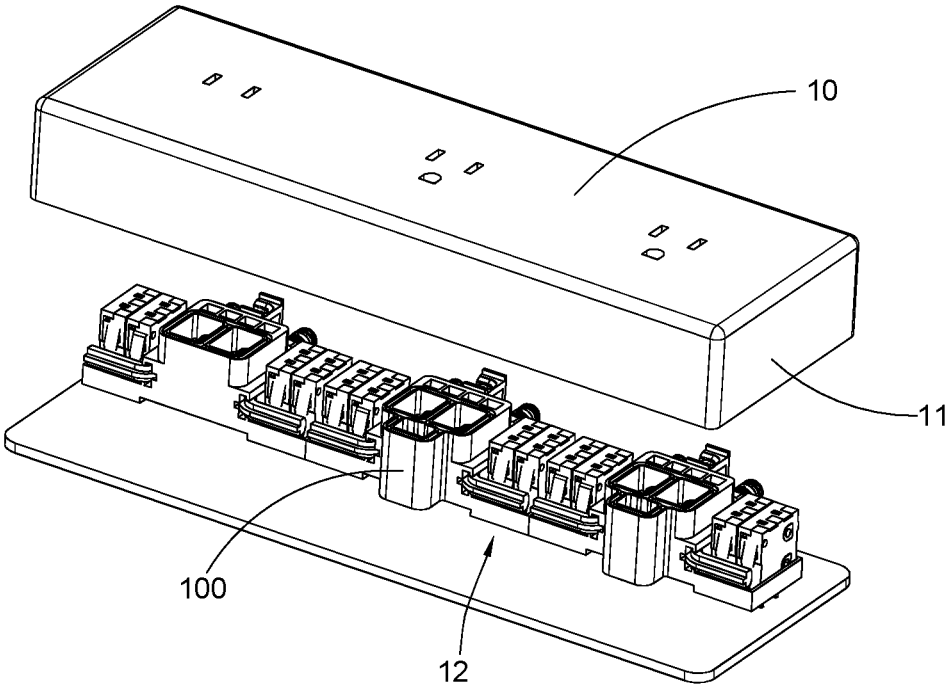
FIG. 1B is an exploded view of the safety socket according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1A to FIG. 4 of the drawings, a safety socket according to a preferred embodiment of the present invention is illustrated, wherein the safety socket 10 comprises at least a socket body 100. It is understandable that certainly in practical applications, the safety socket may comprise one, two, three or multiple socket bodies 100 assembled in a socket shell 11, and the socket body 100 can be, for example, a two-hole jacks socket or three-hole jacks socket, and so on.

According to the preferred embodiment of the present invention, the socket body 100 is embodied as a three-hole jacks socket comprising three circuit connecting units for connecting a live circuit, a neutral circuit and an earth circuit correspondingly. More specifically, the socket body 100 has a live connecting unit 110, a neutral connecting unit 120 and an earth connecting unit 130. The live connecting unit 110 comprises a live wire receptacle 111 and a live wire connection circuit 112. The neutral connecting unit 120 comprises a neutral wire receptacle 121 and a neutral wire connection circuit 122. The earth connecting unit 130 comprises an earth wire receptacle 131 and an earth wire connection circuit 132.

The socket body 100 is adapted to be connected with an appliance plug 21 of an electric appliance 20 to a power supply 30. The power supply 30 can be a direct-current power supply or an alternating-current power supply, such as 110V or 220V, so as to enable the electric appliance 20 working normally or to be charged under the electricity supplied from the power supply 30. The electric appliance 20 can be a variety of electrical equipments or machineries, including but not limited to, television sets, electric lamps, washing machines, air conditioners, refrigerators, electric fans, electric irons, vacuum cleaners, electric stoves, microwaves, toasters, rice cookers, electric water heaters, electric heaters, hair dryers, radios, tape recorders, cameras, stereos, computers, mobile phones, and so on.

According to the preferred embodiment of the present invention, the live wire receptacle 111, the neutral wire receptacle 121 and the earth wire receptacle 131 of the socket body 100 are used for receiving a live wire pin 201, a neutral wire pin 202 and an earth wire pin 203 of the appliance plug 21 respectively. Then, the live wire pin 201, the neutral wire pin 202 and the earth wire pin 203 are electrically and conductively connect to the live wire connection circuit 112, the neutral wire connection circuit 122, and the earth wire connection circuit 132 respectively, so as to electrically connect the electric appliance 20 to the power supply 30 while the earth wire connection circuit 132 plays a role in grounding protection.

Each of the live wire receptacle 111, the neutral wire receptacle 121 and the earth wire receptacle 131 of the socket body 100 comprises an independent chamber. The three chambers are not communicated with each other and can be formed indentedly within the same insulating shell or, alternatively, made by various electrical insulation materials to form the live wire receptacle 111, the neutral wire receptacle 121 and the earth wire receptacle 131 independently and then assembled with each other. Preferably, the live wire receptacle 111 and the neutral wire receptacle 121 are arranged side by side, and the earth wire receptacle 131 is arranged at one side of the live wire receptacle 111 and the neutral wire receptacle 121 and located in a middle position. The socket body 100 further has three receptacle opening holes 113, 123 and 133 provided in an outer side thereof and towards the positions of the live wire receptacle 111, the neutral wire receptacle 121 and the earth wire receptacle 131 respectively, so that the live wire pin 201, the neutral wire pin 202 and the earth wire pin 203 can thus be received in the corresponding live wire receptacle 111, the corresponding neutral wire receptacle 121, and the corresponding earth wire receptacle 131 respectively.

According to the present invention, the socket body 100 further comprises a locking and controlling mechanism 140, wherein only when the locking and controlling mechanism 140 is activated and switched to an operating state, the electric circuit between the appliance plug 21 of the electric appliance 20, the socket body 100 and the power supply 30 can be electrically connected and the electric appliance 20 can work normally.

More specifically, only when the live wire pin 201, the neutral wire pin 202 and the earth wire pin 203 of the standard appliance plug 21 of the electric appliance 20 are respectively inserted into the live wire receptacle 111, the neutral wire receptacle 121 and the earth wire receptacle 131 of the socket body 100 correspondingly and simultaneously, the electrical circuit between the appliance plug 21 of the electric appliance 20, the socket body 100 and the power supply 30 can be electrically connected. According to the present invention, the locking and controlling mechanism 140 is activated by the effect of the earth wire pin 203 of the appliance plug 21 to electrically connect the circuit of the live connecting unit 110 and the circuit of the neutral connecting unit 120. In other words, when the earth wire pin 203 of the appliance plug 21 is inserted into the earth wire receptacle 131 of the socket body 100, the locking and controlling mechanism 140 is activated to electrically connect the electric circuit between appliance plug 21 of the electric appliance 20, the socket body 100 and the power supply 30.

An action hole 134 is formed in a sidewall of the earth wire receptacle 131. The locking and controlling mechanism 140 comprises a pushing element 141, an actuating element 142 and a reset element 143. A first end 1411 of the pushing element 141 penetrates the action hole 134 and extends to the earth wire receptacle 131, while the reset element 143 connects to the pushing element or the actuating element 142. According to the preferred embodiment of the present invention, the reset element 143 can be a reset spring which is connected to the actuating element 142, and an opposite second end 1412 of the pushing element 141 is connected to the actuating element 142.

Furthermore, when the earth wire pin 203 of the appliance plug 21 is inserted into the earth wire receptacle 131 of the socket body 100, the earth wire pin 203 pushes the first end 1411 of the pushing element 141 and the reset element 143, embodied as the reset spring, is removed away from an equilibrium position and results in elastic deformation, being compressed or being stretched. According to the embodiment of the invention, the reset spring is compressed, and the actuating element 142 is adapted for electrically connecting the circuit of the live connecting unit 110 and the circuit of the neutral connecting unit 120, so as to electrically connect the circuit between appliance plug 21 of the electric appliance 20, the socket body 100 and the power supply 30. When the live wire pin 201, the neutral wire pin 202 and the earth wire pin 203 of the appliance plug 21 are all removed away from the live wire receptacle 111, the neutral wire receptacle 121 and the earth wire receptacle 131 of the socket body 100 correspondingly, as a thrust force is not applied on the pushing element 141, the pushing element 141 and the actuating element 142 all return to their initial positions under the restoration action of the reset element 143, embodied as the reset spring, so as to disconnect the electric circuit between appliance plug 21 of the electric appliance 20, the socket body 100 and the power supply 30.

More specifically, the live wire connection circuit 112 of the live connecting unit 110 further comprises a live wire connection switch 114. The neutral wire connection circuit 122 of the neutral connecting unit 120 further comprises a neutral wire connection switch 124. When the live wire pin 201, the neutral wire pin 202 and the earth wire pin 203 of the standard appliance plug 21 of the electric appliance 20 are inserted into the live wire receptacle 111, the neutral wire receptacle 121 and the earth wire receptacle 131 of the socket body 100 respectively and correspondingly at the same time, the earth wire pin 203 pushes the pushing element 141 and further drives the actuating element 142 to move. The live wire connection switch 114 and the neutral wire connection switch 124 are switched to an operating state by the actuating element 142 such that the circuit between appliance plug 21 of the electric appliance 20, the socket body 100 and the power supply 30 is electrically connected and the electric appliance 20 works normally with the electric supply of the power supply 30.

The actuating element 142 can have a variety of components as long as actuating the live wire connection switch 114 and the neutral wire connection switch 124 to switch on. More specifically, according to the preferred embodiment of the present invention, the actuating element 142 comprises a connector element 1421 and two actuating blocks 1422 connected to two sides of the connector element 1421 respectively. A receiving slot 1423, an actuating surface 1424 and an inclined guiding surface 1425 are formed in each of the actuating blocks 1422. The reset element 143, embodied as the reset spring, is connected to the actuating element 142. The live wire connection switch 114 comprises two switch elements 1141, 1142 which are made of electrically conductive materials such as copper, wherein the two switch elements 1141, 1142 are in contact with each other during a working state so as to electrically connect the live wire connection circuit 112.

According to the preferred embodiment of the present invention, the switch element 1141 has a predetermined elasticity, wherein when the pushing element 141 drives the actuating element 142 to move, the actuating surface 1424 drives the switch element 1141 to move toward the switch element 1142 so as to eventually make the two switch elements 1141, 1142 in contact with each other, thereby an electrically conductive connection forms between the two switch elements 1141, 1142. Each of the switch elements 1141, 1142 further comprises a conductive protrusion 1145, 1146 which is protruded and disposed on an contacting end portion 1143, 1144 in such a manner that, during a working state, the two conductive protrusions 1145, 1146 contact with each other so as to form a point-to-point contacting configuration. Thus, the displacement of the pushing element 141 and the actuating element 142 can be reduced and the stability and reliability of the switch element 1141, 1142 are ensured.

It is worth mentioning that the contacting end portions 1143, 1144 of the switch elements 1141, 1142 can be accommodated in the corresponding receiving slot 1423, wherein the two contacting end portions 1143, 1144 are arranged in parallel with each other and at regular intervals. The positions of the two conductive protrusions 1145, 1146 ensure that, when the live wire connection switch 114 is switched on, the two conductive protrusions 1145, 1146 are just in contact with together, while the position of the conductive protrusion 1145 can be slightly higher than the position of the conductive protrusion 1146.

Correspondingly, the neutral wire connection switch 124 comprises two switch elements 1241, 1242 which are made of electrically conductive materials such as copper. The two switch elements 1241, 1242 are in contact with each other during a working state so that the neutral wire connection circuit 122 is electrically connected.

According to the preferred embodiment of the present invention, the switch element 1241 has a predetermined elasticity, wherein when the pushing element 141 drives the actuating element 142 to move, the actuating surface 1424 drives the switch member 1241 to move toward the switch element 1242 that eventually makes the two switch elements 1241, 1242 to contact with each other, thereby an electrically conductive connection forms between the two switch elements 1241, 1242. Each of the switch elements 1241, 1242 further comprises a conductive protrusion 1245, 1246 which is protruded and disposed on an contacting end portion 1243, 1244 in such a manner that, during a working state, the two conductive protrusions 1245, 1246 are contacted with each other so as to form a point-to-point contacting configuration. Thus, the displacement of the pushing element 141 and the actuating element 142 can be reduced and the stability and reliability of the switch elements 1241, 1242 are ensured.

Figure 2:
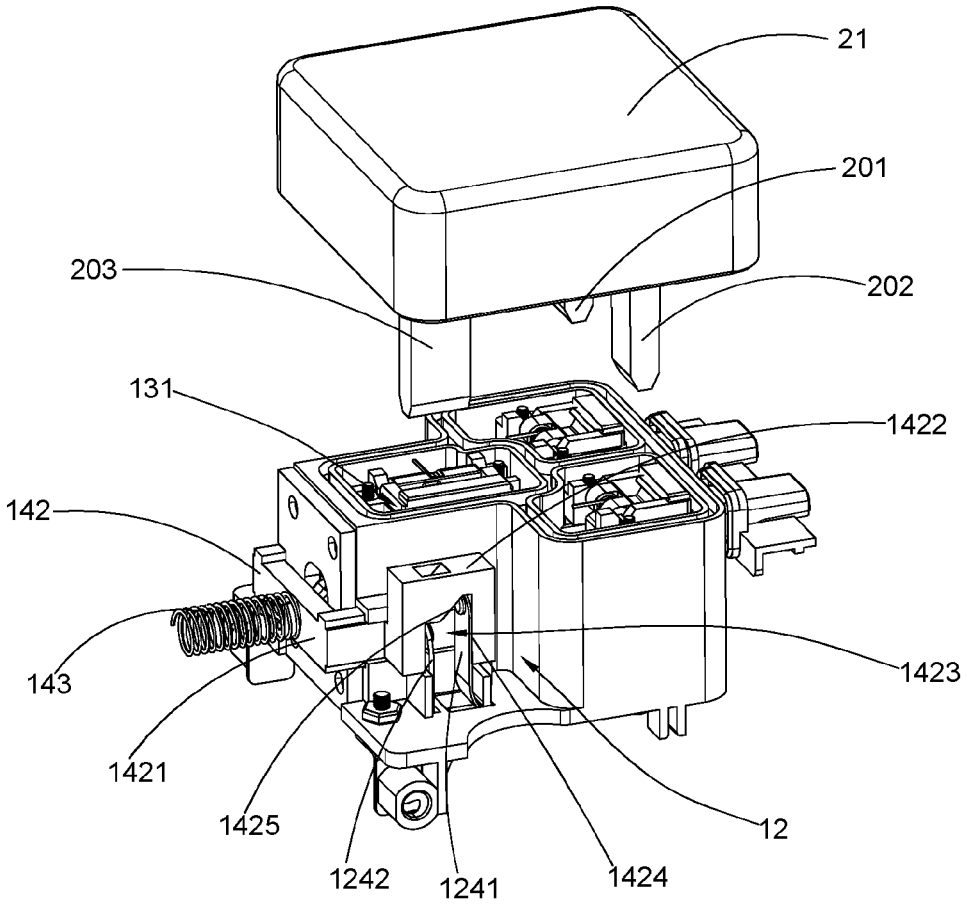
FIG. 2 is a schematic view of the safety socket according to the above preferred embodiment of the present invention when an appliance plug is not inserted into a socket body of the safety socket.

It is worth mentioning that the contacting end portions 1243, 1244 of the switch elements 1241, 1242 can be accommodated in the corresponding receiving slot 1423, wherein the two contacting end portions 1243, 1244 are arranged in parallel to each other and at regular intervals. The positions of the two conductive protrusions 1245, 1246 ensure that, when the neutral wire connection switch 124 is switched on, the two conductive protrusions 1245, 1246 are just in contact with together, and, as shown in FIG. 2, the position of the conductive protrusion 1245 can be slightly higher than the position of the conductive protrusion 1246.

Figure 3:
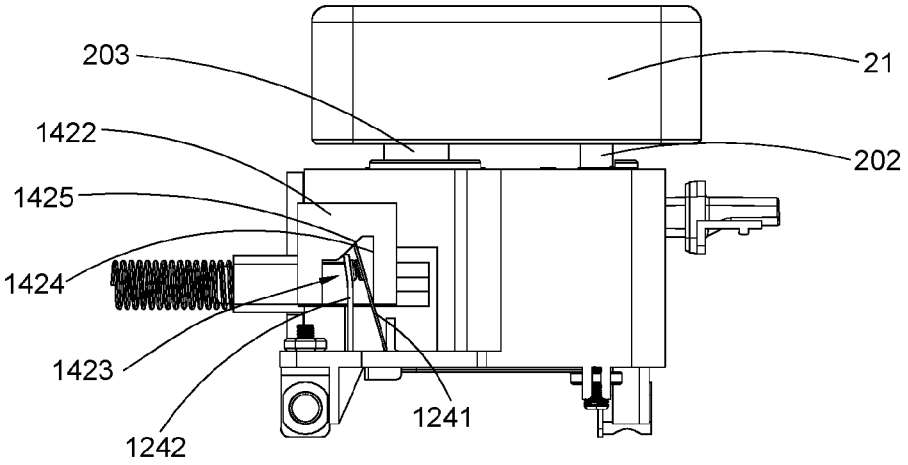
FIG. 3 is a schematic view of the safety socket according to the above preferred embodiment of the present invention when an appliance plug is inserted into a socket body of the safety socket.

In other words, the actuating surface 1424 of the actuating element 142 is adapted for actuating one switch element of the respective connection switches to move, and the inclined guiding surface 1425 further guides the end portion of the switch element to rotate. As shown in FIG. 3, an end portion of the switch element 1241 rotates along the inclined guiding surface 1425 under the driven of the actuating surface 1424 so as to contact with the switch element 1242, so that the neutral wire connection switch 124 is switched on. It is understanding that the live wire connection switch 114 has the same structure of the neutral wire connection switch 124. Furthermore, each of the two switch elements of the live wire connection switch 112 and the neutral wire connection switch 122 can also be embodied in any other ways to contact and separate with each other, such as using a return spring, without limitation to this aspect of the present invention.

It is worth mentioning that the live wire connection switch 112 and the neutral connection switch 122 are at a predetermined interval so as to prevent short circuit resulting from static electricity or electric sparks, and etc. According to the preferred embodiment of the present invention, a distance between live wire connection switch 112 and the neutral connection switch 122 is defined by the two actuating blocks of the actuating element 142, and the actuating element 142 can further play a role of separating the live wire connection switch 112 and the neutral connection switch 122. More specifically, as shown in FIG. 2, the live wire connection switch 112 and the neutral connection switch 122 are respectively provided at two sides of the earth wire receptacle 131 such that the sidewall of the earth wire receptacle 131 is adapted to be used to separate the live wire connection switch 112 and the neutral connection switch 122, thereby further preventing the occurrence of short circuits.

Furthermore, the pushing element 141 and the actuating element 142 return to their initial positions after the plug pins of the appliance plug 21 are moving away from the corresponding socket body 100 according to the resilient and recovery abilities thereof. That is the two switch elements arranged correspondingly return to their initial positions that are spaced apart to each other, thereby the corresponding connection switch is switched off and the corresponding circuit is electrically disconnected.

It is understanding that the actuating element 142 can be embodied as protrusions integrally formed on both sides of the pushing element 141. The reset element 143, embodied as the reset spring, is connected to the pushing element 141. The protrusion is used to drive the corresponding switch element to move to switch on or off the corresponding circuit connection switch. In other words, the actuating element 142 has various modified embodiments and the structure is not limited to the specific embodiments described above.

Figure 1C:
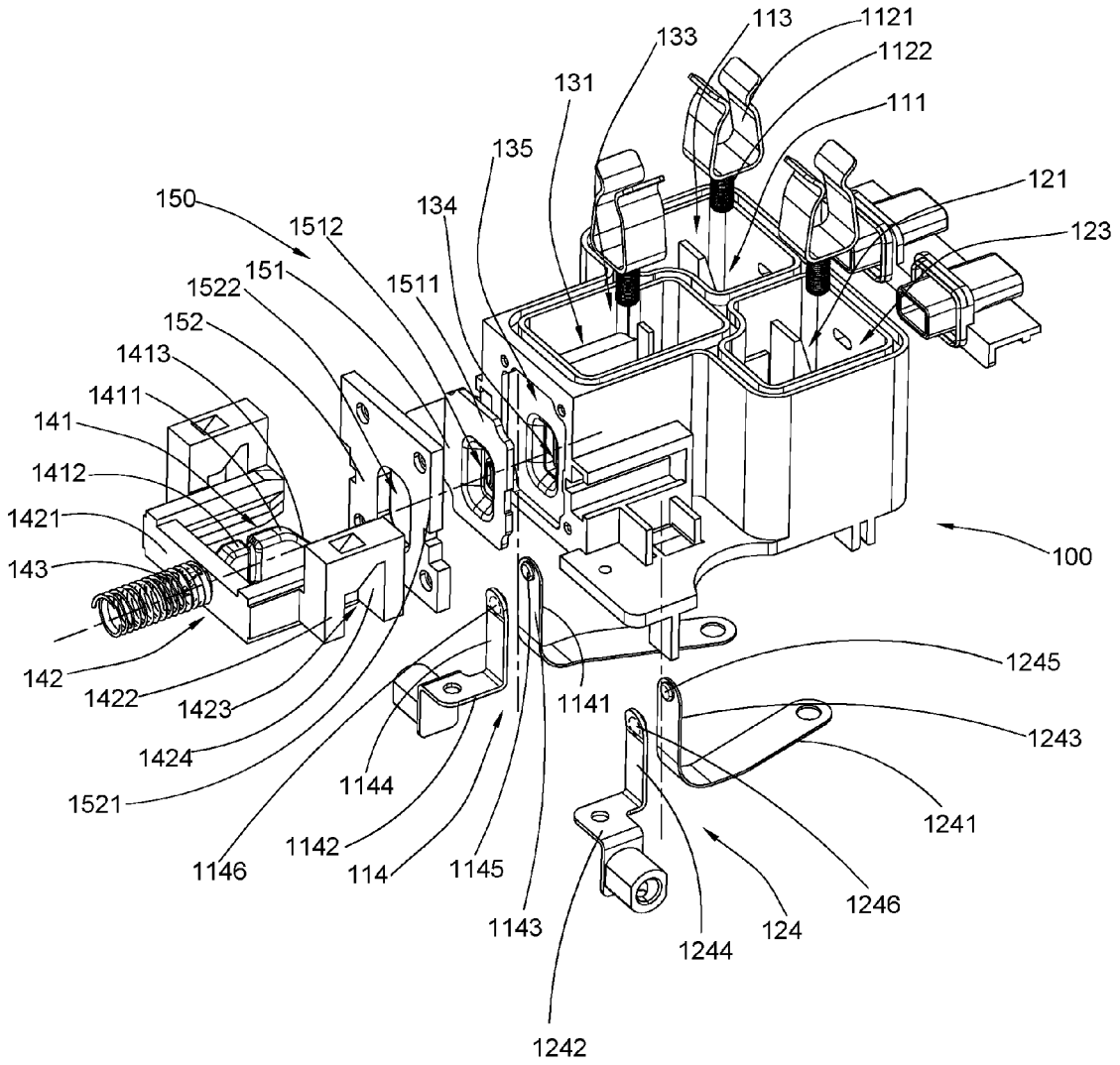
FIG. 1C is an exploded view of the safety socket according to the above preferred embodiment of the present invention.

As shown in FIG. 1C, the first end 1411 of the pushing element 141 further has a sloped surface 1413. The earth wire pin 203 of the appliance plug 21 inserted into the earth wire receptacle 131 pushes downwardly on the sloped surface 1413 to further promote the movement of the pushing element 141 along a horizontal direction in the action hole 134. It is worth mentioning that only when the earth wire pin 203 of the standard appliance plug 21 is inserted into the earth wire receptacle 131, the pushing element 141 can be driven to move. However, an electrical conductive object with a smaller size inserted into the earth wire receptacle 131 is unable to drive the pushing element 141 to move. For example, when a child inserts a thin iron wire into the earth wire receptacle 131, the thin iron wire slides down on the sloped surface 1413, and the pushing force in the horizontal direction is not enough to drive the pushing element 141 to move, thereby further preventing any electric shock. It is worth mentioning that the sloped surface 1413 can be a linear surface with an invariant slope, a curved surface with changeable slope, or a cambered surface such as a protruding spherical surface, a concave surface, and etc.

In other words, the size, shape and position of the first end 1411 of the pushing element 141 is configured to only enable a plug pin of the standard appliance plug 20 to push to move to activate the locking and controlling mechanism 140, thereby ensuring a safety use of the safety socket.

Figure 4:
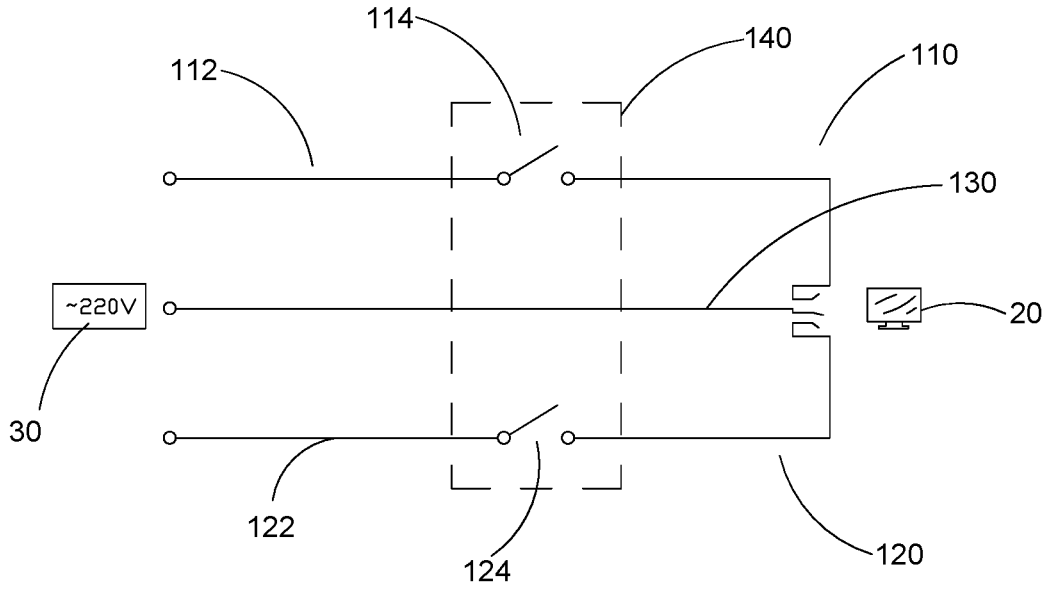
FIG. 4 is a circuit schematic diagram of a socket body of the safety socket according to the above preferred embodiment of the present invention.

On the other hand, as shown in FIG. 4, the socket body 100 provides the live wire connection circuit 112 and the neutral wire connection circuit 122. The live wire connection circuit 112 provides the live wire connection switch 114 and the neutral wire connection circuit 122 provides the neutral wire connection switch 124. The locking and controlling mechanism 140 is adapted for controlling the switch on and off of the live wire connection switch 114 and the neutral wire connection switch 124, thereby controlling the connection and disconnection of the respective circuits. More specifically, according to the preferred embodiment of the present invention, when the earth wire pin 203 of the appliance plug 21 is inserted into the respective earth wire receptacle 131 of the socket body 100, the locking and controlling mechanism 140 is activated to electrically connect the live wire connection circuit 112 and the neutral wire connection circuit 122.

It is worth mentioning that when an electrical conductive object is separately inserted into any of the receptacles of the socket body 100, the conductive object will not be connected to the power supply 30 via the socket body 100 so that no electric shock will be occurred. Specifically, when an electrical conductive object is inserted into the live wire receptacle 111 with no conductive object being inserted into the neutral wire receptacle 121 and the earth wire receptacle 131, since the locking and controlling mechanism 140 is not activated to the working state and is in an idle state, the live wire connection circuit 112 will not electrically connected, thereby there will not have any electric shock occurred. When an conductive object is inserted into the neutral wire receptacle 121 with no conductive object being inserted into the live wire receptacle 111 and the earth wire receptacle 131, similarly, since the locking and controlling mechanism 140 is not activated to the working state and remains in the idle state, the neutral wire connection circuit 122 is still electrically disconnected, thereby there will not have any electric shock occurred. When an electrical conductive object is inserted into the earth wire receptacle 131 with no conductive object being inserted into the live wire receptacle 111 and the neutral wire receptacle 121, the pushing element 141 will not be driven to move to activate the locking and controlling mechanism 140 if the shape and the size of the conductive object do not fit, thereby the electric shock accident is avoided. Even if the conductive object inserting into the earth wire receptacle 131 pushes the pushing element 141 to activate the locking and controlling mechanism 140 and the live wire connection circuit 112 and the neutral wire connection circuit 122 are connected by the locking and controlling mechanism 140, electric shock will still not occur because there is on other conductive object inserting into the live wire receptacle 111 and the neutral wire receptacle 121.

Furthermore, when electrical conductive objects are inserted into both the live wire receptacle 111 and the neutral wire receptacle 121 simultaneously, the conductive objects are electrically connected to live wire receptacle 111 and the neutral wire receptacle 121 respectively. However, since no conductive object is inserted into the earth wire receptacle 131, the locking and controlling mechanism 140 will not be activated and remains in its idle state, thereby the live wire connection switch 114 and the neutral wire connection switch 124, which are arranged for electrically connecting the live wire connection circuit 112 and the neutral wire connection switch 124, are not switched on and electrical connected, thereby no the electric shock will be occurred.

Accordingly, according to the preferred embodiment of the present invention, an application method of a safety socket is provided. Specifically, the application method is an electrical connection method of the appliance plug 21 of the electric appliance and the power supply 30 via the socket body 100 of the safety socket 10. The method comprises the following steps:

(a) When an electrical conductive object is inserted into the live wire receptacle 111 and/or the neutral wire receptacle 121 of the socket body 100, the locking and controlling mechanism is in an idle state, the live wire connection circuit 112 and/or the neutral wire connection circuit 122 of the socket body 100 are electrically disconnected, thereby preventing electric shock from occurring; and (b) When the live wire pin 201, the neutral wire pin 202 and the earth wire pin 203 of the standard appliance plug 21 of the electric appliance 20 are inserted into the live wire receptacle 111, the neutral wire receptacle 121 and the earth wire receptacle 131 of the socket body 100 respectively, the earth wire pin 203 inserted into the earth wire receptacle 131 activates the locking and controlling mechanism 140 to electrically connect the live wire connection circuit 112 and the neutral wire connection circuit 122, thereby the live wire pin 201, the neutral wire pin 202 are electrically connected to the power supply 30 via live wire connection circuit 112 and the neutral wire connection circuit 122 respectively in order to ensure a normal working condition of the electric appliance 20 with the electricity supply from the power supply 30.

In the above step (b), the live wire connection switch 114 adapted for electrically connecting or disconnecting the live wire connection circuit 112 and the neutral wire connection switch 124 adapted for electrically connecting or disconnecting the neutral wire connection circuit 122 are provided in the live wire connection circuit 112 and the neutral wire connection circuit 122 respectively, wherein when the locking and controlling mechanism 140 is in a working state, the locking and controlling mechanism 140 will simultaneously switch on the live wire connection switch 114 and the neutral wire connection switch 124 in such a manner that the whole electric circuit structure is in electrical connection condition and the electric appliance 20 works under the electricity supply of the power supply 30.

Furthermore, in the step (b), the earth wire pin 203 of the earth wire receptacle 131 inserted along a vertical direction pushes the pushing element 141 of the locking and controlling mechanism 140 to move in a horizontal direction so as to drive the actuating element 142 connected to the pushing element 141 to move, so that the actuating element 142 switches on the live wire connection switch 114 and the neutral wire connection switch 124 to electrical connection state. Also, when the earth wire pin 203 is removed away from the earth wire receptacle 131, the pushing element 141 and the actuating element 142 return to their initial positions under the action of the reset element 143, so that the live wire connection switch 114 and the neutral wire connection switch 124 are switched off and in electrical disconnection state. It is worth mentioning that the vertical and horizontal directions as described above are merely example, for the socket body 100 being placed in a horizontal direction. When the socket body 100 is placed in the vertical direction as a wall socket, the earth wire pin 203 will be inserted into the earth wire receptacle 131 along the horizontal direction and pushes the pushing element 141 of the locking and controlling mechanism 140 to move along the vertical direction. Thus, the directions of the pushing movements of the earth wire pin 203 and the pushing element 141 described above are only examples in the embodiment without specific limitation to the present invention. The socket body 100 of the present invention can also be placed aslant in practical applications. According to the preferred embodiment of the present invention, the directions of the movement of the earth wire pin 203 and the pushing element 141 are preferably perpendicular to each other.

Preferably, in the step (b), the pushing element 141 guides the earth wire pin 203 to insert into the earth wire receptacle 131 via the sloped surface 1413, and the earth wire pin 203 is easy to push the pushing element 141 to move in the action hole 134 of the earth wire receptacle 131 so as to further drive the actuating element 142 to move. The two actuating blocks 1422 of the actuating element 142 are respectively used to ensure two switch elements of the live wire connection switch 114 and the neutral wire connection switch 124 contacting with each other, such that the live wire connection circuit 112 and the neutral wire connection circuit 122 are in the electrically connection state. It is worth mentioning that the two switch elements of the respective live wire connection switch 114 and the neutral wire connection switch 124 can form a point-to-point contact. In addition, each of the live wire connection switch 114 and the neutral wire connection switch 124 can be embodied as a micro-move switch. That is to say, driving elements such as press pins, buttons, levers, rollers, and so on apply an external mechanical force on an action reed. When the displacement of the action reed shifts to a critical point and produces an instantaneous action, the movable contact and the constant contact of the end portion of the reed action are rapidly to switch on and off, such that the switch is switched on and switched off. One skilled in art should understand that the structures of the live wire connection switch 114 and the neutral wire connection switch 124 described above can be embodied as other switch structures, that is not intended to be limiting to the two kinds of switch structures described above. As long as each of the live wire connection circuit 112 and the neutral wire connection circuit 122 is electrically connected or disconnected by the live wire connection switch 114 and the neutral wire connection switch 124.

One skilled in the art should understand that each of the live wire connection circuit, the neutral wire connection circuit and the earth wire connection circuit comprises conductive terminals such as coppers provided in each receptacles for electrically and conductively connecting to the live wire pin, the neutral wire pin and the earth wire pin of the appliance plug. Each of the live wire connection circuit and the neutral wire connection circuit further comprises conductive wires which are provided between the live wire connection switch 114 and the neutral wire connection switch 124 while each of the live wire connection circuit 112 and the neutral wire connection circuit 122 is electrically connected with two electric poles of the power supply 30 via the conductive wires.

It is worth mentioning that the socket body 100 may have other configurations, such as various shells, partitions, connectors, circuit boards, and so on. One of the main features of the present invention is to use the locking and controlling mechanism 140 to achieve the electrical connection and the disconnection of the electric circuits so as to prevent any electric shock being occurred. In addition, besides electric conductors for electrically connecting the circuits are provided in the electric circuit configuration, such as the live wire connection circuit, the neutral wire connection circuit, the earth wire connection circuit, the connection switches, and so on, other structures of the socket body 100, such as the locking and controlling mechanism, the shells, and so on, are preferred to be made of insulating materials to prevent short circuit and electric shock.

It is also worth mentioning that each of the live wire connection circuit, the neutral wire connection circuit and the earth wire connection circuit comprises a conductive terminal such as copper provided in each receptacle for electrically and conductively connecting to the live wire pin, the neutral wire pin and the earth wire pin of the appliance plug. Take the live wire connection circuit 112 as an example, the live wire connection circuit 112 comprises a live wire conductive terminal 1121 provided in the live wire receptacle 111, and a conductive screw 1122 correspondingly provided on the outer of the bottom wall of the live wire receptacle 111. The live wire conductive terminal 1121 is affixed by the conductive screw 1122 and other elements. According to the present invention, the material which forms the peripheral wall of each receptacle (at least forming the bottom wall of each receptacle) can be an insulating and heat-resistant material such as ceramic, mica, bakelite or other suitable material, so that the heat of the conductive terminals generated after a long period of time of electricity conduction therethrough will not cause aging deformation thereof and result in any shedding or falling off of components like the conductive terminals and the screws. In addition, the material of the peripheral wall forming the receptacles which are disclosed in the following embodiments can be insulating and heat-resistant materials such as ceramic, mica, bakelite or other suitable materials described above. It is worth mentioning that the specific materials described above are exemplary only and not intended to be limiting the scope of the present invention, and the person skilled in the art may select other suitable heat-resistant material according to the embodiments disclosed above.

The following description further illustrates the waterproof feature of the socket body 100 according to the above preferred embodiment of the present invention. A short circuit will not occur even if there is water or other conductive liquid entering into the receptacles of the socket body 100 so as to ensure a safety use of the safety socket 10 of the present invention according to the above preferred embodiment.

The live wire receptacle 111, the neutral wire receptacle 121 and the earth wire receptacle 131 of the socket body 100 are independently and do not communicate with each other. According to the present invention, the locking and controlling mechanism 140, the live wire connection switch 114 and the neutral wire connection switch 124 are introduced. The socket body 100 further provides an isolation cavity 12. The actuating element 142 of the locking and controlling mechanism 140, the reset element 143, the live wire connection switch 114, and the neutral wire connection switch 124 are disposed in isolation cavity 12. The isolation cavity 12 does not communicate with the live wire receptacle 111, the neutral wire receptacle 121 and the earth wire receptacle 131 in such a manner that water or other conductive liquid cannot enter into the live wire receptacle 111, the neutral wire receptacle 121 and the earth wire receptacle 131 through the isolation cavity 12, thereby a short circuit will not occur in the socket body 100.

According to the preferred embodiment of the present invention, the isolation cavity 12 is formed outside of the live wire receptacle 111, the neutral wire receptacle 121 and the earth wire receptacle 131 of the socket body 100. One skilled in the art should understand that independent isolation chambers which receiving, for example, the live wire connection switch 114 and the neutral wire connection switch 124 can be disposed in part areas of the isolation cavity 12.

It is worth mentioning that the isolation cavity 12 can be formed by the shells, the separation walls or other parts of the socket body 100 and, alternatively, the isolation cavity 12 can also be formed by the socket body 100 and the socket shell 11 of the safety socket 10. The present invention is not intended to be limiting in this aspect, as long as the isolation cavity 12 is isolated with the live wire receptacle 111, the neutral wire receptacle 121 and the earth wire receptacle 131, the locking and controlling mechanism 140 in the isolation cavity 12 selectively and electrically connects or disconnects the live wire connection circuit 112 and the neutral wire connection circuit 122.

Furthermore, the socket body 100 further comprises a sealing member 150 to isolate the isolation cavity 12 with the receptacles of the 100 so as to prevent water or other conductive liquid in the receptacles of the socket body 100 entering into the isolation cavity 12, thereby the socket body 100 has a water-proof feature because of the sealing member 150 and the sealing member 150 prevents the socket body 100 from occurring a short circuit which can result in an electric shock accident.

According to the preferred embodiment of the present invention, since the locking and controlling mechanism 140 is operated by the earth wire pin 203 of the appliance plug 21 and the earth wire receptacle 131, the pushing element 141 of the locking and controlling mechanism 140 is adapted for moving in the action hole 134 of the earth wire receptacle 131 while the action hole 134 must be sealed.

Accordingly, the sealing member 150 comprises a sealer 151. The sealer 151 comprises a sealing body 1511 and a through-hole 1512 is provided in the middle of the sealing body 1511. The through-hole 1512 is corresponding to the action hole 134 of the earth wire receptacle 131. It is worth mentioning that the size and the shape of the through-hole 1512 is arranged in respective with the size and the shape of the pushing element 141 such that the pushing element 141 is able to penetrate through the through-hole 1512 tightly and fittingly. The sealer 151 is made of waterproof materials. The sealer 151 and the pushing element 141 are in frictional contact and the sealer 151 is not easy to be damaged. For example, according to the preferred embodiment, the sealer 151 can be a waterproof silicone ring. The sealer 151 is affixed to the outside of the earth wire receptacle 131 so as to prevent water or other conductive liquid in the earth wire receptacle 131 from entering into the isolation cavity 12 without hindering the normal function and operation of the pushing element 141.

According to the preferred embodiment of the present invention, the outer side wall of the earth wire receptacle 131 forms a locating slot 135 indented inwardly. The sealer 151 is mounted in the locating slot 135 which is arranged in a ring shape. The sealing member 150 further comprises a fixator 152. The fixator 152 comprises a fixator body 1521 and an opening 1522 is formed in the middle of the fixator body 1521. The opening 1522 allows the pushing element 141 penetrating therethrough. The fixator 152 is affixed to the outer side wall of the earth wire receptacle 131 such that the sealer 151 is securely and tightly mounted between the fixator 152 and the outer side wall of the earth wire receptacle 131. The way of fixation may have various structures. For example, using four screws penetrating through fixation holes on the four corners of the fixator 152 and the corresponding fixation holes in the outer side wall of the earth wire receptacle 131 respectively.

It is worth mentioning that the specific configuration of the sealing member 150 is exemplary only and not intended to be limiting the scope of the present invention. One skilled in the art may think of other alternative waterproof structures. According to the present invention, the sealing member 150 is mainly used to prevent water or other conductive liquid entered in the socket body 100 from influencing the operations of electrically connecting or disconnecting of the live wire connection circuit 112 and the neutral wire connection circuit 122 by the locking and controlling mechanism 140.

Referring to the FIG. 5 to FIG. 23, a schematic structural view of a safety socket 10 according to the second preferred embodiment is illustrated, the safety socket 10 comprises at least one socket body 200. It is understandable that certainly in practical applications, the safety socket may comprise one, two, three or multiple socket bodies 200 assembled in a socket shell 11, wherein the socket body 100 can be, for example, a two-hole jacks socket or three-hole jacks socket, and so on.

According to the preferred embodiment of the present invention, the socket body 200 is embodied as a three-hole jacks socket comprising three circuit connecting units for connecting a live circuit, a neutral circuit and an earth circuit correspondingly. More specifically, as shown in FIG. 5 to FIG. 23, the socket body 200 has a live connecting unit 210, a neutral connecting unit 220 and an earth connecting unit 230. The live connecting unit 210 comprises a live wire receptacle 211 and a live wire connection circuit 212. The neutral connecting unit 220 comprises a neutral wire receptacle 221 and a neutral wire connection circuit 222. The earth connecting unit 230 comprises an earth wire receptacle 231 and an earth wire connection circuit 232.

The socket body 200 is adapted to be connected with an appliance plug 21 of an electric appliance 20 to a power supply 30. The power supply 30 can be a direct-current power supply or an alternating-current power supply, such as 110V or 220V, so as to enable the electric appliance 20 working normally or to be charged under the electricity supplied from the power supply 30.

According to the preferred embodiment of the present invention, the live wire receptacle 211, the neutral wire receptacle 221 and the earth wire receptacle 231 of the socket body 200 are used for receiving a live wire pin 201, a neutral wire pin 202 and an earth wire pin 203 of the appliance plug 21 respectively. Then, the live wire pin 201, the neutral wire pin 202 and the earth wire pin 203 are electrically and conductively connect to the live wire connection circuit 212, the neutral wire connection circuit 222 and the earth wire connection circuit 232 respectively, so as to electrically connect the electric appliance 20 to the power supply 30 while the earth wire connection circuit 232 plays a role in grounding protection.

Each of the live wire receptacle 211, the neutral wire receptacle 221 and the earth wire receptacle 231 of the socket body 200 comprises an independent chamber. The three chambers are not communicated with each other and can be formed indentedly within the same insulating shell or, alternatively, made by various electrical insulation materials to the live wire receptacle 211, the neutral wire receptacle 221 and the earth wire receptacle 231 independently and then assembled with each other. Preferably, the live wire receptacle 211 and the neutral wire receptacle 221 are arranged side by side, and the earth wire receptacle 231 is arranged at one side of the live wire receptacle 211 and the neutral wire receptacle 221 and located in a middle position. The socket body 200 further comprises three receptacle opening holes 213, 223 and 233 provided in an outer side thereof and towards the positions of the live wire receptacle 211, the neutral wire receptacle 221 and the earth wire receptacle 231 respectively, so that the live wire pin 201, the neutral wire pin 202 and the earth wire pin 203 can thus be received in the corresponding live wire receptacle 211, the corresponding neutral wire receptacle 221, and the corresponding earth wire receptacle 231 respectively.

According to the present invention, the socket body 200 further comprises a locking and controlling mechanism 240, wherein only when the locking and controlling mechanism 240 is activated and switched to an operating state, the electric circuit between the appliance plug 21 of the electric appliance 20, the socket body 200 and the power supply 30 can be electrically connected and the electric appliance 20 can work normally.

More specifically, only when the live wire pin 201, the neutral wire pin 202 and the earth wire pin 203 of the standard appliance plug 21 of the electric appliance 20 are respectively inserted into the live wire receptacle 211, the neutral wire receptacle 221 and the earth wire receptacle 231 of the socket body 200 correspondingly and simultaneously, the electrical circuit between the appliance plug 21 of the electric appliance 20, the socket body 200 and the power supply 30 can be electrically connected.

According to the preferred embodiment of the present invention, the locking and controlling mechanism 240 is activated by the simultaneously inserting action of the live wire pin 201 and the neutral wire pin 202 of the appliance plug 21 so as to respectively and electrically connect the circuit of the live connecting unit 210 and the circuit of the neutral connecting unit 220. In other words, when the live wire pin 201 and the neutral wire pin 202 of the appliance plug 21 are respectively and simultaneously inserted into the corresponding 211 and the 221 of the socket body 200, the locking and controlling mechanism 240 is activated to electrically connect the electric circuit between appliance plug 21 of the electric appliance 20, the socket body 200 and the power supply 30. The structure of the preferred embodiment of the present invention is different from the structure of the above first preferred embodiment, wherein the locking and controlling mechanism 140 is activated by the earth wire pin 203 of the appliance plug 21 according to the first embodiment, while the locking and controlling mechanism 240 in this present invention is activated by the simultaneously inserting action of the live wire pin 201 and the neutral wire pin 202.

Furthermore, the locking and controlling mechanism 240 includes a first locking control unit 241, a second locking control unit 242 and a braking unit 243. A live wire action hole 216 is provided in the sidewall of the live wire receptacle 211, and a neutral wire action hole 226 is provided in the sidewall of the neutral wire receptacle 221. The first locking control unit 241 is positioned and mounted through the live wire action hole 216 and the second locking control unit 242 is positioned and mounted through the neutral wire action hole 226.

The first locking control unit 241 comprises a first pushing element 2411, a first actuating element 2412 and a first reset element 2413. The first pushing element 2411 penetrates through the live wire action hole 216. The first actuating element 2412 is mounted on the first pushing element 2411 or is integrally formed with the first pushing element 2411. The first reset element 2413 is mounted on the first pushing element 2411 or the first actuating element 2412. According to the preferred embodiment of the present invention, the first reset element 2413 is mounted on the first actuating element 2412. When the live wire pin 201 of the appliance plug 21 is inserted into the live wire receptacle 211 of the socket body 200, the live wire pin 201 drives the first pushing element 2411 to move such that the first pushing element 2411 further drives the first actuating element 2412 to move, thereby the first locking control unit 241 is in a working state and, further, the first reset element 2413 is deformed. The first reset element 2413 can be embodied as a reset spring such that the first reset element 2413 can be compressed or being stretched. According to the preferred embodiment, the first reset element 2413 embodied as the reset spring is compressed. When the live wire pin 201 of the appliance plug 21 is removed away from the live wire receptacle 211 of the socket body 200, the first actuating element 2412 and the first pushing element 2411 return to their initial position under the effect of the first reset element 2413.

The first locking control unit 242 comprises a second pushing element 2421, a second actuating element 2422 and a second reset element 2423. The second pushing element 2421 penetrates through the neutral wire action hole 226. The second actuating element 2422 is mounted on the second pushing element 2421 or is integrally formed with the second pushing element 2421. The second reset element 2423 is mounted on the second pushing element 2421 or the second actuating element 2422. According to the preferred embodiment of the present invention, the second reset element 2423 is mounted on the second actuating element 2422. When the neutral wire pin 202 of the appliance plug 21 is inserted into the neutral wire receptacle 221 of the socket body 200, the neutral wire pin 202 drives the second pushing element 2421 to move such that the second pushing element 2421 further drives the second actuating element 2422 to move, thereby the second locking control unit 242 is in a working state and further the second reset element 2423 is deformed. The second reset element 2423 can be embodied as a reset spring such that the second reset element 2423 is a spring being compressed or being stretched. According to the preferred embodiment, the second reset element 2423 embodied as the reset spring is compressed. When the neutral wire pin 202 of the appliance plug 21 is removed away from the neutral wire receptacle 221 of the socket body 200, the second actuating element 2422 and the second pushing element 2421 return to their initial position under the effect of the second reset element 2423.

According to the preferred embodiment of the present invention, only when the live wire pin 201 and the neutral wire pin 202 of the appliance plug 21 are respectively and simultaneously inserted into the live wire receptacle 211 and the neutral wire receptacle 221 of the socket body 200, the live wire connection circuit 212 and the neutral wire connection circuit 222 can be electrically connected.

More specifically, the live connecting unit 210 further comprises a first live wire connection switch 214 and a second live wire connection switch 215 so as to control the electrical connection and disconnection of the live wire connection circuit 212. Only when the first live wire connection switch 214 and the second live wire connection switch 215 are all in a connected state, the live wire connection circuit 212 can be in an electrically connected state. While at least one of the first live wire connection switch 214 and the second live wire connection switch 215 is in an electrically disconnected state, the live wire connection circuit 212 is in an electrically disconnected state.

Accordingly, the neutral connecting unit 220 further comprises a first neutral wire connection switch 224 and a second neutral wire connection switch 225 so as to control the electrical connection and disconnection of the neutral wire connection circuit 222. Only when the first neutral wire connection switch 224 and the second neutral wire connection switch 225 are all in an electrically connected state, the neutral wire connection circuit 222 can be in an electrically connected state. While at least one of the first neutral wire connection switch 224 and the second neutral wire connection switch 225 is in an electrically disconnected state, the neutral wire connection circuit 222 is in an electrically disconnected state.

The first locking control unit 241 is used to control the switch on and the switch off of the first live wire connection switch 214 and the first neutral wire connection switch 224. The second locking control unit 242 is used to control the switch on and the switch off of the second live wire connection switch 215 and the second neutral wire connection switch 225. Thus, when the live wire pin 201 and the neutral wire pin 202 of the appliance plug 21 are respectively and simultaneously inserted into the live wire receptacle 211 and the neutral wire receptacle 221 of the socket body 200, the live wire pin 201 activates the first locking control unit 241 such that the first live wire connection switch 214 and the first neutral wire connection switch 224 are switched on, and that the neutral wire pin 202 activates the second locking control unit 242 such that the second live wire connection switch 215 and the second neutral wire connection switch 225 are switched on, wherein the live wire connection circuit 212 and the neutral wire connection circuit 222 are on the electrically connected state and the electric circuit between the appliance plug 21 of the electric appliance 20, the socket body 200 and the power supply 30 is electrically connected to ensure the normal working of the electric appliance 20.

Accordingly, in other words, the present invention provides a safety socket 10, which comprises at least one socket body 200. The socket body 200 comprises the live wire connection circuit 212 and the neutral wire connection circuit 222. The live wire connection circuit 212 provides the first live wire connection switch 214 and the second live wire connection switch 215, and the neutral wire connection circuit provides the first neutral wire connection switch 224 and the second neutral wire connection switch 225. The socket body 200 further comprises the locking and controlling mechanism 240 comprising the first locking control unit 241 and the second locking control unit 242. The first locking control unit 241 is used to switch on and switch off the corresponding first live wire connection switch 214 and the first neutral wire connection switch 224, and the second locking control unit 242 is used to switch on and switch off the corresponding second live wire connection switch 215 and the second neutral wire connection switch 225, so as to control the electrical connection and disconnection of the whole electric circuit of the socket body 200. The live wire action hole 216 and the neutral wire action hole 226 associate with the corresponding live wire pin 201 and the corresponding neutral wire pin 202 of the appliance plug 21 such that the first locking control unit 241 and the second locking control unit 242 play a relevant role in the control effect.

Only when the first live wire connection switch 214 and the second live wire connection switch 215 are all in an electrically connected state, the live wire connection circuit 212 can be in an electrically connected state. While only when the first neutral wire connection switch 224 and the second neutral wire connection switch 225 are all in an electrically connected state, the neutral wire connection circuit 222 can be in an electrically connected state. According to the preferred embodiment of the present invention, the first locking control unit 241 and second locking control unit 242 respectively control the switch on and the switch off of a set of the live wire connection switch 215 and the neutral wire connection switch 225. In other words, the first locking control unit 241 controls the switch on and the switch off of the first live wire connection switch 214 and the first neutral wire connection switch 224, and the second locking control unit 242 controls the switch on and the switch off of the second live wire connection switch 215 and the second neutral wire connection switch 225. Only when the first locking control unit 241 and the second locking control unit 242 both under working condition, the live wire connection circuit 212 and the neutral wire connection circuit 222 can be in an electrically connected state. If only one of the first live wire connection 214 and the second locking control unit 242 is in the working condition, the live wire connection circuit 212 and the neutral wire connection circuit 222 are unable to be electrically connected and in an electrically disconnected state.

It is worth mentioning that each of the first pushing element 2411 of the first locking control unit 241 and the second pushing element 2421 of the second locking control unit 242 further has a sloped surface 2414, 2424. When the live wire pin 201 and the neutral wire pin 202 of the appliance plug 21 are respectively inserted into the live wire receptacle 211 and the neutral wire receptacle 221 and press the sloped surface 2414, 2424 downwardly, the vertically downward movements of the live wire pin 201 and the neutral wire pin 202 respectively transform to pushing the first pushing element 2411 and the second pushing element 2421 moving in the action hole along a horizontal direction. The structures of the first pushing element 2411 and the second pushing element 2421 are provided in such a manner that only when the pins of the appliance plug 21 are inserted into the corresponding earth wire receptacle 231, the pushing element 2421 can be pushed to move. However, when a smaller size conductive object is inserted into one of the live wire receptacle 211 and the neutral wire receptacle 221, the pushing element 2421 cannot be pushed to move. For example, when a child inserts a thin iron wire into the live wire receptacle 211, the thin iron wire will simply slide down on the sloped surface 2414, 2424, and the pushing force in the horizontal direction will not enough to drive the first pushing element 2411 and the second pushing element 2421 to move, thereby further preventing any electric shock. It is worth mentioning that the sloped surface 2414, 2424 can be a linear surface with an invariant slope, a curved surface with changeable slope, or a cambered surface such as a protruded spherical surface an indented curved surface, and etc.

In other words, the sizes, shapes and positions of the first pushing element 2411 and the second pushing element 2421 are configured to be only being driven to move by the standard plug pin of the standard appliance plug 20 in order to activate the locking and controlling mechanism 240, thereby ensuring a safety use of the safety socket.

The first actuating element 2412 of the first locking control unit 241 further comprises a first staring element 2415. The starting element 2415 is used to simultaneously switch on and switch off the first live wire connection switch 214 and the first neutral wire connection switch 224. Accordingly, the second actuating element 2422 of the second locking control unit 242 further comprises a second starting element 2425. The second starting element 2425 is used to simultaneously switch on and switch off the second live wire connection switch 215 and the second neutral wire connection switch 225.

According to the preferred embodiment of the present invention, each of the first live wire connection switch 214, the second live wire connection switch 215, the first neutral wire connection switch 224, and the second neutral wire connection switch 225 can be embodied as a micro-move switch and is switched on by the pressing effect of the first staring element 2415 and the second starting element 2425. When the first staring element 2415 and the second starting element 2425 are removed away, each of the first live wire connection switch 214, the second live wire connection switch 215, the first neutral wire connection switch 224, and the second neutral wire connection switch 225 is switched off. It is appreciated that one skilled in the art should understand that each of the first live wire connection switch 214, the second live wire connection switch 215, the first neutral wire connection switch 224, and the second neutral wire connection switch 225 can also be embodied as other switch structures, such as conductive metal sheets and etc., and the present invention is not intended to be limiting in this respect.

Figure 5:
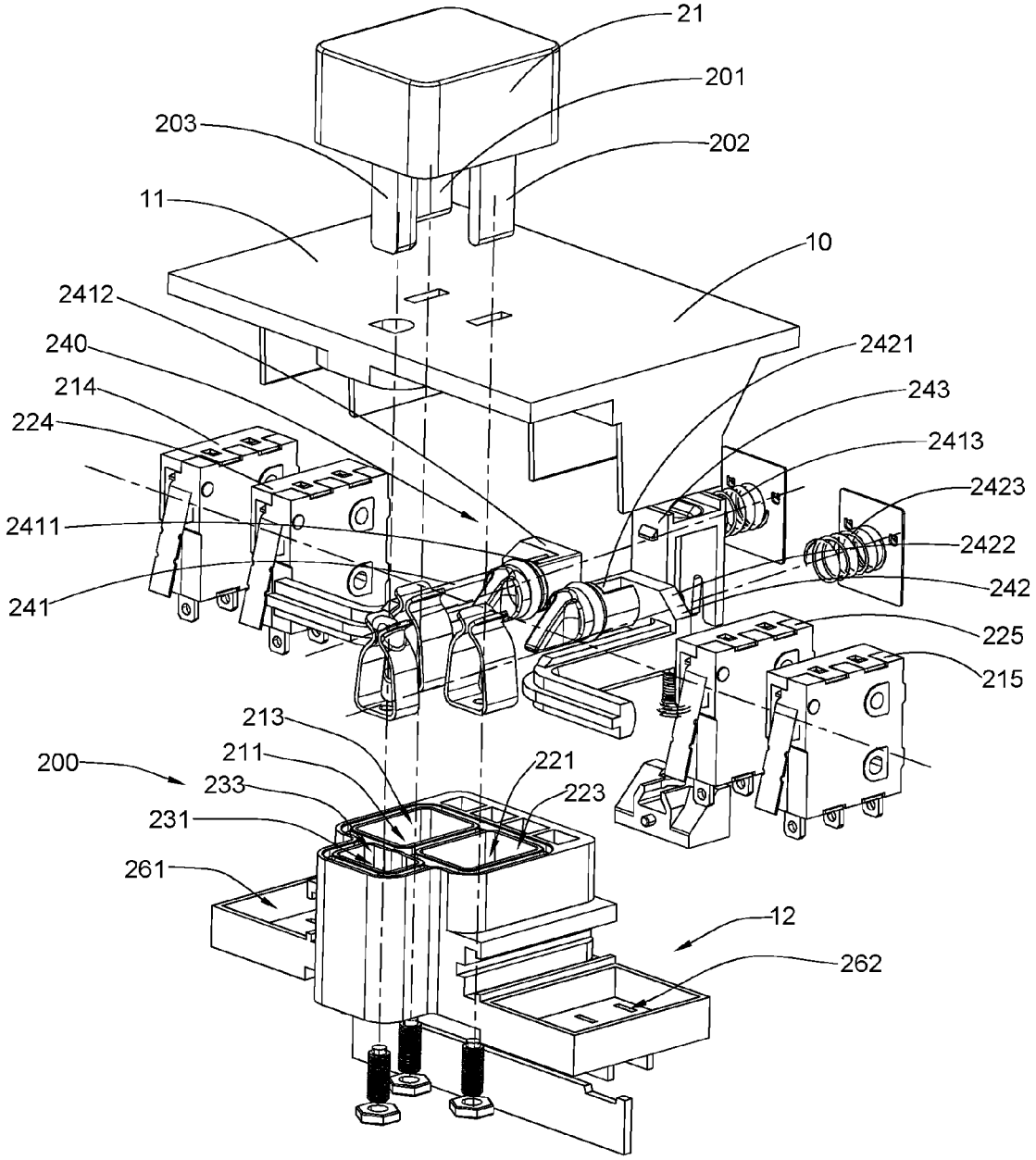
FIG. 5 is an exploded schematic view of a safety socket according to a second preferred embodiment of the present invention.

Furthermore, as shown in FIG. 5, two bearing grooves 261, 262 of the socket body 200 are respectively formed in two sides of the live wire receptacle 211, the neutral wire receptacle 221 and the earth wire receptacle 231. The two bearing grooves 261, 262 are respectively used to receive the first live wire connection switch 214 and the first neutral wire connection switch 224, and the second live wire connection switch 215 and the second neutral wire connection switch 225.

According to the preferred embodiment of the present invention, the locking and controlling mechanism 240 further comprises the braking unit 243. When the first locking control unit 241 and the second locking control unit 242 are simultaneously started, the braking unit 243 makes the first locking control unit 241 and the second locking control unit 242 to work in a normal state. However, when only one of the first locking control unit 214 and the second locking control unit 242 is started, the braking unit 243 prevents the other locking control unit from operating so as to ensure only one set of the live and neutral wire connection switches of the set of the first live wire connection switch 214 and the first neutral wire connection switch 224 and the set of the second live wire connection switch 215 and the second neutral wire connection switch 225 is switched on, while the other set of the live and neutral wire connection switches is switched off, such that the whole live wire connection circuit 212 and the neutral wire connection circuit 222 are still in electrically disconnected state so as to prevent any accident of electric shock.

Figure 6:
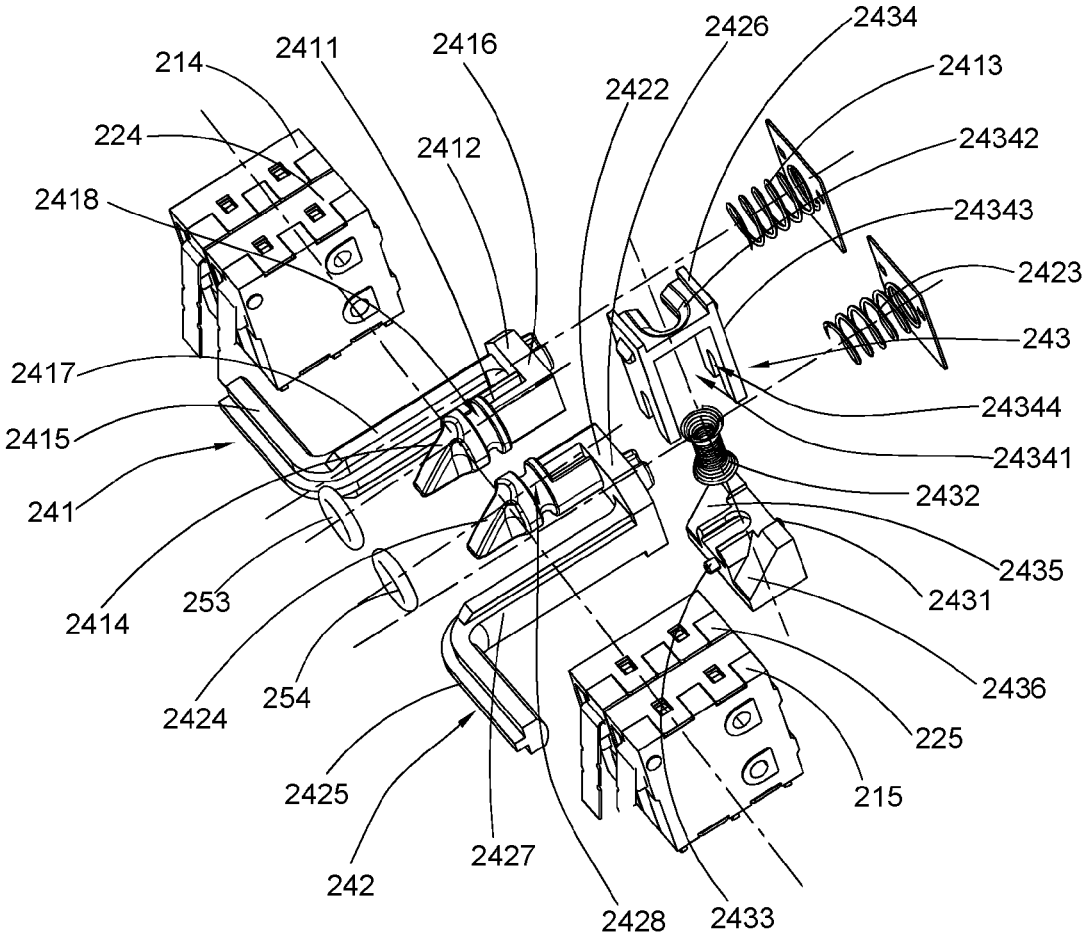
FIG. 6 is an exploded schematic view of a locking and controlling mechanism of the safety socket according to the above preferred embodiment of the present invention.
Figure 7:
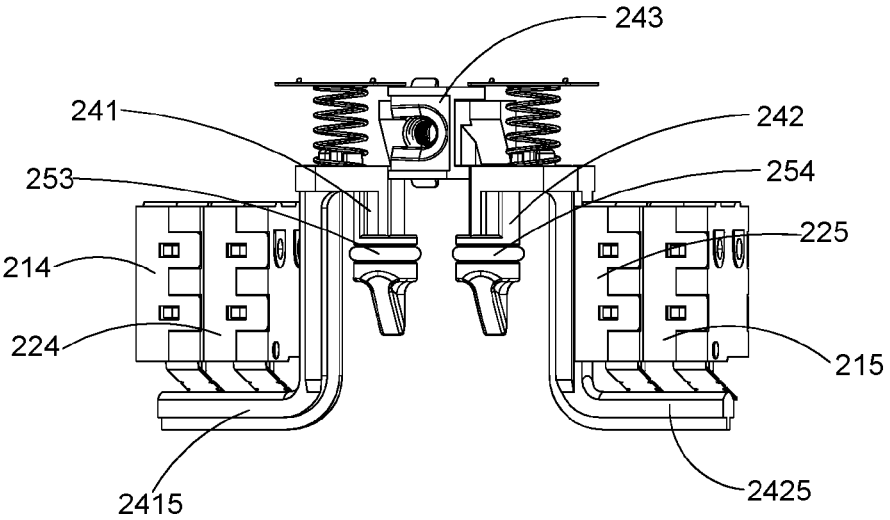
FIG. 7 is a schematic view of a locking and controlling mechanism of the safety socket according to the above preferred embodiment of the present invention.
Figure 8:
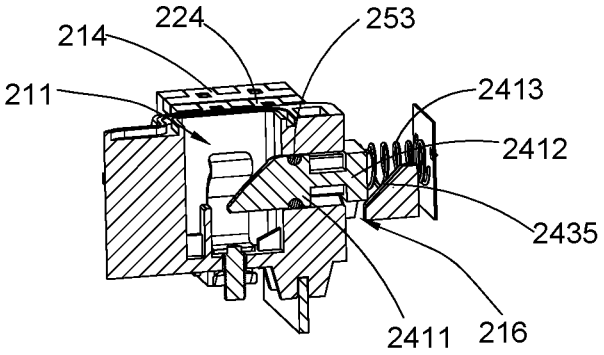
FIG. 8 is a schematic view of a socket body of the safety socket according to the above preferred embodiment of the present invention.
Figure 9:
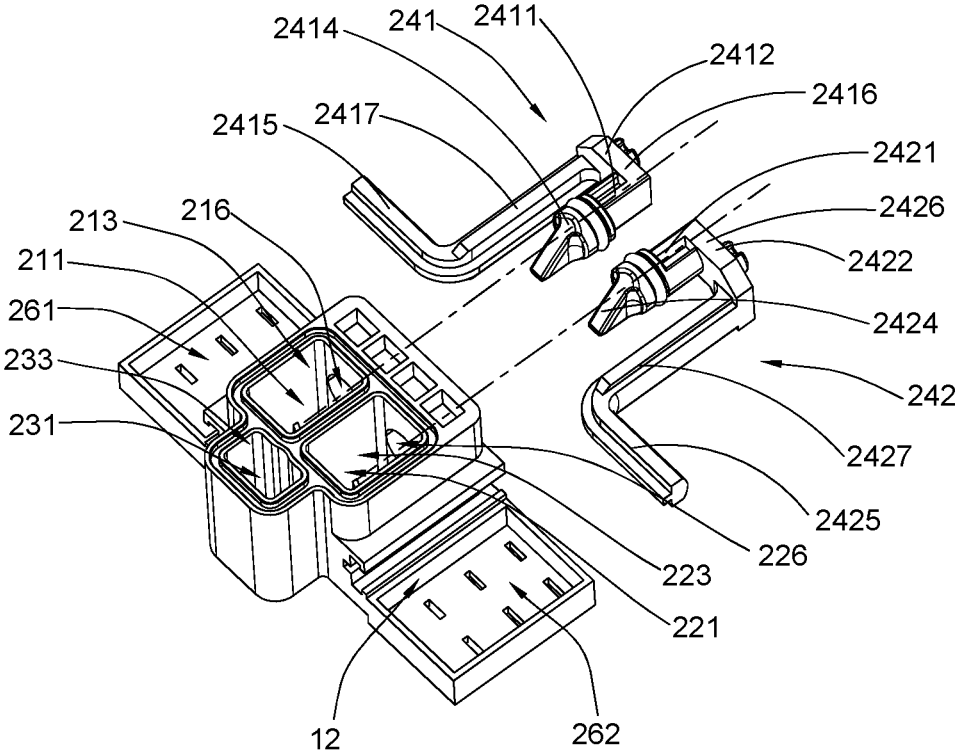
FIG. 9 is a perspective view of the safety socket according to the above preferred embodiment of the present invention when a locking control unit of the locking and controlling mechanism of the socket body is not assembled with the receptacles of the socket body.
Figure 10:
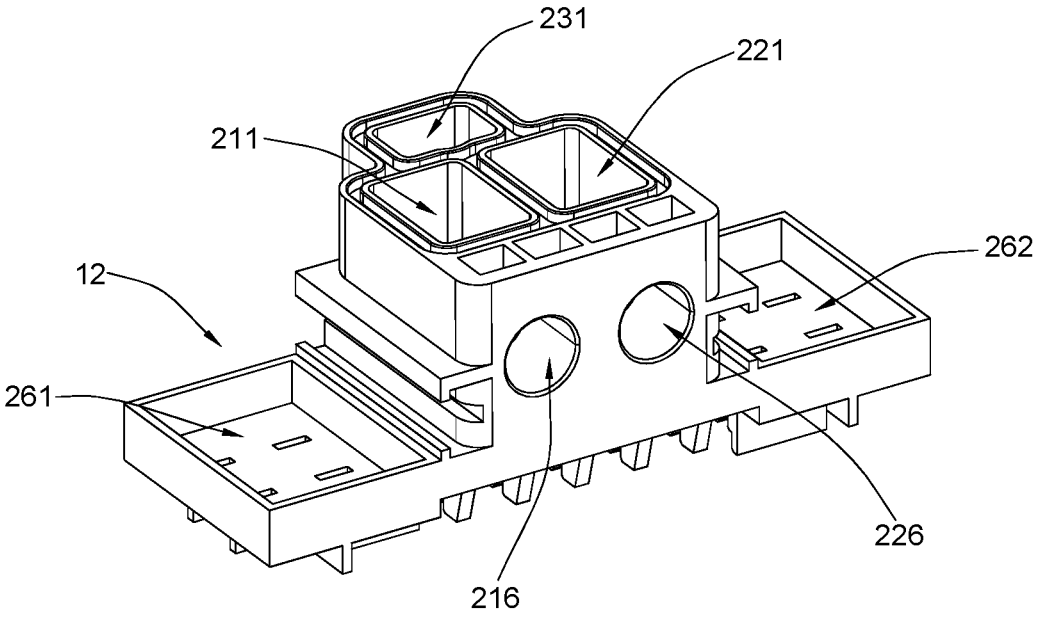
FIG. 10 is a perspective view of receptacles of the safety socket and an isolation cavity of the safety socket according to the above preferred embodiment of the present invention.
Figure 11:
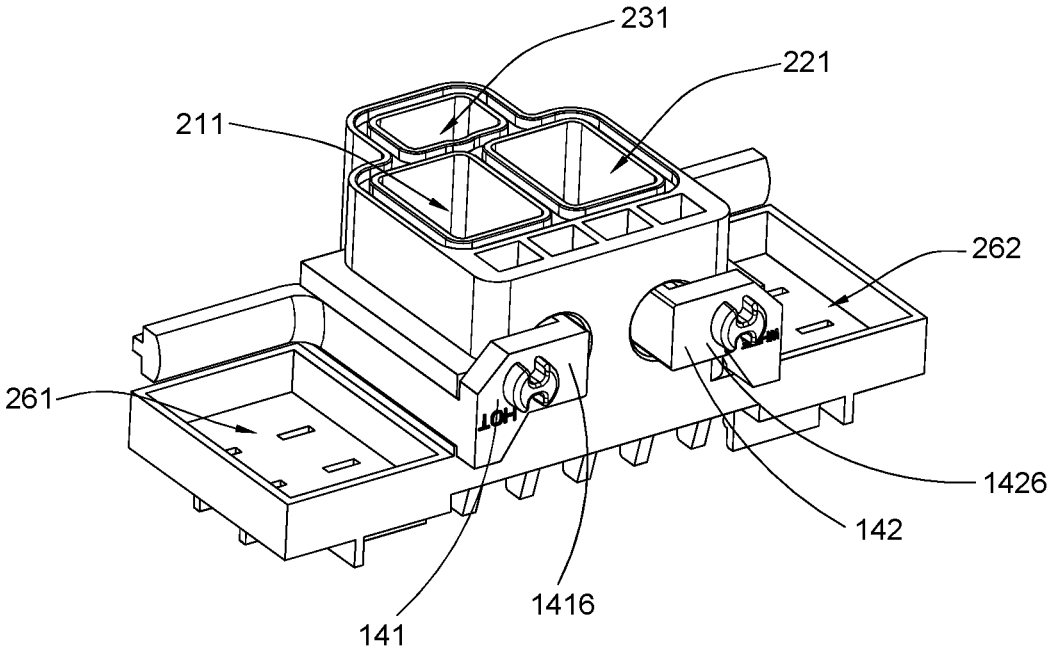
FIG. 11 is a perspective view of the safety socket according to the above preferred embodiment of the present invention when the locking control unit is assembled with the receptacles.
Figure 12:
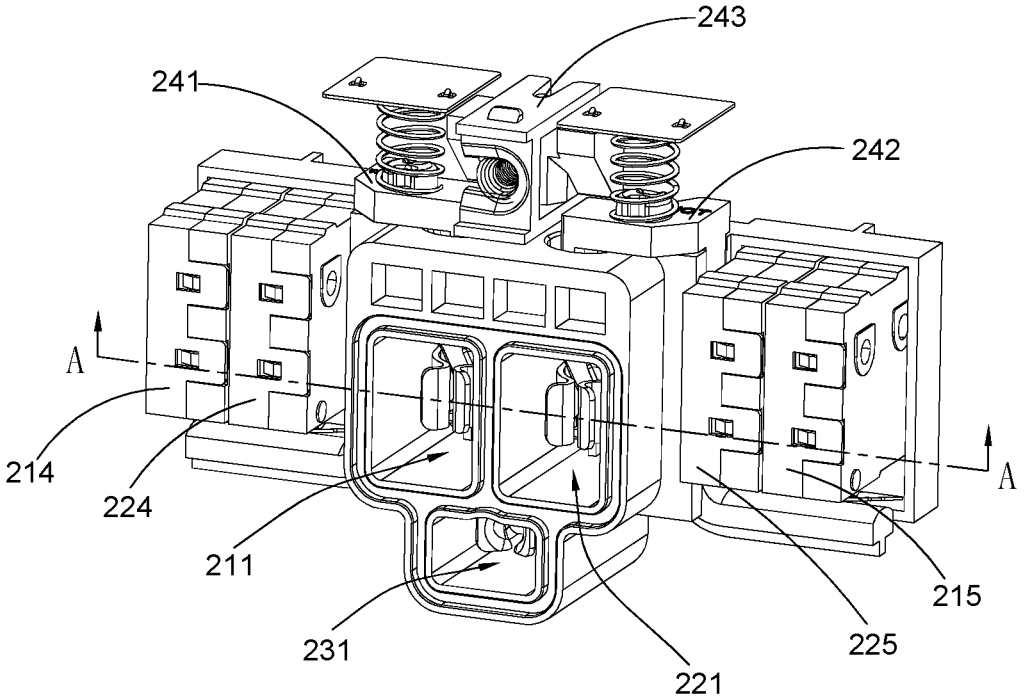
FIG. 12 is a perspective view of the safety socket according to the above preferred embodiment of the present invention when the locking control unit is assembled with the receptacles.
Figure 13:
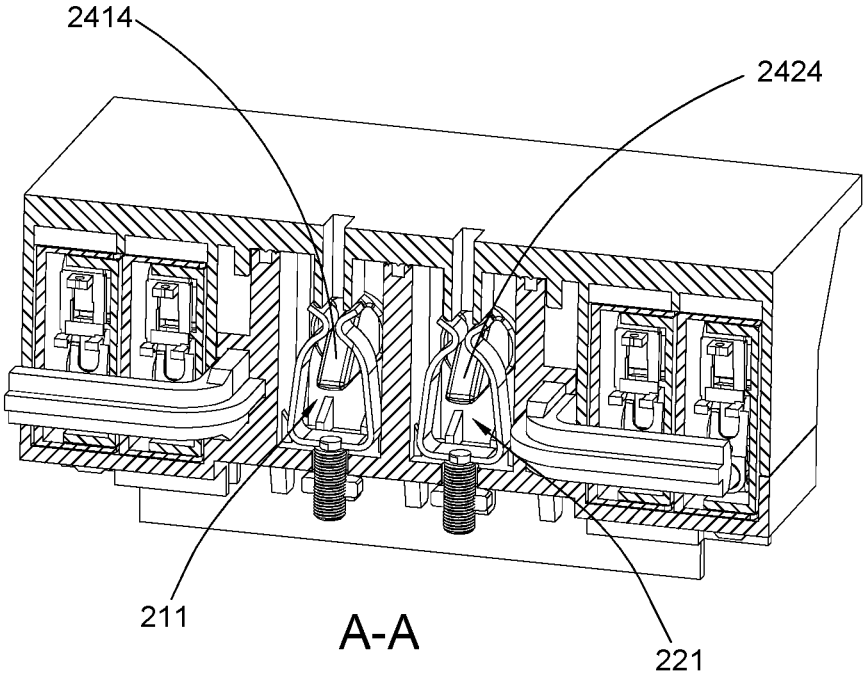
FIG. 13 is a sectional view taken along line A-A in FIG. 12 of the safety socket according to the above preferred embodiment of the present invention.

More specifically, as shown in FIG. 6, the braking unit 243 comprises a braking element 2431, a restraining element 2432, a rotating shaft 2433, and an installing element 2434. The braking element 2431 provides a first effect surface 2435 and a second effect surface 2436. The first effect surface 2435 and the second effect surface 2436 are symmetrically provided on two sides of the braking element 2431 respectively. The restraining element 2432 is mounted on the braking element 2431 such that the braking element 2431 resets to an initial state after completion of the working state. For example, the restraining element 2432 is a restricting spring. When the braking element 2431 is in a working state, the restricting spring is elastically deformed which is compressed or stretched. When the braking element 2431 is in an idle state, the restricting spring returns to its initial equilibrium position. Furthermore, one end of the restraining element 2432 is fixed to the braking element 2431 and the other end is fixed to the installing element 2434. It is worth mentioning that one skilled in the art should understand that the other end of the restraining element 2432 may not fixed to the braking element 2431 but is fixed on either of the top wall, the bottom wall or the side wall of the socket body 200, or the inner surface of the socket shell 11.

The rotating shaft 2433 is mounted on the braking element 2431 such that the braking element 2431 is adapted for rotating around the rotating shaft 2433, and the braking element 2431 can move along a direction where the restraining element 2432 extending to, and consequently, the braking element 2431 is adapted for completing two different motions, that are the rotational motion and linear motion according to the preferred embodiment of the present invention.

The installing element 2434 forms a retaining groove 24341 for receiving the braking element 2431 and retaining the position of the braking element 2431. In other words, the braking element 2431 is just adapted for moving in the retaining groove 24341. More specifically, the installing element 2434 comprises a base portion 24342 and two flanks 24343 extending from the base portion 24342. The retaining groove 24341 is formed between the base portion 24342 and the two flanks 24343, and a guiding groove 24344 is formed in each flanks 24343. Two ends of the rotating shaft 2433 respectively extend to the guiding groove 24344 so as to move in the guiding groove 24344, and the guiding groove 24344 has a position restricting effect on the rotating shaft 2433. Furthermore, the restraining element 2432 is adapted for mounting on the base portion 24342 of the installing element 2434.

In addition, the first effect surface 2435 and the second effect surface 2436 of the braking element 2431 are provided outside of the retaining groove 24341 such that the first effect surface 2435 and the second effect surface 2436 are adapted for moving by the actuation of the first actuating element 2412 and the second actuating element 2422 and driving the braking element 2431 to produce motions.

Accordingly, the first actuating element 2412 further comprises a first actuating body 2416. The first actuating body 2416, under the driven action of the first pushing element 2411, acts on the first effect surface 2435 to drive the braking unit 243 to produce corresponding movement. The second actuating element 2422 further comprises a second actuating body 2426. The second actuating body 2426, under the driven action of the second pushing element 2421, acts on the second effect surface 2436 to drive the braking unit 243 to produce corresponding movement.

Figure 14:
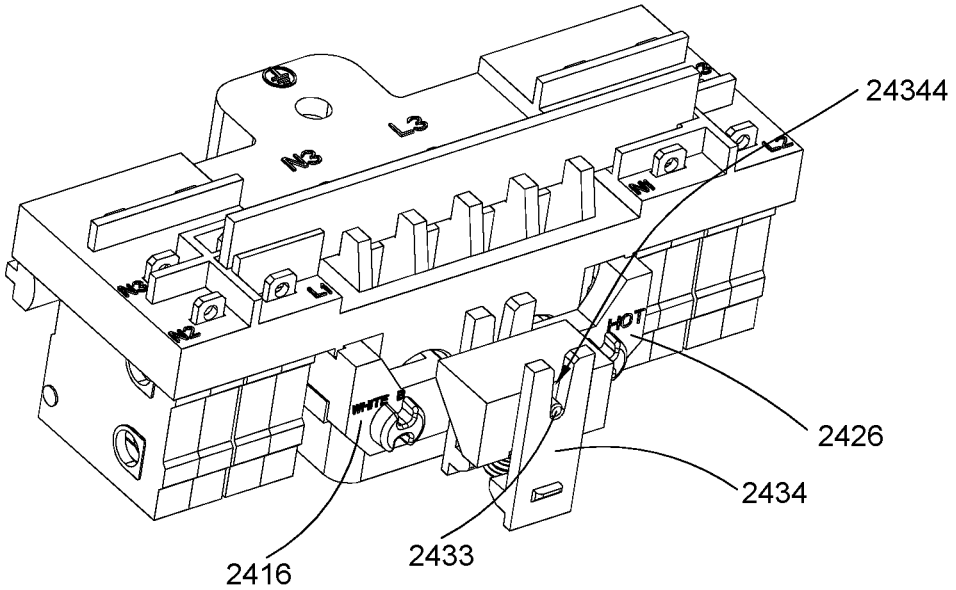
FIG. 14 is a schematic view of a braking unit of the safety socket according to the above preferred embodiment of the present invention when the safety socket is not working.

More specifically, as shown in FIG. 14, when the live wire receptacle 211 and the neutral wire receptacle 221 of the socket body 200 are not inserted into the live wire pin 201 and the neutral wire pin 202 of the appliance plug 21, the first locking control unit 241 and the second locking control unit 242 are in an idle state and the braking unit 243 is in an idle state correspondingly, such that the braking element 2431 is in its initial position and the restraining element 2432 does not have any deformation, and the live wire connection switch and the neutral wire connection switch of the socket body 200 are switched off, thereby the live wire connection circuit 212 and the neutral wire connection circuit 222 are electrically disconnected.

Alternatively, when electrical conductive objects such as thin iron wires are inserted to the live wire receptacle 211 and the neutral wire receptacle 221 of the socket body 200, wherein the sizes, the shapes of the conductive objects and the pushing force thereof are unable to drive the first pushing element 2411 and the second pushing element 2421, the first locking control unit 241 and the second locking control unit 242 are in an idle state such that the live wire connection circuit 212 and the neutral wire connection circuit 222 are electrically disconnected.

Figure 15:
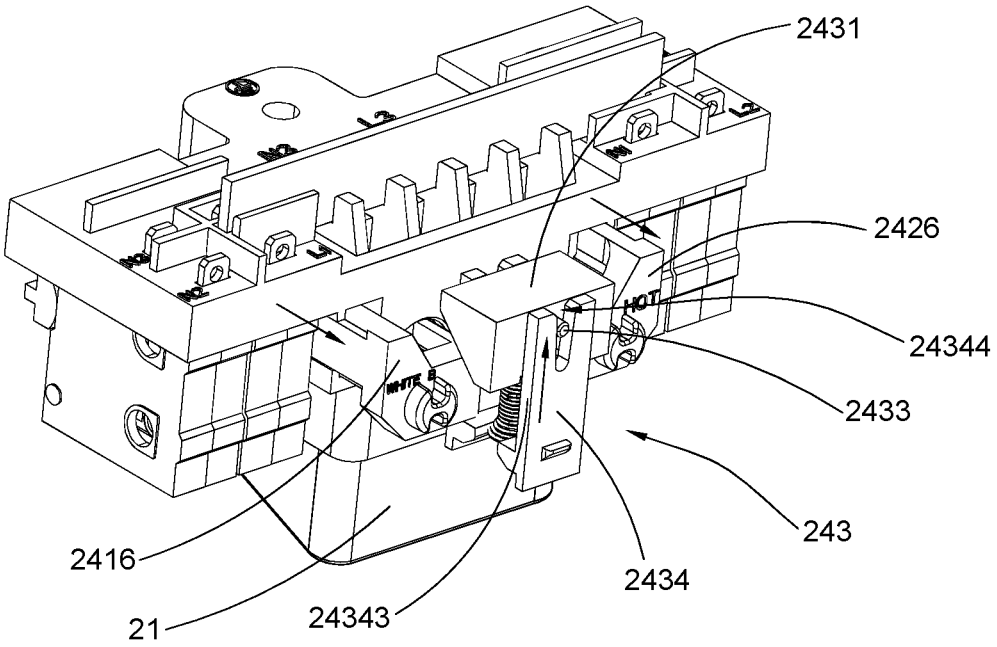
FIG. 15 is a perspective view of the socket body of the safety socket with an appliance plug inserted therein according to the above preferred embodiment of the present invention.

As shown in FIG. 15, when the live wire receptacle 211 and the neutral wire receptacle 221 of the socket body 200 are simultaneously inserted into the live wire pin 201 and the neutral wire pin 202 of the socket body 200, the live wire pin 201 and the neutral wire pin 202 respectively activate the first locking control unit 241 and the second locking control unit 242. More specifically, the live wire pin 201 and the neutral wire pin 202 respectively push the first pushing element 2411 and the first actuating element 2412, such that the corresponding first actuating body 2416 of the first actuating element 2412 and the corresponding second actuating body 2426 of the second actuating element 2422 act on the first effect surface 2435 and the second effect surface 2436 of the braking element 2431 respectively.

According to the preferred embodiment of the present invention, when the socket body 200 is placed in the horizontal direction, the first pushing element 2411 and the first actuating element 2412 drive the first actuating body 2416 of the first actuating element 2412 and the second actuating body 2426 of the second actuating element 2422 along the same direction and parallel with each other to produce pushing acts so as to respectively apply pushing forces to the first effect surface 2435 and the second effect surface 2436 of the braking element 2431. The two symmetrical sides of the braking element 2431 experience pushing forces applied from the same direction such that the braking element 2431 moves in the retaining groove 24341 along the vertical direction, and that the restraining element 2432 embodied as a restricting spring is compressed or stretched, such that the rotating shaft 2433 moves in the 24344 along the vertical direction. One skilled in the art should understand that the vertical directional movement is exemplary only, wherein when the socket body 200 is placed in the vertical direction, embodied as a wall socket, the braking element 2431 and the rotating shaft 2433 can also move along the horizontal direction, the present invention is not intended to be limited in this aspect.

When the live wire pin 201 and the neutral wire pin 202 of the appliance plug 21 are removed away from the live wire receptacle 211 and the neutral wire receptacle 221 of the socket body 200, under the actions of an elastic restoring force of the restraining element 2432, the first effect surface 2435 and the second effect surface 2436 of the braking element 2431 conversely apply pushing forces on the first actuating body 2416 of the first actuating element 2412 and the second actuating body 2426 of the second actuating element 2422, such that the corresponding first actuating element 2412 and the second actuating element 2422 are driven and the first pushing element 2411 and the first actuating element 2412 return to their initial positions.

Preferably, the first effect surface 2435 and the second effect surface 2436 of the braking element 2431 are embodied as sloped surfaces so as to easy be pushed by the first actuating body 2416 of the first actuating element 2412 and the second actuating body 2426 of the second actuating element 2422. The configuration of the sloped surfaces makes the pushing movements of the first actuating body 2416 of the first actuating element 2412 and the second actuating body 2426 of the second actuating element 2422 in the horizontal direction respectively act on the first effect surface 2435 and the second effect surface 2436 of the braking element 2431. It is worth mentioning that the sloped surfaces of the first effect surface 2435 and the second effect surface 2436 can be linear surface with an invariant slope, a curved surface, or a cambered surface such as a protruded spherical surface, an indented curved surface, and etc.

In addition, the first pushing element 2411 and first actuating element 2412 of the first locking control unit 241 can be fixed and assembled together, or be formed integrally. The first actuating element 2412 comprises the first staring element 2415, the first actuating body 2416 and, further, a connection element 2417 connecting the first staring element 2415 and the first actuating body 2416 to form a three-section structure such as a Z-shaped structure. It is worth mentioning that the three-section structure here is exemplary only and not intended to be limited in this aspect.

Accordingly, the second pushing element 2421 and the second actuating element 2422 of the second locking control unit 242 can be fixed and assembled together, or be formed integrally. The second actuating element 2422 comprises the second starting element 2425, the second actuating body 2426 and, further, a connection element 2427 connecting the second starting element 2425 and the second actuating body 2426 to form a three-section structure such as a Z-shaped structure. Similarly, the three-section structure here is exemplary only and not intended to be limited in this aspect.

It is worth mentioning that person skilled in the art may think of any other structural deformations of the first actuating element 2412 and the second actuating element 2422 as long as the motion of the braking element 2431 is completed and the corresponding live wire connection switch and the neutral wire connection switch are electrically connected and disconnected.

According to the preferred embodiment of the present invention, when the braking element 2431 is driven by the first locking control unit 241 and the second locking control unit 242 to move along the vertical direction under the working state, the corresponding first staring element 2415 of the first actuating element 2412 of the first locking control unit 241 electrically connects the first live wire connection switch 214 and the first neutral wire connection switch 224 and, simultaneously, the second starting element 2425 of the second actuating element 2422 of the second locking control unit 242 electrically connects the second live wire connection switch 215 and the second neutral wire connection switch 225, such that the live wire connection circuit 212 and the neutral wire connection circuit 222 are in an electrically connected state.

When the live wire pin 201 and the neutral wire pin 202 of the appliance plug 21 are removed away from the live wire receptacle 211 and the neutral wire receptacle 221, the first effect surface 2435 and the second effect surface 2436 of the braking element 2431 conversely apply pushing forces on the first actuating element 2412 and the second actuating element 2422 under the actions of an elastic restoring force of the restraining element 2432, so as to drive the corresponding first staring element 2415 and the second starting element 2425 to their initial positions in such a manner that the first live wire connection switch 214 and the first neutral wire connection switch 224 are switched off and the live wire connection circuit 212 and the neutral wire connection circuit 222 are in an electrically disconnected state.

Figure 16A:
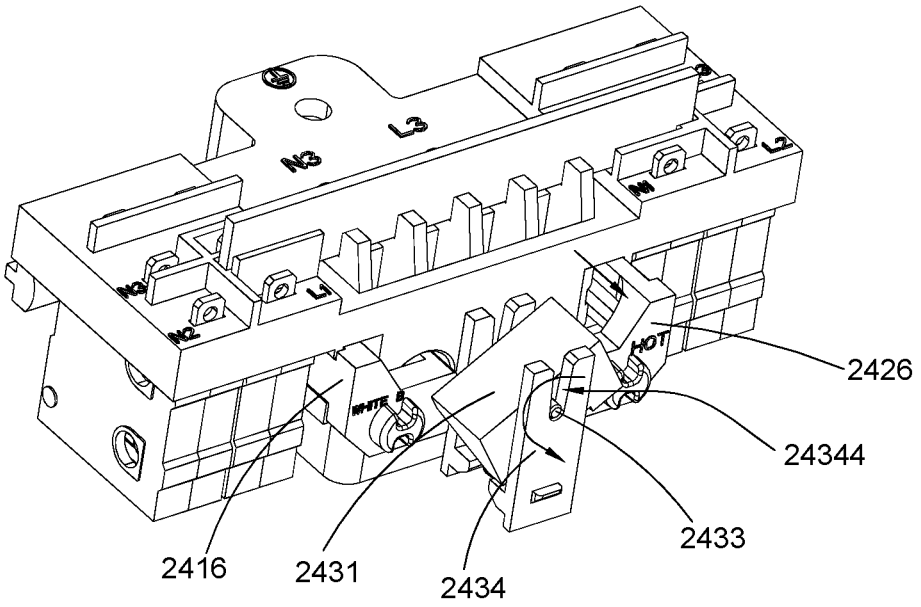
FIGS. 16A, 16B and 17 are perspective views of the safety socket according to the above preferred embodiment of the present invention when a receptacle is inserted into an electrical conductive object.
Figure 16B:
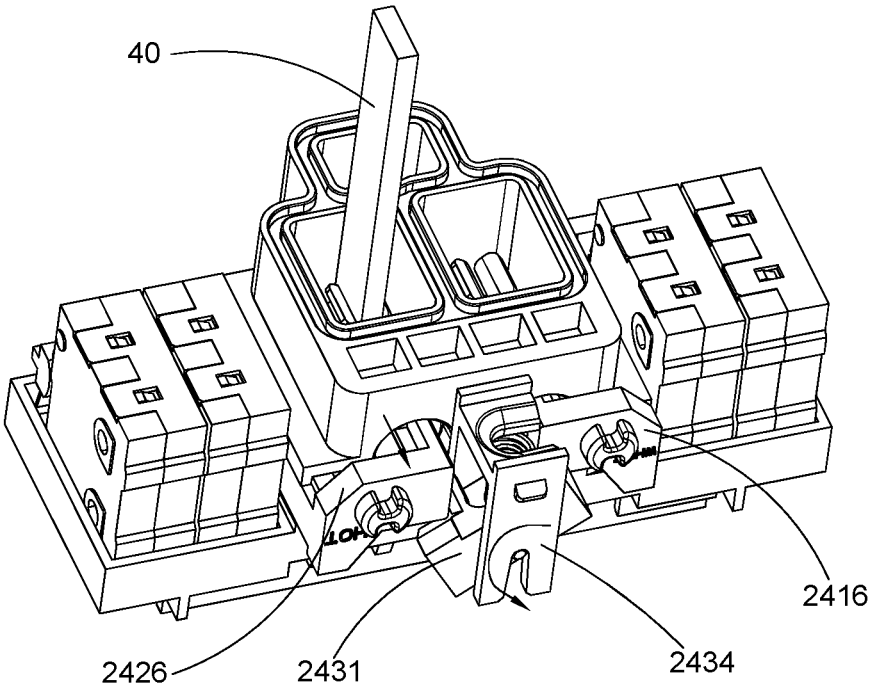
Figure 17:
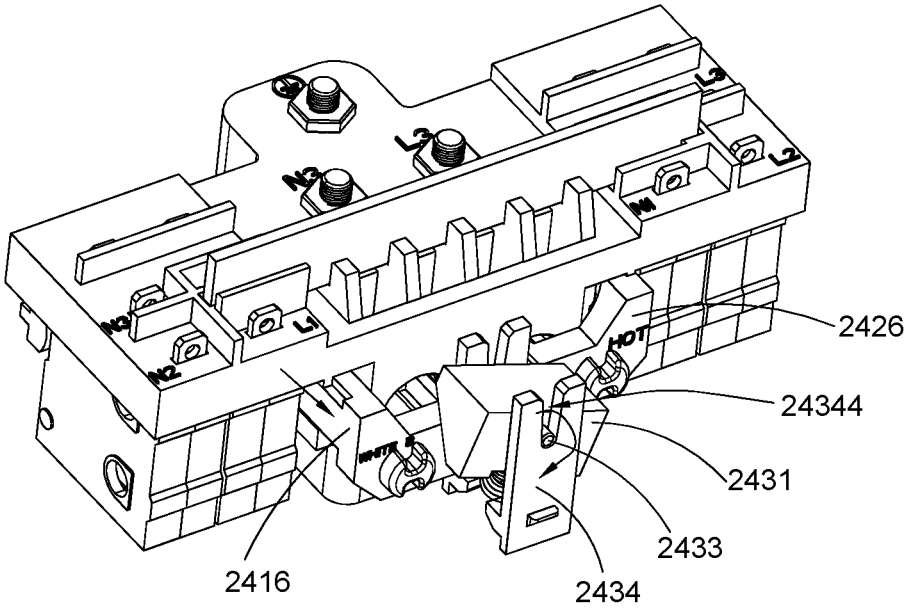
Figure 18:
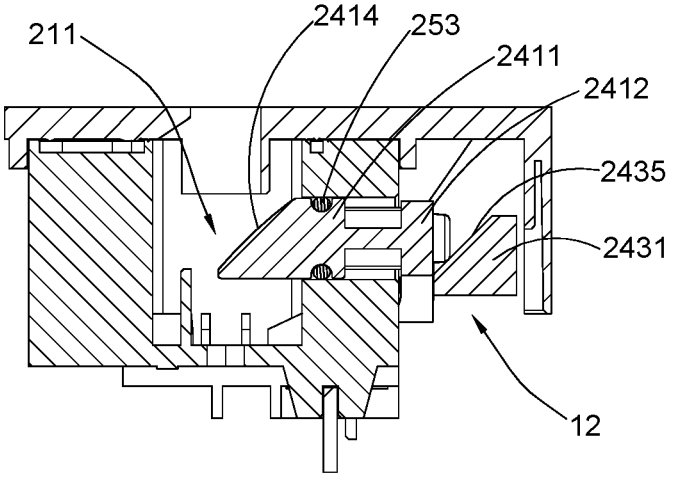
FIG. 18 is a sectional view of the safety socket with the appliance plug inserted into the receptacles according to the above preferred embodiment of the present invention.

As shown in FIG. 16 and FIG. 17, when an electrical conductive object is inserted into one of the live wire receptacle 211 and the neutral wire receptacle 221, for example when a conductive object is inserted to the live wire receptacle 211, where the pushing force is not enough to push the first pushing element 2411 of the first locking control unit 241, the first staring element 2415 of the first actuating element 2412 switches on the first live wire connection switch 214 and the first neutral wire connection switch 224, and the first actuating body 2416 of the first actuating element 2412 applies a pushing force on the first effect surface 2435. However, since the pushing force of the first actuating body 2416 only applies to one side of the braking element 2431, the braking element 2431 rotates around the rotating shaft 2433, rendering the second effect surface 2436 moving away from its initial position and, finally, the braking element 2431 can be positioned in an inclined position. It is worth mentioning that when another conductive object is inserted into the neutral wire receptacle 221 of the socket body 200, the braking element 2431 under this state prevents the motion of the second actuating element 2422 and further prevents the motion of the second pushing element 2421 so as to prevent the starting of the second locking control unit 242. In other words, when an electrical conductive object is inserted into the neutral wire receptacle 221 once again, since the second actuating body 2426 and the second effect surface 2436 are in a dislocation state, the second actuating body 2426 cannot apply a pushing force on the second effect surface 2436 and cannot move under the restriction of the braking element 2431, and that the second locking control unit 242 cannot be activated so that the second live wire connection switch 215 and the second neutral wire connection switch 225 cannot be switched on, thereby the whole live wire connection circuit 212 and the neutral wire connection circuit 222 are electrically disconnected to prevent any conductive object from being inserted into the live wire receptacle 211 resulting in electric shock accident.

Accordingly, when an electrical conductive object is inserted into the neutral wire receptacle 221 and the pushing force is not enough to push the second pushing element 2421 of the second locking control unit 242, the second starting element 2425 of the second actuating element 2422 switches on the second live wire connection switch 215 and the second neutral wire connection switch 225, and the second actuating body 2426 of the second actuating element 2422 applies a pushing force on the second effect surface 2436. Since the pushing force of second actuating body 2426 only applies on one side of the braking element 2431, the braking element 2431 rotates around the rotating shaft 2433, such that the first effect surface 2435 moves away from its initial position and the braking element 2431 is in an another inclined position. It is worth mentioning that when another conductive object is inserted into the neutral wire receptacle 221 of the socket body 200, the braking element 2431 under this state prevents the motion of the first actuating element 2412 and further prevents the motion of the first pushing element 2411 so as to prevent the activating of the first locking control unit 241. In other words, when an conductive object is inserted into the live wire receptacle 211 once again, since the first actuating body 2416 and the first effect surface 2435 are in a dislocation state, the first actuating body 2416 cannot apply any pushing force on the first effect surface 2435 and cannot move under the restriction of the braking element 2431, and the first locking control unit 241 cannot be activated, such that the first live wire connection switch 214 and the second live wire connection switch 215 cannot be switched on, thereby the whole live wire connection circuit 212 and the neutral wire connection circuit 222 are electrically disconnected to prevent any conductive object from being inserted into the neutral wire receptacle 221 resulting in electric shock accident.

It is worth mentioning that the first effect surface 2435 and the second effect surface 2436 are located at two symmetrical ends of the braking element 2431 respectively and on the same side. When the first locking control unit 241 and the second locking control unit 242 are activated respectively, instead of being activated simultaneously, the braking element 2431 rotates in the opposite direction. For example, when the first locking control unit 241 activates separately, the braking element 2431 rotates around the rotating shaft 2433 in a clockwise direction, and when the second locking control unit 242 activates alone, the braking element 2431 rotates around the rotating shaft 2433 in a counterclockwise direction, vice versa.

In other words, when the first locking control unit 241 and the second locking control unit 242 are activated separately, the braking element 2431 performs a rotational movement, and that when the first locking control unit 241 and the second locking control unit 242 are activated simultaneously, the braking element 2431 performs a linear movement such as a vertical or horizontal motion. When the braking element 2431 performs the rotational movement, the rotating shaft 2433 is a rotation center of the braking element 2431 and the rotating shaft 2433 may not perform movement. However, when the braking element 2431 performs the linear movement in the retaining groove 24341 such as moving up and moving down in a vertical direction, the rotating shaft 2433 moves with the braking element 2431 in the 24344 and reaches a final working state.

According to the preferred embodiment of the present invention, the locking and controlling mechanism 240 has three states, including an idle state, a self-locking state and an operating state. Accordingly, an application method of the safety socket 10 of the preferred embodiment of the present invention is provided, wherein the safety socket 10 comprises at least one socket body 200. The socket body 200 has a live wire receptacle 211 and a neutral wire receptacle 221 and comprises a live wire connection circuit 212, a neutral wire connection circuit 222 and a locking and controlling mechanism 240. The method comprises the following steps:

(A) When the locking and controlling mechanism 240 is in an ideal state, the live wire connection circuit 212 and the neutral wire connection circuit 222 are electrically disconnected.

(B) When an electrical conductive object 40 is independently inserted into one receptacle of the live wire receptacle 211 and the neutral wire receptacle 221, and that the corresponding locking and controlling mechanism 240 is in a self-locking state, the locking and controlling mechanism 240 prevents the live wire connection circuit 212 and the neutral wire connection circuit 222 from electrically connecting and electric shock accident is prevented.

(C) When the live wire pin 201 and the neutral wire pin 202 of the electric appliance 20 are simultaneously inserted into the live wire receptacle 211 and the neutral wire receptacle 221, the corresponding locking and controlling mechanism 240 is activated by the live wire pin 201 and the neutral wire pin 202 and is in the operation state, wherein the locking and controlling mechanism 240 electrically connects the live wire connection circuit 212 and the neutral wire connection circuit 222 and the electric appliance 20 works normally under the electricity supply of the power supply 30 through the socket body 200 electrically connecting to the power supply 30.

In the above step (A), when no conductive objects or other objects is inserted into the live wire receptacle 211 and the neutral wire receptacle 221, the locking and controlling mechanism 240 is in the idle state, or that when a conductive object is inserted into one of the live wire receptacle 211 and the neutral wire receptacle 221 while the shape, the size and the magnitude of the pushing force of the conductive object is not enough to activate the locking and controlling mechanism 240, the locking and controlling mechanism 240 still remains in the idle state.

The socket body 200 further comprises two sets of the live wire connection switches and the neutral wire connection switches, wherein one set is the first live wire connection switch 214 and the first neutral wire connection switch 224 while the other set is the second live wire connection switch 215 and the second neutral wire connection switch 225. In the above step (B), when an electrical conductive object is separately inserted into the live wire receptacle 211 and the corresponding locking and controlling mechanism 240 is activated to the self-locking state, the first live wire connection switch 214 and the first neutral wire connection switch 224 are able to be switched on. Certainly, if the displacement of the first actuating element 2412 is not enough, the first live wire connection switch 214 and the first neutral wire connection switch 224 are still electrically disconnected. However, since the locking and controlling mechanism 240 prevents the second live wire connection switch 215 and the second neutral wire connection switch 225 from being switched on, the live wire connection circuit 212 and the neutral wire connection circuit 222 are electrically disconnected to prevent any electric shock accident. Similarly, when a conductive object is separately inserted into one of the neutral wire receptacle 221 and the locking and the locking and controlling mechanism 240 is activated to the self-locking state, the second live wire connection switch 215 and the second neutral wire connection switch 225 are able to be switched on or still remains being switched off. However, since the locking and controlling mechanism 240 prevents the first live wire connection switch 214 and the first neutral wire connection switch 224 from switching on, the live wire connection circuit 212 and the neutral wire connection circuit 222 are electrically disconnected to prevent any electric shock accident.

Accordingly, according to the preferred embodiment of the present invention, the self-locking state is performed by the braking unit 243 of the locking and controlling mechanism 240. The locking and controlling mechanism 240 comprises the first locking control unit 241 and the second locking control unit 242. In the self-locking state, only one locking control unit of the first locking control unit 241 and the second locking control unit 242 is in that activating state, the braking unit 243 prevents the activating of the other locking control unit so as to achieve the object of preventing the electric shock accident.

In the step (C), the first locking control unit 241 and the second locking control unit 242 are under the simultaneously actions of the live wire pin 201 and the neutral wire pin 202 of the appliance plug 21, the first locking control unit 241 and the second locking control unit 242 are simultaneously activated. Two ends of the braking element 2431 of the braking unit 243 bear force together and the braking element 2431 will bear averaged force such that the two sets of the live wire connection switches and the neutral wire connection switches are switched on and the live wire connection circuit 212 and the neutral wire connection circuit 222 are in a connection state, thereby the socket body 200 works normally.

More specifically, according to the preferred embodiment of the present invention, in the step (B) and the step (C), the braking element 2431 of braking unit 243 will complete the different motions. In the step (B), the braking element 2431 produces a rotary motion under the action of one locking control unit, while in the step (C), the braking element 2431 will produce a linear motion under the simultaneously actions of two locking control units, such as a upward or downward vertical motion, in the next two lock control units, so as to achieve the self-locking state and the operation state respectively.

The waterproof structure according to the preferred embodiment of the present invention is illustrated as follows. When water or other conductive liquid enters the receptacle of the socket body 200, short circuit will not occur that further ensures the safety use of the safety socket 10 of the preferred embodiment of the present invention.

The live wire receptacle live wire receptacle 211, the neutral wire receptacle neutral wire receptacle 221 and the earth wire receptacle 231 of the socket body 200 are independent and do not communicate with each other. According to the preferred embodiment of the present invention, the locking and controlling mechanism 240, the live wire connection switch 214, the second live wire connection switch 215, and the first neutral wire connection switch 224, the second neutral wire connection switch 225 are introduced. The socket body socket body 200 further provides an isolation cavity 12. The actuating element and the reset element of the locking and controlling mechanism 240, the first live wire connection switch 214, the second live wire connection switch 215, the first neutral wire connection switch 224, and the second neutral wire connection switch 225 are disposed in the isolation cavity 12. The isolation cavity 12 does not communicate with the live wire receptacle 211, the neutral wire receptacle 221 and the earth wire receptacle 231, such that water or other conductive liquid cannot enter the live wire receptacle 211, the neutral wire receptacle 221 and the earth wire receptacle 231 through the isolation cavity 12, thereby a short circuit will not occur in the socket body 200.

According to the preferred embodiment of the present invention, the isolation cavity 12 is formed outside of the live wire receptacle 211, the neutral wire receptacle 221 and the earth wire receptacle 231 of the socket body 200. One skilled in the art should understand that independent isolation chambers could be provided in various portions of the isolation cavity 12, such as for receiving the live wire connection switch, the neutral wire connection switch and etc.

It is worth mentioning that the isolation cavity 12 can be formed by the shells, the separating walls or other parts of the socket body 200, as well as integrally formed from the socket body 200 and the socket shell 11 of the safety socket 10. The present invention is not intended to be limiting in this aspect, as long as the isolation cavity isolation cavity 12 is isolated with the live wire receptacle 211, the neutral wire receptacle 221 and the earth wire receptacle 231, and that the locking and controlling mechanism 240 in the isolation cavity 12 selectively and electrically connects or disconnects the live wire connection circuit 112 and the neutral wire connection circuit 122.

Furthermore, the socket body 200 further comprises a sealing member 250 to isolate the isolation cavity 12 with the receptacles of the socket body 200 so as to prevent water or other conductive liquid in the receptacles of the socket body 200 entering into the isolation cavity 12, thereby the socket body 200 has a water-proof feature because of the sealing member 250 while the sealing member 250 prevents the socket body 200 from occurring a short circuit which may result in an electric shock accident.

According to the preferred embodiment of the present invention, since the live wire action hole 216 is provided in the side wall of the live wire receptacle 211 and the neutral wire action hole 226 is provided in the side wall of the neutral wire receptacle 221, waterproof configuration is required to be provided in the live wire action hole 216 and the neutral wire action hole 226 so as to prevent water or other conductive liquid entering the isolation cavity 12.

As shown in FIG. 7, FIG. 8, FIG. 18, and FIG. 19, each of the the first pushing element 2411 and second pushing element 2421 provide a groove 2418, 2428. The sealing member 250 comprises sealing rings 253, 254. The sealing rings 253, 254 are respectively provided in the grooves 2418, 2428 and are located within the corresponding live wire action hole 216 and the neutral wire action hole 226 respectively so as to frictional contact to the inner surface of the live wire action hole 216 and the neutral wire action hole 226, such that the sealing ring 253 and the sealing ring 254 respectively prevent seams between the first pushing element 2411, the second pushing element 2421, the live wire action hole 216, and the neutral wire action hole 226, thereby preventing water or other conductive liquid in the live wire receptacle 211 and the neutral wire receptacle 221 from entering into the isolation cavity 12.

Figure 19:
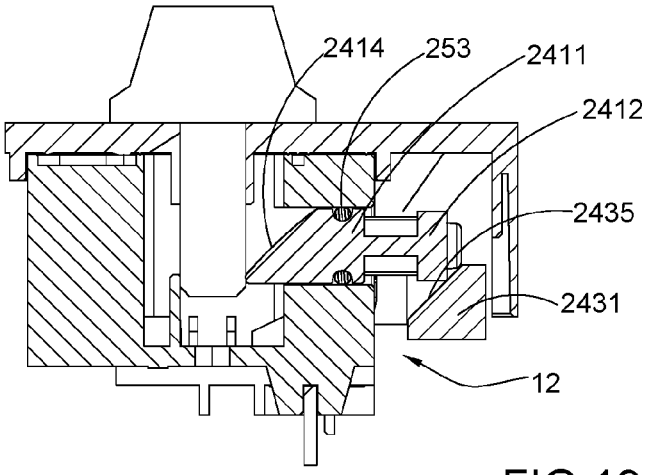
FIG. 19 is a sectional view of the safety socket according to the above preferred embodiment of the present invention, illustrating a waterproof structure.

According to the preferred embodiment of the present invention, the sealing ring 253 and the sealing ring 254 can be embodied as waterproof silicone rings which contact intimately and seamlessly with the inner surfaces of the grooves 2418, 2428 respectively for waterproof. Moreover, as shown in FIG. 19, when power plug pins are inserted into the live wire receptacle 211 or the neutral wire receptacle 221, the sealing ring 253 and the sealing ring 254 can move with the first pushing element 2411 and the second pushing element 2421 in a horizontal direction and will not depart from the corresponding live wire action hole 216 and the neutral wire action hole 226, such that when the locking and controlling mechanism 240 is activated, the sealing ring 253 and the sealing ring 254 still perform the waterproof feature.

Figure 20:
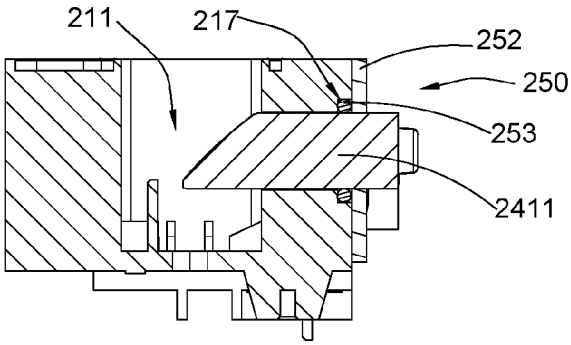
FIG. 20 is a cross-sectional view of the safety socket according to the above preferred embodiment of the present invention, illustrating another waterproof structure.
Figure 21:
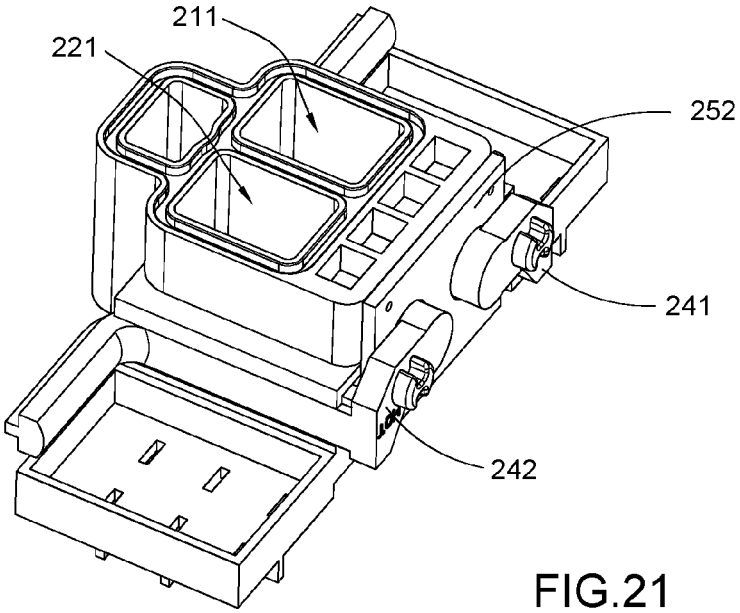
FIG. 21 is a perspective view of an action hole of the safety socket according to the above preferred embodiment of the present invention.
Figure 22:
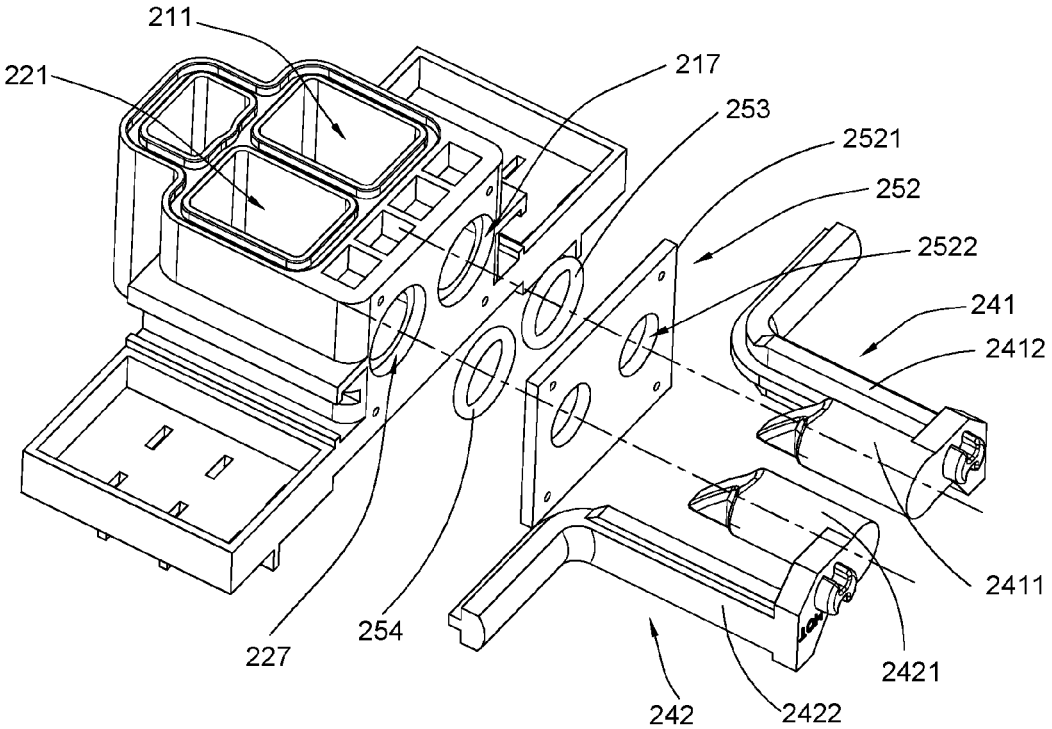
FIG. 22 is an exploded schematic view of the safety socket according to the above preferred embodiment of the present invention, illustrating a waterproof structure.
Figure 23:
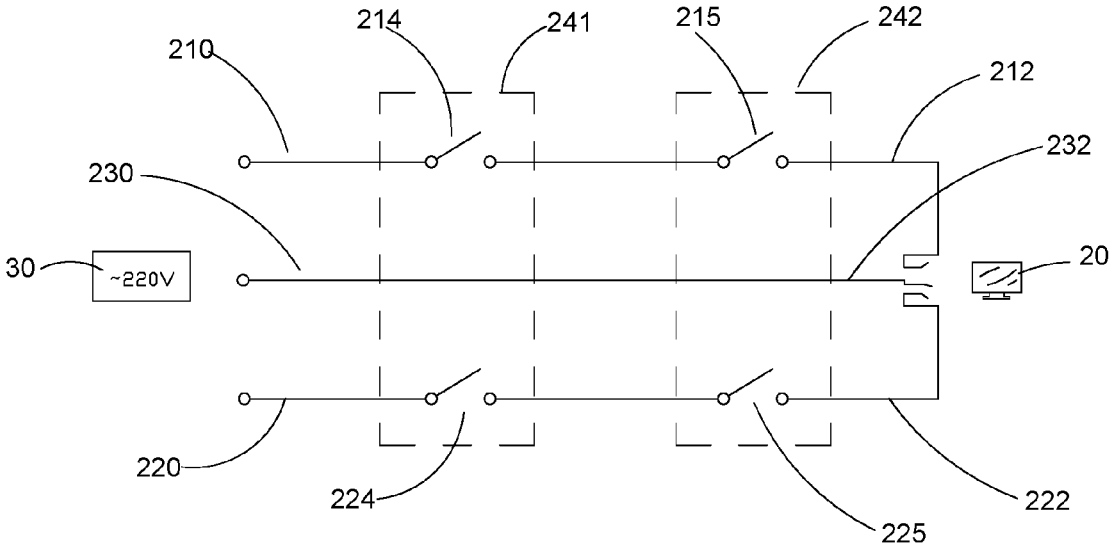
FIG. 23 is a view showing a circuit configuration of the safety socket according to the above preferred embodiment of the present invention.

Referring to FIG. 20 to FIG. 22, an alternative mode of the sealing member 250 according to the preferred embodiment of the present invention is illustrated. Ring-shaped fixation grooves 217, 227 are respectively formed in the outer side walls of the live wire receptacle 211 and the neutral wire receptacle 221, adjacent to the side of the isolation cavity 12. The sealing ring 253 and the sealing ring 254 are respectively mounted on the ring-shaped fixation grooves 217, 227. In other words, in this alternative mode, the sealing ring 253 and the sealing ring 254 are not mounted on the corresponding first pushing element 2411 and the second pushing element 2421 as in the above embodiments, wherein the sealing ring 253 and the sealing ring 254 are mounted on the side walls of the live wire receptacle 211 and the neutral wire receptacle 221. The sealing ring 253 and the sealing ring 254 are tightly and fittingly attached to the corresponding first pushing element 2411 and the second pushing element 2421, and allow motions of the first pushing element 2411 and the second pushing element 2421. But the sealing ring 253 and the sealing ring 254 do not move with the corresponding first pushing element 2411 and the second pushing element 2421 so as to ensure the waterproof effect.

In other words, each of the sealing ring 253 and the sealing ring 254 has a through hole, wherein the sizes of the through holes are made corresponding to the sizes and shapes of the first pushing element 2411 and the second pushing element 2421 such that the first pushing element 2411 and the second pushing element 2421 are able to penetrate through the through holes tightly and fittingly. The sealing ring 253 and the sealing ring 254 which are made of waterproof silicone materials are frictional attached to the first pushing element 2411 and the second pushing element 2421 and are not easily damaged, so as to prevent water or other conductive liquid in the live wire receptacle 211 and the neutral wire receptacle 221 from entering into the isolation cavity 12 and not interfere with the normal working of the first pushing element 2411 and the second pushing element 2421.

The sealing member 250 further comprises a fixing member 252 comprising a fixing member body 2521 and two openings 2522 are formed in the middle of the fixing member body 2521. The two openings 2522 respectively allow the first pushing element 2411 and the second pushing element 2421 to penetrate therethrough. The fixing member 252 is fixed to the outer side walls of the live wire receptacle 211 and the neutral wire receptacle 221 such that the sealing rings 253, 254 are tightly are firmly mounted between the fixing member 252 and the outer side walls of the live wire receptacle 211 and the neutral wire receptacle 221. The way of fixation can be various structures. For example, four screws penetrating through fixation holes on the four corners of the fixing member 252 and corresponding to fixation holes in the outer side walls of the live wire receptacle 211 and the neutral wire receptacle 221.

It is worth mentioning that the specific configuration of the sealing member 250 is exemplary only and not intended to be limiting in this aspect. Person skilled in the art could think of other waterproof structures. According to the present invention, the sealing member 250 is mainly used to prevent water or other conductive liquid in the socket body 200 from influencing the operations of electrically connecting or disconnecting the live wire connection circuit 212 and the neutral wire connection circuit 222 of the locking and controlling mechanism 240.

As shown in FIG. 24 to FIG. 34, an alternative mode of the safety socket 10 according to the second preferred embodiment of the present invention is illustrated. The safety socket 10 comprises at least one socket body 300. It is understandable that certainly in practical applications, the safety socket may comprise one, two, three or multiple socket bodies 300 assembled in a socket shell 11, and the socket body 300 can be, for example, a two-hole jacks socket or three-hole jacks socket, and so on.

According to the preferred embodiment of the present invention, the socket body 300 is embodied as a two-hole jacks socket comprising two circuit connecting units for electrically connecting a live circuit and a neutral circuit correspondingly. More specifically, as shown in FIG. 24 to FIG. 34, the socket body 300 has a live connecting unit 310 and a neutral connecting unit 320. The live connecting unit 310 comprises a live wire receptacle 311 and a live wire connection circuit 312. The neutral connecting unit 320 comprises a neutral wire receptacle 321 and a neutral wire connection circuit 322.

Similarly, the socket body 300 connects an appliance plug 21 of an electric appliance 20 to a power supply 30. The power supply 30 can be a direct-current power supply or a 110V or 220V alternating-current power supply so as to enable the electric appliance 20 working normally or to be charged by the power supply 30.

According to the preferred embodiment of the present invention, the live wire pin 201 is received in the live wire receptacle 311 of the socket body 300 and the neutral wire pin 202 is received in the neutral wire receptacle 321 of the socket body 300. Then, the live wire pin 201 electrically connects to the live wire connection circuit 212, and the neutral wire pin 202 electrically connects to the neutral wire connection circuit 322, such that the circuit between the electric appliance 20 and the power supply 30 is electrically connected.

Each of the live wire receptacle 311 and the neutral wire receptacle 321 of the socket body 300 comprises an independent chamber. The two chambers are not communicate with each other and can be indentedly formed in the same insulating shell. The live wire receptacle 311 and the neutral wire receptacle 321 can also be formed independently using different insulating materials and then assembled with each other.

According to the present invention, the socket body 300 further comprises a locking and controlling mechanism 340. Only when the locking and controlling mechanism 340 is activated and is switched to an operating state, the electric circuit between the appliance plug 21 of the electric appliance 20, the socket body 300, and the power supply 30 can be electrically connected and the electric appliance 20 can work normally.

More specifically, only when the live wire pin 201 and the neutral wire pin 202 of the standard appliance plug 21 of the electric appliance 20 are inserted into the live wire receptacle 311 and the neutral wire receptacle 321 of the socket body 300 independently and simultaneously, the electric circuit between the appliance plug 21 of the electric appliance 20, the socket body 300 and the power supply power supply 30 ca be electrically connected.

According to the preferred embodiment of the present invention, the locking and controlling mechanism 340 is activated by the simultaneously inserting action of the live wire pin 201 and the neutral wire pin 202 of the appliance plug 21 so as to respectively connect the circuit of the live connecting unit 310 and the circuit of the neutral connecting unit 320. In other words, when the live wire pin 201 and the neutral wire pin 202 of the appliance plug 21 are respectively and simultaneously inserted into the corresponding live wire receptacle 311 and the corresponding neutral wire receptacle 321 of the socket body 300, the locking and controlling mechanism 340 is activated so as to connect the circuit between the appliance plug 21 of the electric appliance 20, the socket body 300 and the power supply 30. The structure of the preferred embodiment of the present invention is different from the structure of the above second preferred embodiment and details will be described in the following descriptions.

Furthermore, the locking and controlling mechanism 340 comprises a first locking control unit 341, a second locking control unit 242 and a braking unit 343. A live wire action hole 316 is provided in the sidewall of the live wire receptacle 311, and a neutral wire action hole 326 is provided in the sidewall of the neutral wire receptacle 321. The first locking control unit 341 is positioned and mounted through the live wire action hole 316 and the second locking control unit 342 is positioned and mounted through the neutral wire action hole 326.

The first locking control unit 341 comprises a first pushing element 3411, a first actuating element 3412 and a first reset element 3413. The first pushing element 3411 penetrates through the live wire action hole 316. The first actuating element 3412 is mounted on the first pushing element 3411 or is integrally formed with the first pushing element 3411. The first reset element 3413 is mounted on the first pushing element 3411 or the first actuating element 3412. According to the preferred embodiment of the present invention, the first reset element 3413 is mounted on the first actuating element 3412. When the live wire pin 201 of the appliance plug 21 is inserted into the live wire receptacle 311 of the socket body 300, the live wire pin 201 drives the first pushing element 3411 to move and the first pushing element 3411 further drives the first actuating element 3412 to move, thereby the first locking control unit 341 is in a working state and, further, the first reset element 3413 is deformed. The first reset element 3413 can be embodied as a reset spring such that the first reset element 3413 is a spring being compressed or being stretched. According to the preferred embodiment, the first reset element 3413 embodied as the reset spring is compressed. When the live wire pin 201 of the appliance plug 21 is removed away from the live wire receptacle 311 of the socket body 300, the first actuating element 3412 and the first pushing element 3411 return to their initial positions under the effect of the first reset element 3413.

The second locking control unit 342 comprises a second pushing element 3421, a second actuating element 3422 and a second reset element 3423. The second pushing element 3421 penetrates through the neutral wire action hole 326. The second actuating element 3422 is mounted on the second pushing element 3421 or is integrally formed with second pushing element 3421. The second reset element 3423 is mounted on the second pushing element 3421 or the second actuating element 3422. According to the preferred embodiment of the present invention, the second reset element 3423 is mounted on the second actuating element 3422. When the neutral wire pin 202 of the appliance plug 21 is inserted into the neutral wire receptacle 321 of the socket body 300, the neutral wire pin 202 drives the second pushing element 3421 to move and the second pushing element 3421 further drives the second actuating element 3422 to move, thereby the second locking control unit 342 is in a working state and, further, the second reset element 3423 is deformed. The second reset element 3423 can be embodied as a reset spring that the second reset element 3423 is a spring being compressed or being stretched. According to the preferred embodiment, the second reset element 3423 embodied as the reset spring is compressed. When the neutral wire pin 202 of the appliance plug 21 is removed away from the neutral wire receptacle 321 of the socket body 300, the second actuating element 3422 and the second pushing element 3421 return to their initial positions under the effect of the second reset element 3423.

According to the preferred embodiment of the present invention, only when the live wire pin 201 and the neutral wire pin 202 of the appliance plug 21 are respectively and simultaneously inserted into the live wire receptacle 311 and the neutral wire receptacle 321 of the socket body 300, the live wire connection circuit 312 and the neutral wire connection circuit 322 can be electrically connected.

More specifically, the live connecting unit 310 further comprises a first live wire connection switch 314 and a second live wire connection switch 315 so as to control the electrical connection and disconnection of the live wire connection circuit 312. Only when the first live wire connection switch 314 and the second live wire connection switch 315 are all in an electrically connected state, the live wire connection circuit 312 can be in an electrically connected state. While at least one of the first live wire connection switch 314 and the second live wire connection switch 315 is in an electrically disconnected state, the live wire connection circuit 312 is in an electrically disconnected state.

Accordingly, the neutral connecting unit 320 further comprises a first neutral wire connection switch 324 and a second neutral wire connection switch 325 so as to control the electrical connection and disconnection of the neutral wire connection circuit 322. Only when the first neutral wire connection switch 324 and the second neutral wire connection switch 325 are all in an electrically connected state, the neutral wire connection circuit 322 can be in an electrically connected state. While at least one of the first neutral wire connection switch 324 and the second neutral wire connection switch 325 is in an electrically disconnected state, the neutral wire connection circuit 322 is in an electrically disconnected state.

The first locking control unit 341 is used to control the switch on and the switch off of the first live wire connection switch 314 and the first neutral wire connection switch 324, and the second locking control unit 342 is used to control the switch on and the switch off of the second live wire connection switch 315 and the second neutral wire connection switch 325. Thus, when the live wire pin 201 and the neutral wire pin 202 of the appliance plug 21 are respectively and simultaneously inserted into the live wire receptacle 311 and the neutral wire receptacle 321 of the socket body 300, the live wire pin 201 activates the first locking control unit 341 such that the first live wire connection switch 314 and the first neutral wire connection switch 324 are switched on, and the neutral wire pin 202 activates the second locking control unit 342 such that the second live wire connection switch 315 and the second neutral wire connection switch 325 are switched on, wherein the live wire connection circuit 312 and the neutral wire connection circuit 322 are in the electrically connected state and the circuit between the appliance plug 21 of the electric appliance 20, the socket body 300 and the power supply 30 is electrically connected to ensure the normal working state of the electric appliance 20.

The first actuating element 3412 of the first locking control unit 341 further comprises a staring element 3415. The staring element 3415 is used to simultaneously switch on and switch off the first live wire connection switch 314 and the first neutral wire connection switch 324. Accordingly, the second actuating element 3422 of the second locking control unit 342 further comprises a staring element 3425. The staring element 3425 is used to simultaneously switch on and switch off the second live wire connection switch 315 and the second neutral wire connection switch 325.

According to the preferred embodiment of the present invention, the connection switches are different from micromove switches of the second embodiment. For the first live wire connection switch 314 as an example, the first live wire connection switch 314 is directly mounted on the staring element 3415 and driven by the staring element 3415 to move and to connect to the live wire connection circuit 312. In other words, unlike the actuating element which needs to apply a pushing force to the corresponding connection switch in above embodiment, the first actuating element 3412 and the second actuating element 3422 merely need to drive the corresponding connection switches to move in this preferred embodiment.

More specifically, the first live wire connection switch 314 can be embodied as a conductive member such as a conductive plate, a conductive column and so on. The first live wire connection switch 314 has two connection ends 3141. Two first live wire access terminals 3121 are provided in the live wire connection circuit 312. When the live wire pin 201 of the appliance plug 21 is inserted into the live wire receptacle 311, the first pushing element 3411 drives the first actuating element 3412 to move and the staring element 3415 of the first actuating element 3412 drives the first live wire connection switch 314 to move, such that the two connection ends 3141 of the first live wire connection switch 314 are respectively in contact with the two first live wire access terminals 3121 of the live wire connection circuit 312 and the first live wire connection switch 314 is switched on. Furthermore, the two connection ends 3141 can have conductive bumps and, correspondingly, the two first live wire access terminals 3121 of the live wire connection circuit 312 also have conductive bumps, such that the first live wire connection switch 314 and the two first live wire access terminals 3121 of the live wire connection circuit 312 form a point-to-point contacting conductive structure.

Figure 24:
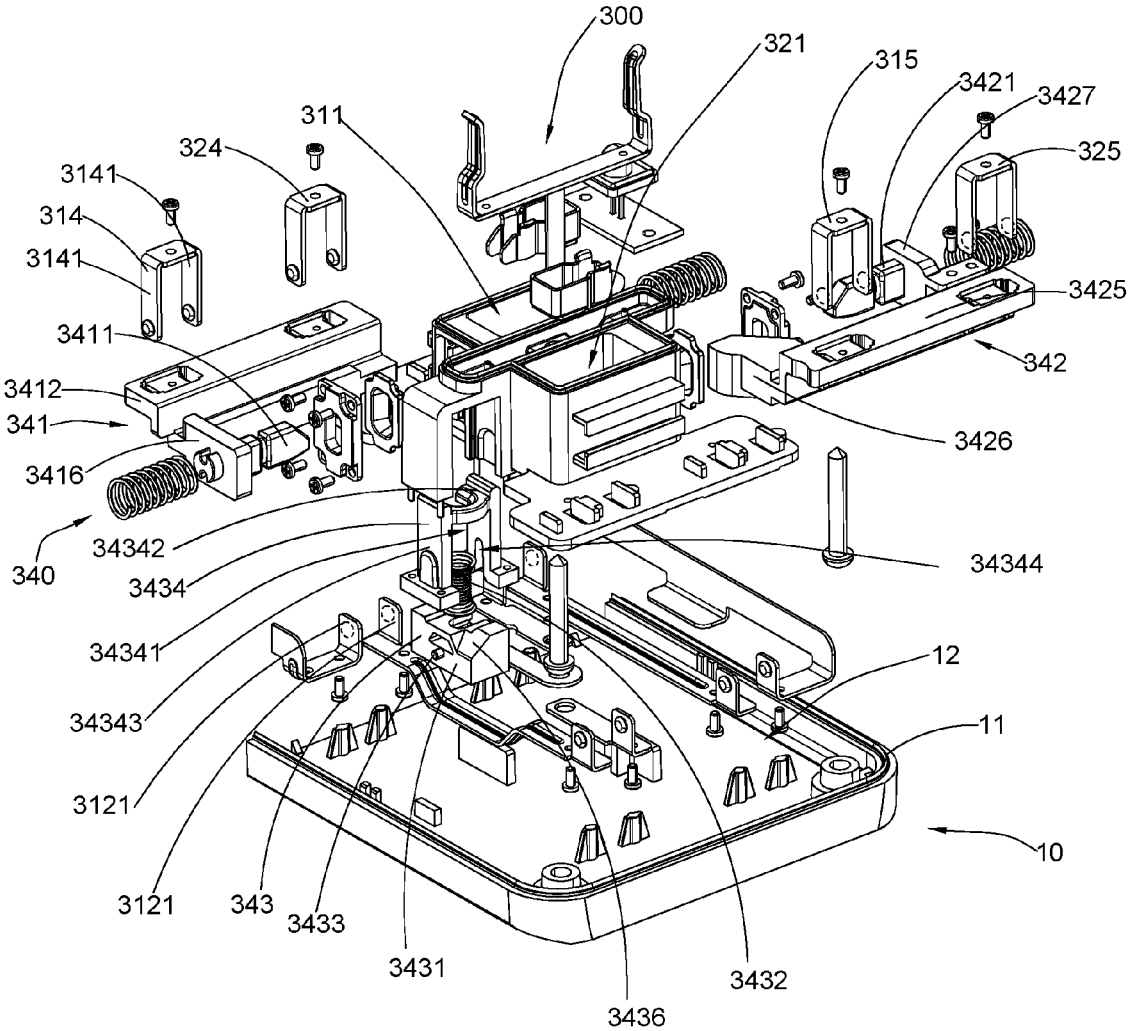
FIG. 24 is an exploded schematic view of the safety socket, illustrating an alternative mode according to the above preferred embodiment of the present invention.
Figure 25:
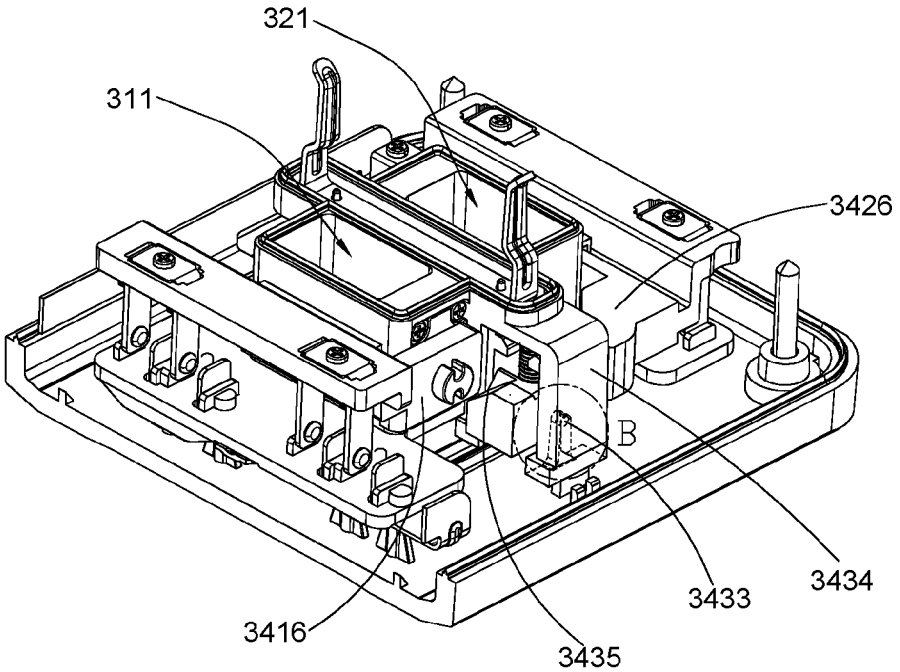
FIG. 25 is a perspective view of the safety socket according to an alternative mode of the above preferred embodiment of the present invention.
Figure 26:
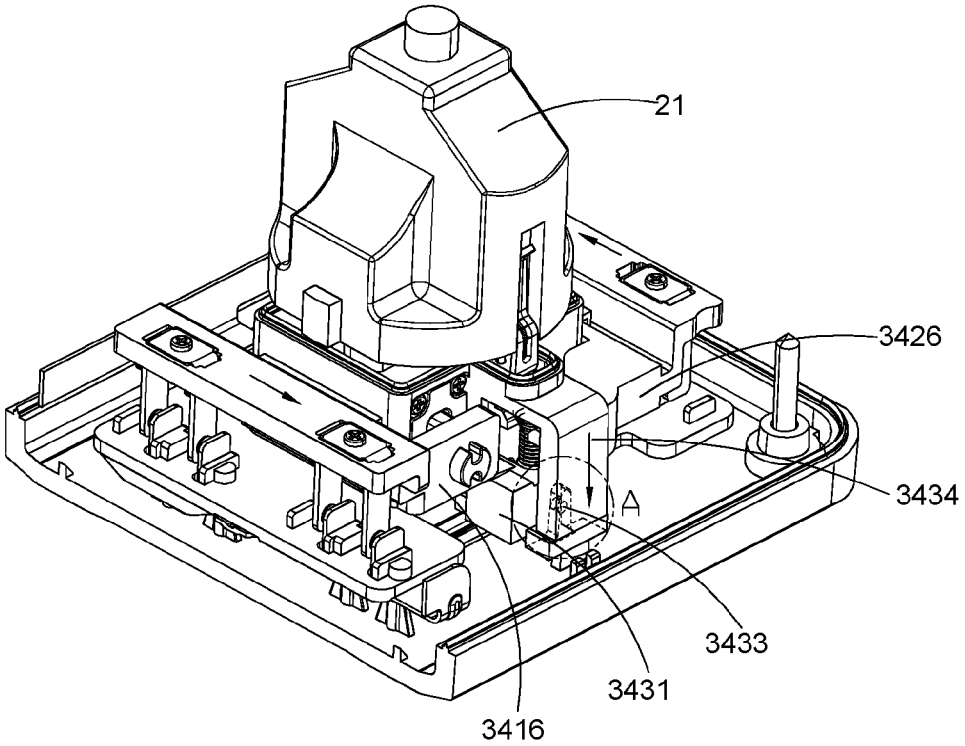
FIG. 26 is a perspective view of a safety socket with an appliance plug inserted into a safe body thereof according to an alternative mode of the above preferred embodiment of the present invention.
Figure 27:
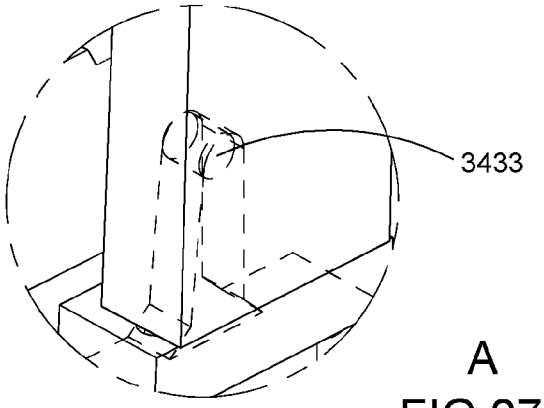
FIGS. 27 and 28 are perspective views of a safety socket according to an alternative mode of the above preferred embodiment of the present invention.
Figure 28:
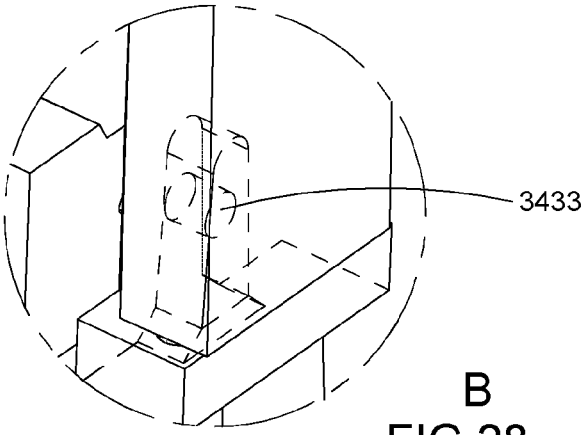

The first neutral wire connection switch 324, the second live wire connection switch 315 and the second neutral wire connection switch 325 can have a similar structure with the first live wire connection switch 314 as shown in FIG. 24. Therefore, the detail structure will not repeat here again.

It is worth mentioning that according to the preferred embodiment of the present invention, the first locking control unit 341 and the second locking control unit 342 of the locking and controlling mechanism 340 are arranged in the opposite directions, wherein the locking and controlling mechanism 340 comprises the braking unit 343 such that the first locking control unit 341 and the second locking control unit 342 have a controlling effect on the braking unit 343 in the opposite directions.

More specifically, similar to the above second preferred embodiment, the braking unit 343 comprises the braking element 3431, the restraining element 3432, the rotating shaft 3433 and the installing element 3434. The braking element 3431 has a first effect surface 3435 and a second effect surface 3436. The first effect surface 3435 and the second effect surface 3436 are symmetrically provided on two sides of the braking element 3431. The restraining element 3432 is mounted on the braking element 3431 such that the braking element 3431 resets to an initial state after the working state. For example, the restraining element 3432 is a restricting spring. When the braking element 3431 is in the working state, the restricting spring is elastically deformed which is compressed or stretched. When the braking element 3431 is in the idle state, the restricting spring returns to its initial equilibrium position. Furthermore, one end of the restraining element 3432 is fixed to the braking element 3431 and the other end is fixed to the installing element 3434.

The rotating shaft 3433 is mounted on the braking element 3431 such that the braking element 3431 is adapted for rotating around the rotating shaft 3433, and the braking element 3431 can move along a direction where the restraining element 3432 extends to and, consequently, the braking element 3431 is also adapted for completing two different motions, including the rotational motion and linear motion according to the preferred embodiment of the present invention.

The installing element 3434 provides a retaining groove 34341 for receiving the braking element 3431 and restricting the position of the braking element 3431. In other words, the braking element 3431 is merely adapted for moving in the retaining groove 34341. More specifically, the installing element 3434 comprises a base portion 34342 and two flanks 34343 extending from the base portion 34342. The retaining groove 34341 is formed between the base portion 34342 and the two flanks 34343, and a guiding groove 34344 is formed in each flanks 34343. Two ends of the rotating shaft 3433 respectively extend to the guiding groove 34344 so as to be moved in the guiding groove 34344, and the guiding groove 34344 has a position restricting effect on the rotating shaft 3433. Furthermore, the restraining element 3432 is adapted for mounting on the base portion 34342 of the installing element 3434.

What is distinguished with the above second preferred embodiment is that, in this preferred embodiment of the present invention, the first effect surface 3435 and the second effect surface 3436 of the braking element 3431 are respectively provided on opposite sides of the braking element 3431, such that the first locking control unit 341 and the second locking control unit 342 respectively apply pushing force on the first effect surface 3435 and the second effect surface 3436 in opposite directions.

Accordingly, the first actuating element 3412 further comprises a first actuating body 3416. The first actuating body 3416 applies a first pushing force on the first effect surface 3435 by the driven action of the first pushing element 3411 so as to drive the braking unit 343 to produce corresponding motions. The second actuating element 3422 further comprises a second actuating body 3426. The second actuating body 3426 applies a second force on the second effect surface 3436 by the driven action of the second pushing element 3421 so as to drive the braking unit 343 to produce corresponding motions. According to the preferred embodiment of the present invention, the directions of the first pushing force and the second pushing force are opposite. In other words, the first actuating body 3416 of the first actuating element 3412 is adapted for applying an acting force on the first effect surface 3435 to push the braking element 3431, and the second actuating body 3426 of the second actuating element 3422 is adapted for applying an acting force on the second effect surface 3436 to pull the braking element 3431.

Figure 29:
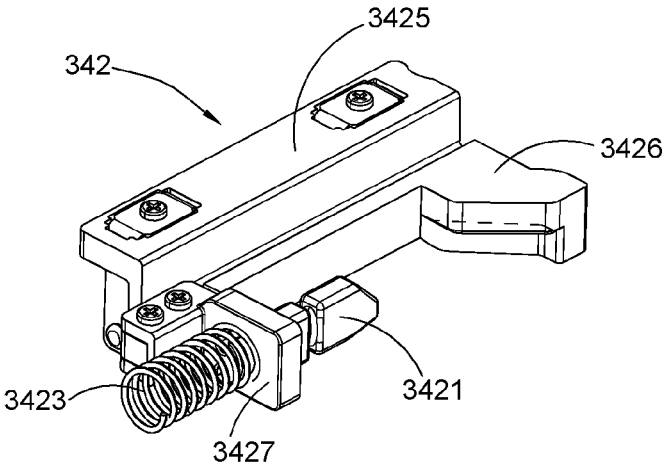
FIG. 29 is a perspective view of a locking control unit for pulling a braking unit of a safety socket according to an alternative mode of the above preferred embodiment of the present invention.

As shown in the drawings, the first actuating body 3416 and the second actuating body 3426 are also located on two opposite sides of the braking element so as to apply acting forces on the first effect surface 3435 and the second effect surface 3436 in opposite directions. According to the preferred embodiment, the first locking control unit 341 comprises the first pushing element 3411, the first actuating element 3412 and first reset element 3413. The first actuating element 3412 further comprises the staring element 3415 and the first actuating body 3416 connected with the staring element 3415. The second locking control unit 342 comprises the second pushing element 3421, the second actuating element 3422 and the second reset element 3423. The second actuating element 3422 further comprises the staring element 3425, the second actuating body 3426 connected with the staring element 3425, and a second connection element 3427. As shown in FIG. 29, the second reset element 3423 is mounted on the second connection element 3427. The second actuating body 3426 is fixed on or integrally extends from the staring element 3425 to form a hook-shaped structure, such that when the first pushing element 3411 is pushed, the pushing force is transmitted to the second actuating body 3426 by the second connection element 3427 and the staring element 3425, and the similar hook-shaped second actuating body 3426 applies a pulling force to pull the braking element 3431.

One skilled in the art should understand that the structure of the second locking control unit 342 of the embodiment of the present invention can also be applied in the above second preferred embodiment. In other words, according to the second preferred embodiment of the present invention, the first locking control unit 241 and the second locking control unit 242 all applies pushing forces to the braking element 2431, while in this preferred embodiment, the second locking control unit 342 can apply pulling forces to the braking element 2431.

As shown in FIG. 25 to FIG. 28, when the live wire receptacle 311 and the neutral wire receptacle 321 of the socket body 300 are simultaneously inserted into the live wire pin 201 and the neutral wire pin 202 of the socket body 200, the live wire pin 201 and the neutral wire pin 202 respectively activate the first locking control unit 341 and the second locking control unit 342. More specifically, the live wire pin 201 and the neutral wire pin 202 respectively push the first pushing element 3411 and the first actuating element 3412, such that the corresponding first actuating body 3416 of the first actuating element 3412 and the corresponding second actuating body 3426 of the second actuating element 3422 are respectively act on the first effect surface 3435 and the second effect surface 3436 of the braking element 3431.

According to the preferred embodiment of the present invention, when the braking element 3431 is driven by the first locking control unit 341 and the second locking control unit 342 to move in the vertical direction to achieve the working state, the corresponding staring element 3415 of the first actuating element 3412 of the first locking control unit 341 switches on the first live wire connection switch 314 and the first neutral wire connection switch 324, and that the staring element 3425 of the second actuating element 3422 of the second locking control unit 342 switches on the second live wire connection switch 315 and the second neutral wire connection switch 325 at the same time, such that the live wire connection circuit 312 and the neutral wire connection circuit 322 are switched on.

When the live wire pin 201 and the neutral wire pin 202 of the appliance plug 21 are removed away from the live wire receptacle 211 and the neutral wire receptacle 321 of the socket body 300, under the actions of an elastic restoring force of the restraining element 3432, the first effect surface 3435 and the second effect surface 3436 of the braking element 3431 conversely apply pushing forces on the first actuating element 3412 and the second actuating element 3422, such that the staring element 3415 and the staring element 3425 return to their initial positions to switch off the corresponding first live wire connection switch 314, the first neutral wire connection switch 324, the second live wire connection switch 315, and the second neutral wire connection switch 325, thereby the live wire connection circuit 312 and the neutral wire connection circuit 322 are electrically disconnected.

Figure 30:
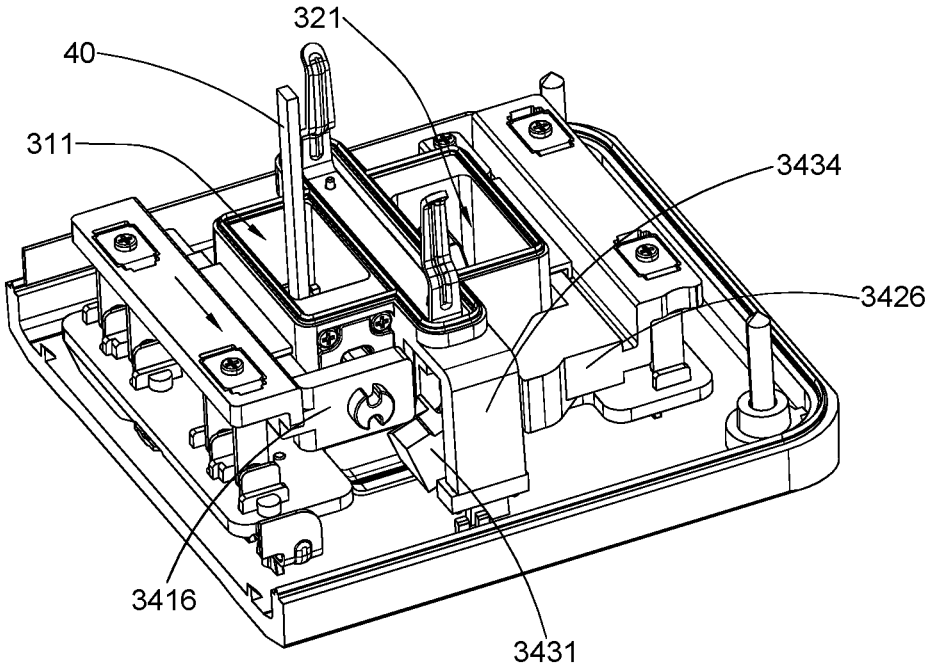
FIGS. 30 and 31 are exploded views of a safety socket according to an alternative mode of the above preferred embodiment of the present invention when a conductive object is inserted into a receptacle of a socket body thereof.
Figure 31:
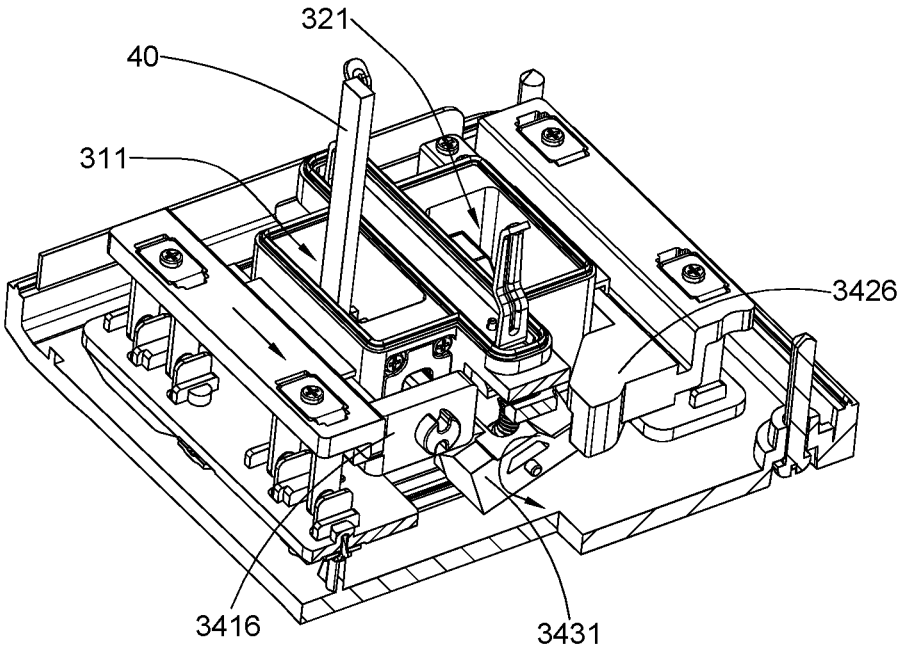

As shown in FIG. 30 and FIG. 31, when an electrical conductive object is inserted into the live wire receptacle 311 of the socket body 300 and the pushing force is not enough to push the first pushing element 3411 of the first locking control unit 341, the staring element 3415 of the first actuating element 3412 switches on the first live wire connection switch 314 and the first neutral wire connection switch 324, and the first actuating body 3416 of the first actuating element 3412 applies a pushing force on the first effect surface 3435. Since the pushing force of the first actuating body 3416 applies only on the inner side of the braking element 3431, the braking element 3431 rotates around the rotating shaft 3433 such that the second effect surface 3436 moves away from the initial position and the braking element 3431 is in an inclined position eventually. It is worth mentioning that when another conductive object is inserted into the neutral wire receptacle 321 of the socket body 300, the braking element 3431 under this state prevents the motion of the second actuating element 2422 and further prevents the motion of the second pushing element 3421 by preventing the motions of the second actuating element 3422 so as to prevent the activating of the second locking control unit 342. In other words, when an conductive object is inserted into the neutral wire receptacle 321 once again, since the second actuating body 3426 and the second effect surface 3436 are in a dislocation state, the second actuating body 3426 cannot apply a pushing force on the second effect surface 3436 and cannot move under the restriction of the braking element 3431, and the second locking control unit 342 cannot be activated such that the second live wire connection switch 315 and the second neutral wire connection switch 325 cannot be switched on, thereby the whole live wire connection circuit 312 and the neutral wire connection circuit 322 are electrically disconnected to prevent any conductive object from being inserted into the live wire receptacle 311 resulting in electric shock accident.

Figure 32:
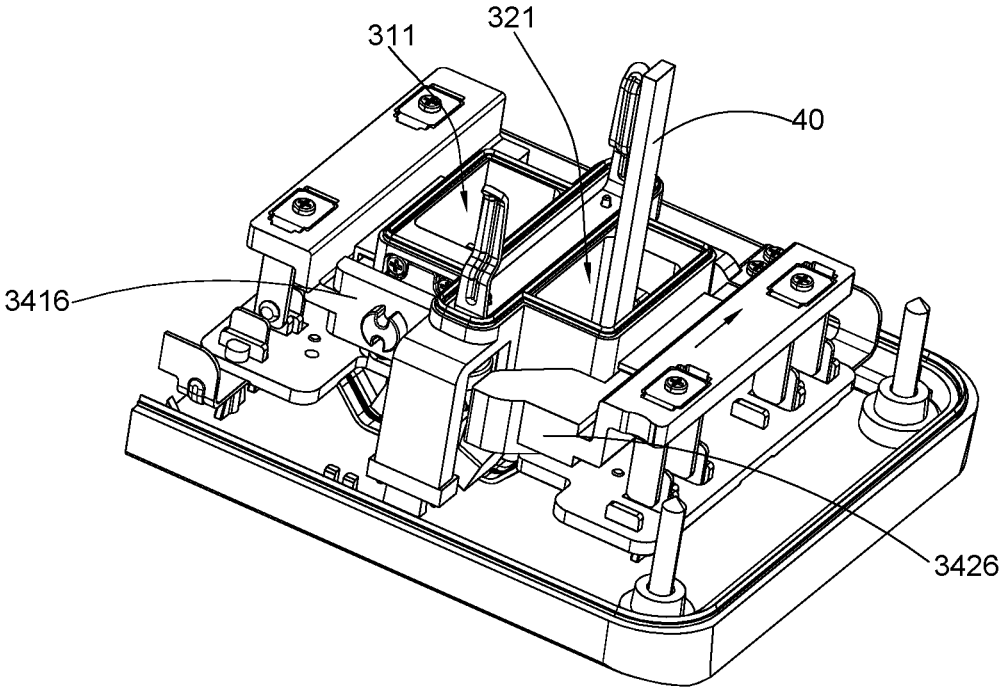
FIGS. 32 and 33 are schematic state views of a safety socket according to an alternative mode of the above preferred embodiment of the present invention when a conductive object is inserted into another receptacle of a socket body thereof.
Figure 33:
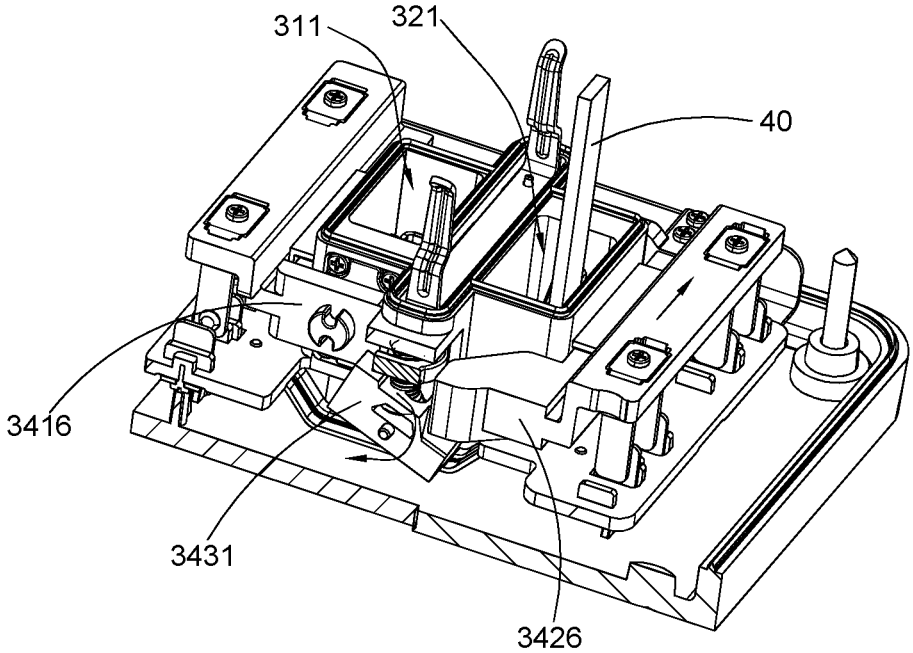
Figure 34:
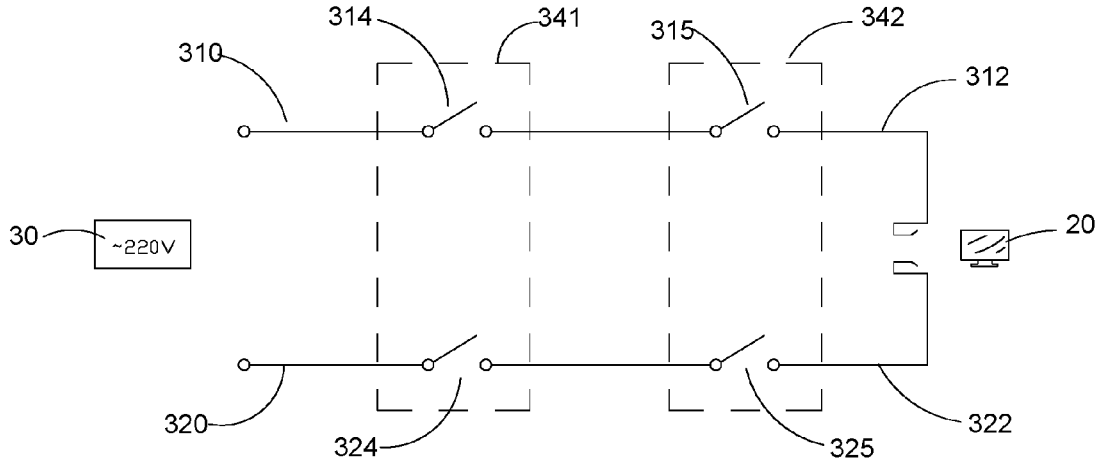
FIG. 34 is a circuit configuration of a safety socket according to an alternative mode of the above preferred embodiment of the present invention.

Accordingly, as shown in FIG. 32 and FIG. 33, when an electrical conductive object is inserted into the neutral wire receptacle 321 and the pushing force is not enough to push the second pushing element 3421 of the second locking control unit 342, the staring element 3425 of the second actuating element 3422 switches on the second live wire connection switch 315 and the second neutral wire connection switch 325, and the second actuating body 3426 of the second actuating element 3422 applies a pushing force on the second effect surface 3436. Since the pushing force of the second actuating body 3426 only applies to the outer side of the braking element 3431, the braking element 3431 rotates around the rotating shaft 3433 such that the first effect surface 3435 moves away from the initial position and the braking element 3431 is in an another inclined position. It is worth mentioning that when another conductive object is inserted into the neutral wire receptacle 321 of the socket body 300, the braking element 3431 under this state prevents the motion of the first actuating element 3412 and further prevents the motion of the first pushing element 3411 so as to prevent the activating of the first locking control unit 341. In other words, when an conductive object is inserted into the live wire receptacle 311 once again, since the first actuating body 3416 and the first effect surface 3435 are in a dislocation state, the first actuating body 3416 cannot apply a pushing force on the first effect surface 3435 and cannot move under the restriction of the braking element 3431, and the first locking control unit 341 cannot be activated such that the first live wire connection switch 314 and the second live wire connection switch 315 cannot be switched on, thereby the whole live wire connection circuit 312 and the neutral wire connection circuit 322 are electrically disconnected to prevent any conductive object from being inserted into the neutral wire receptacle 321 resulting in electric shock accident.

Figure 35:
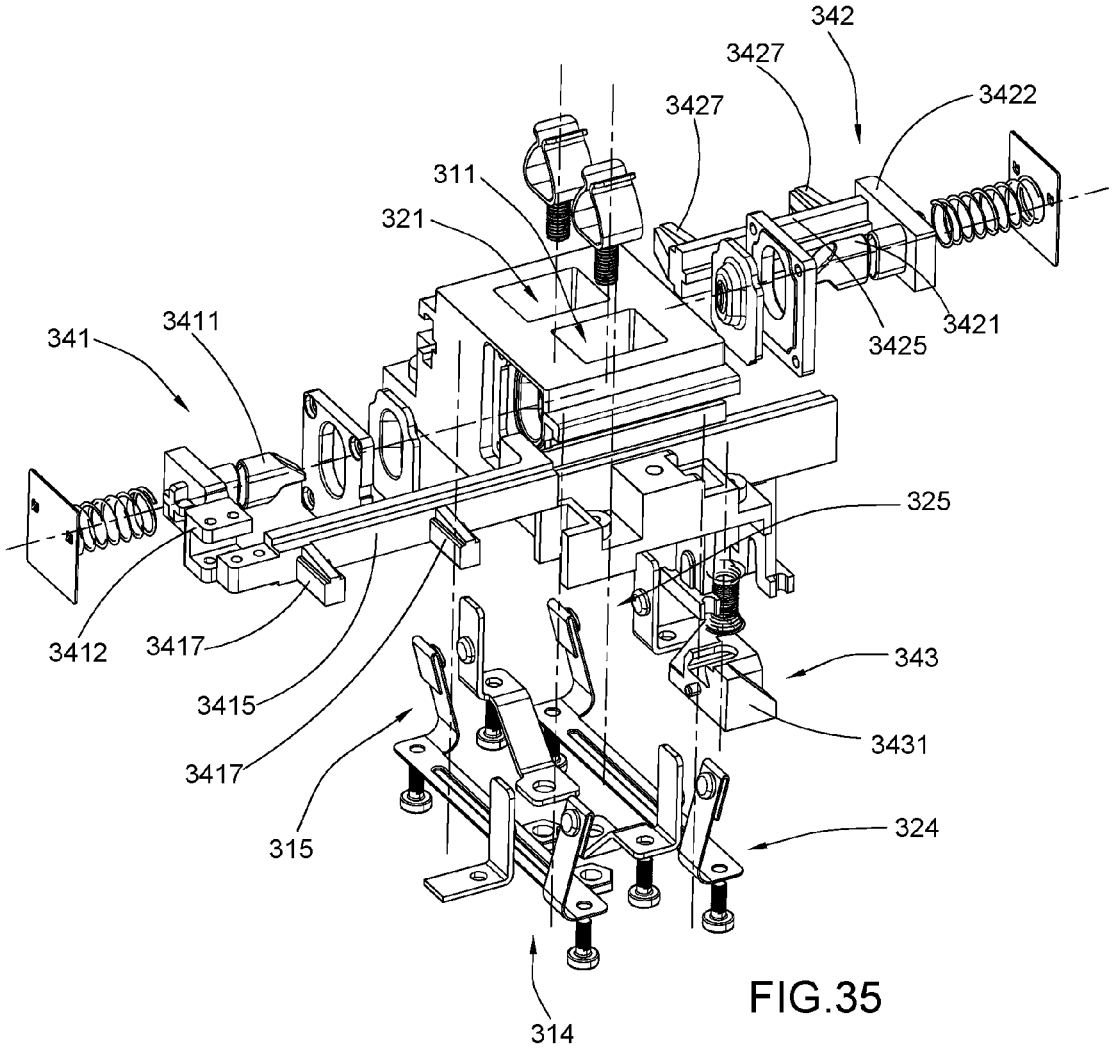
FIG. 35 is a schematic exploded view of a safety socket according to an alternative mode of the above preferred embodiment of the present invention.
Figure 36A:
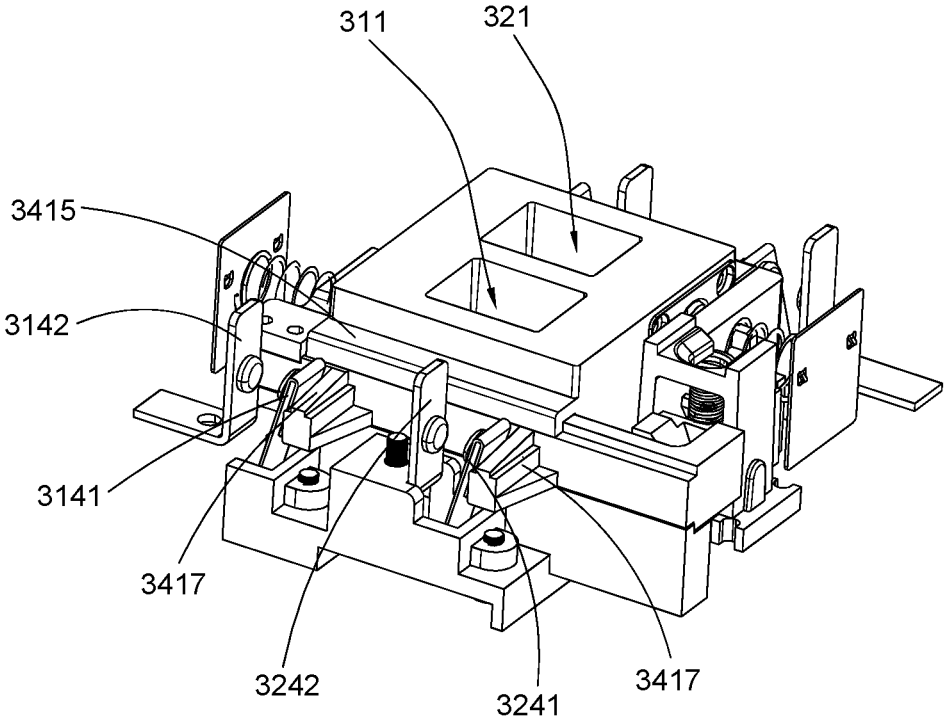
FIG. 36A is a perspective view of a safety socket according to an alternative mode of the above preferred embodiment of the present invention.
Figure 36B:
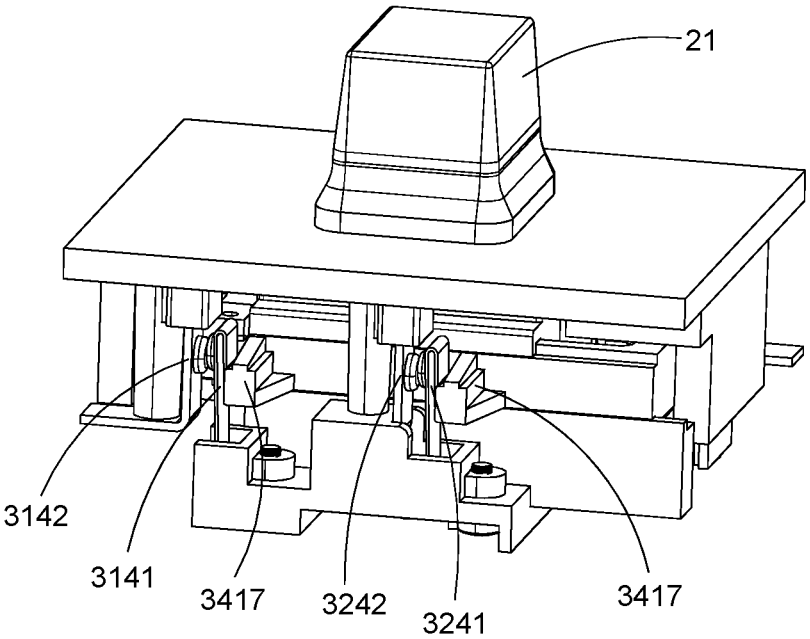
FIG. 36B is an exploded view of a safety socket according to an alternative mode of the above preferred embodiment of the present invention when an appliance plug is inserted into the socket body.
Figure 37:
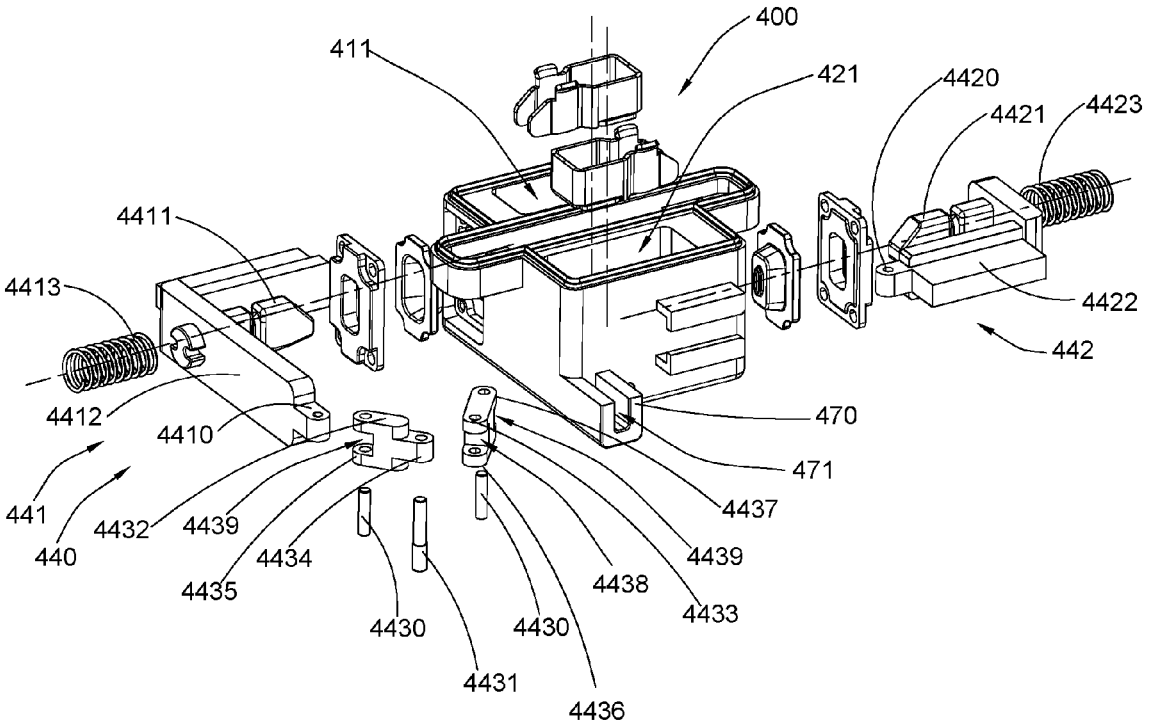
FIG. 37 is a schematic exploded view of a safety socket according to a third preferred embodiment of the present invention.
Figure 38A:
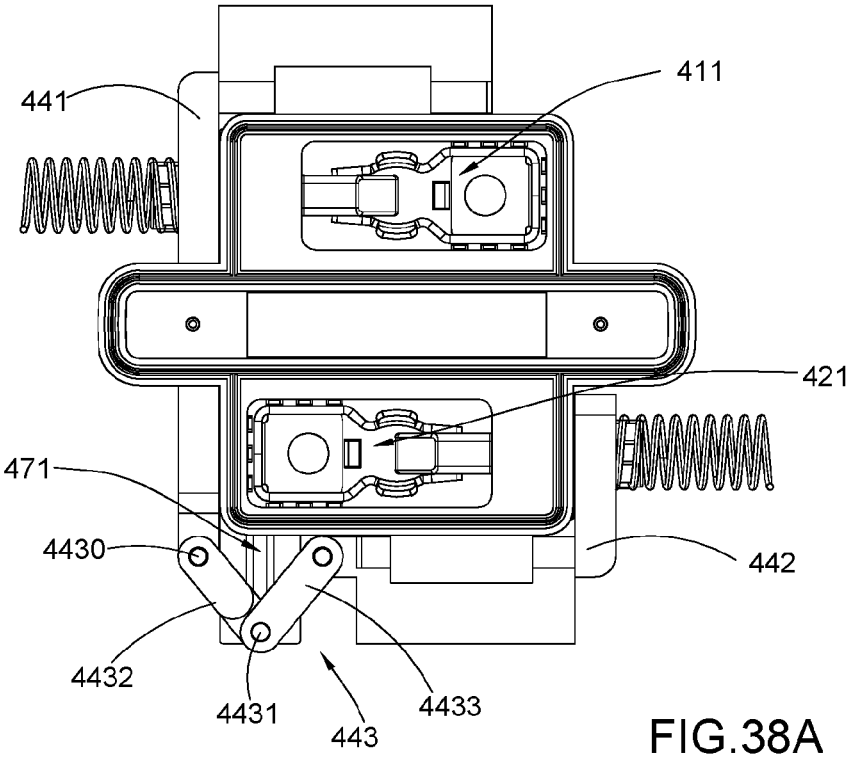
FIGS. 38A and 38B respectively are a top view and a perspective view of the safety socket according to the above preferred embodiment of the present invention.
Figure 38B:
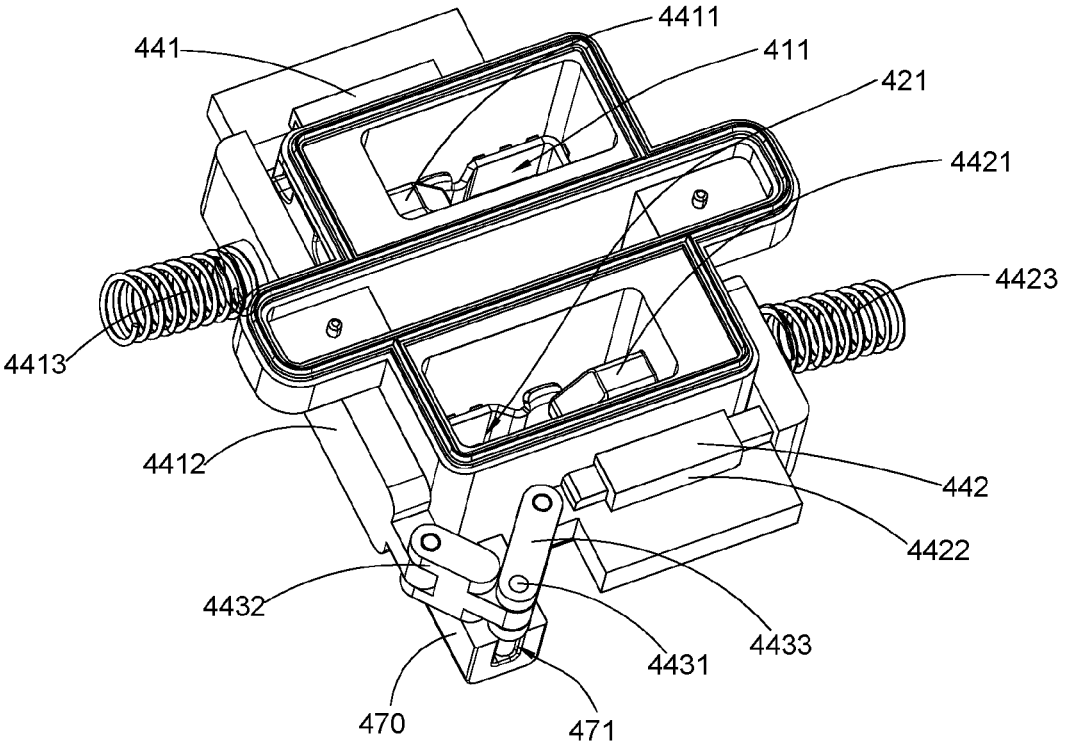
Figure 39A:
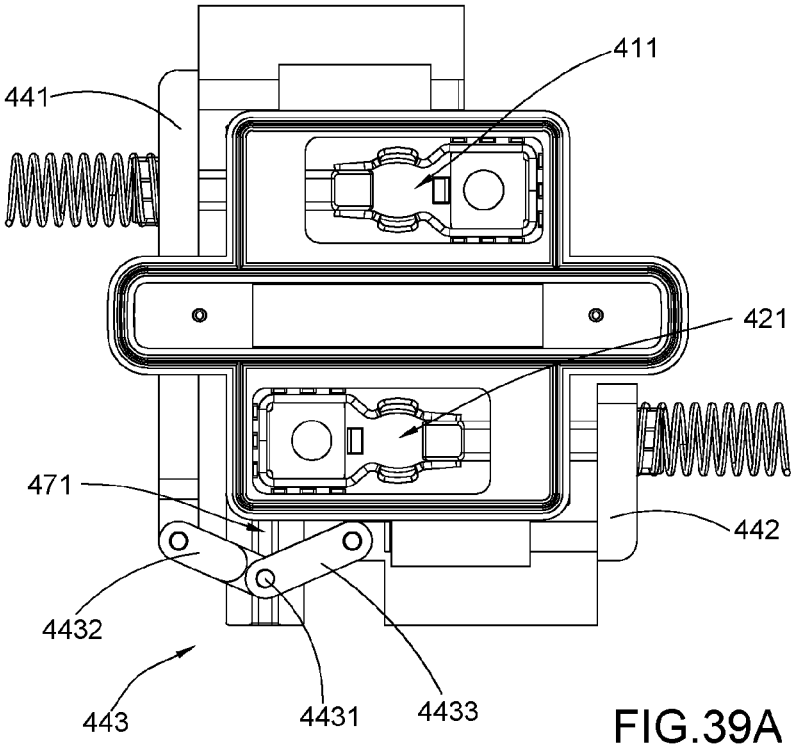
FIGS. 39A and 39B are a top view and a perspective view of the safety socket according to the above preferred embodiment of the present invention when an appliance plug is inserted into the socket body.
Figure 39B:
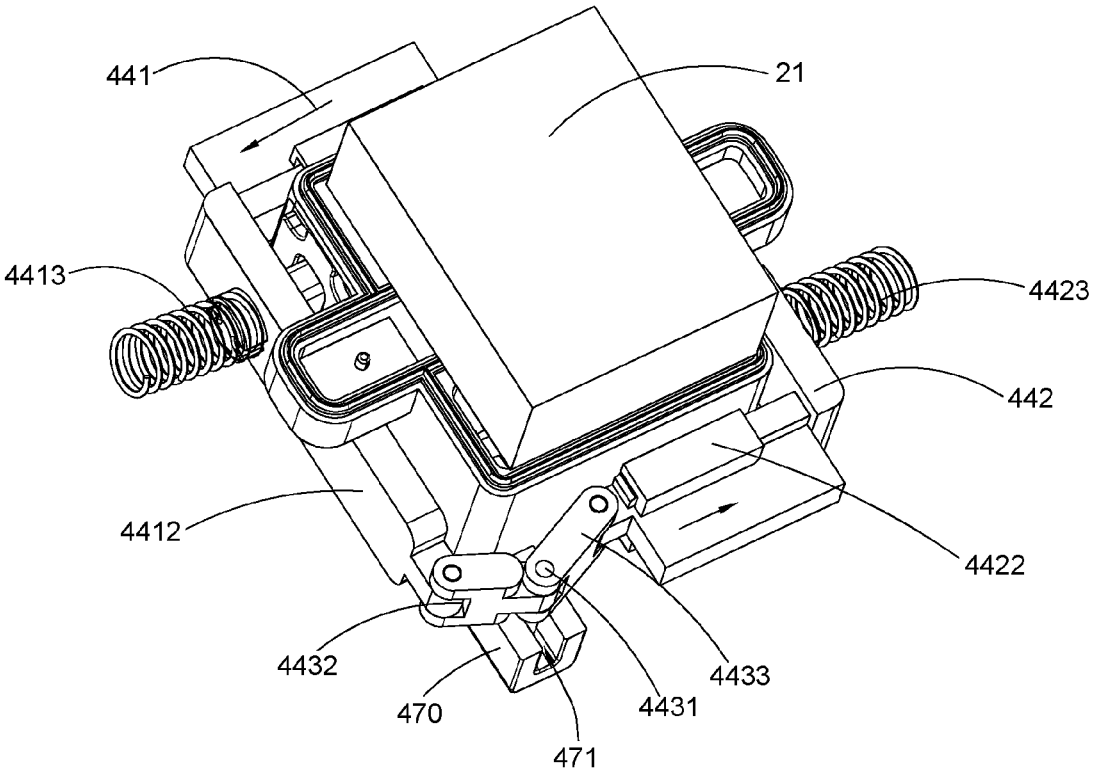
Figure 40:
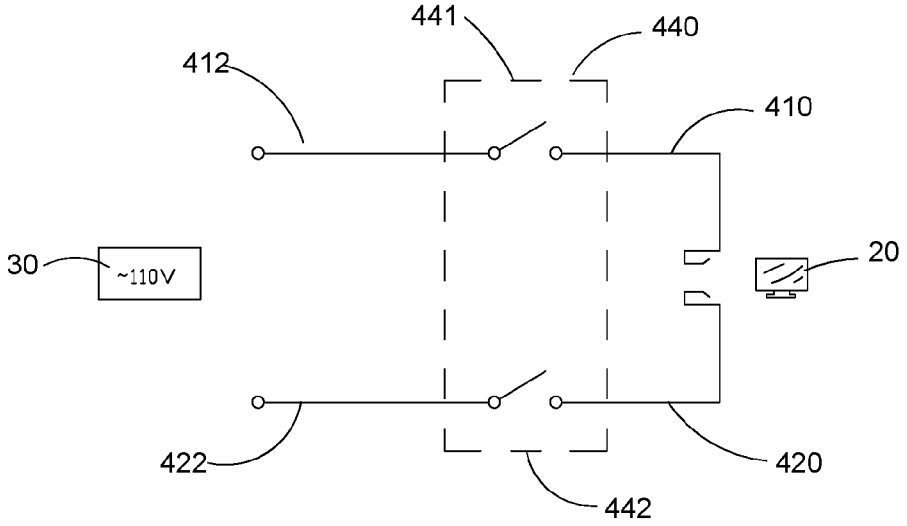
FIG. 40 is a circuit connection structural diagram of the safety socket according to the above preferred embodiment of the present invention.
Figure 41:
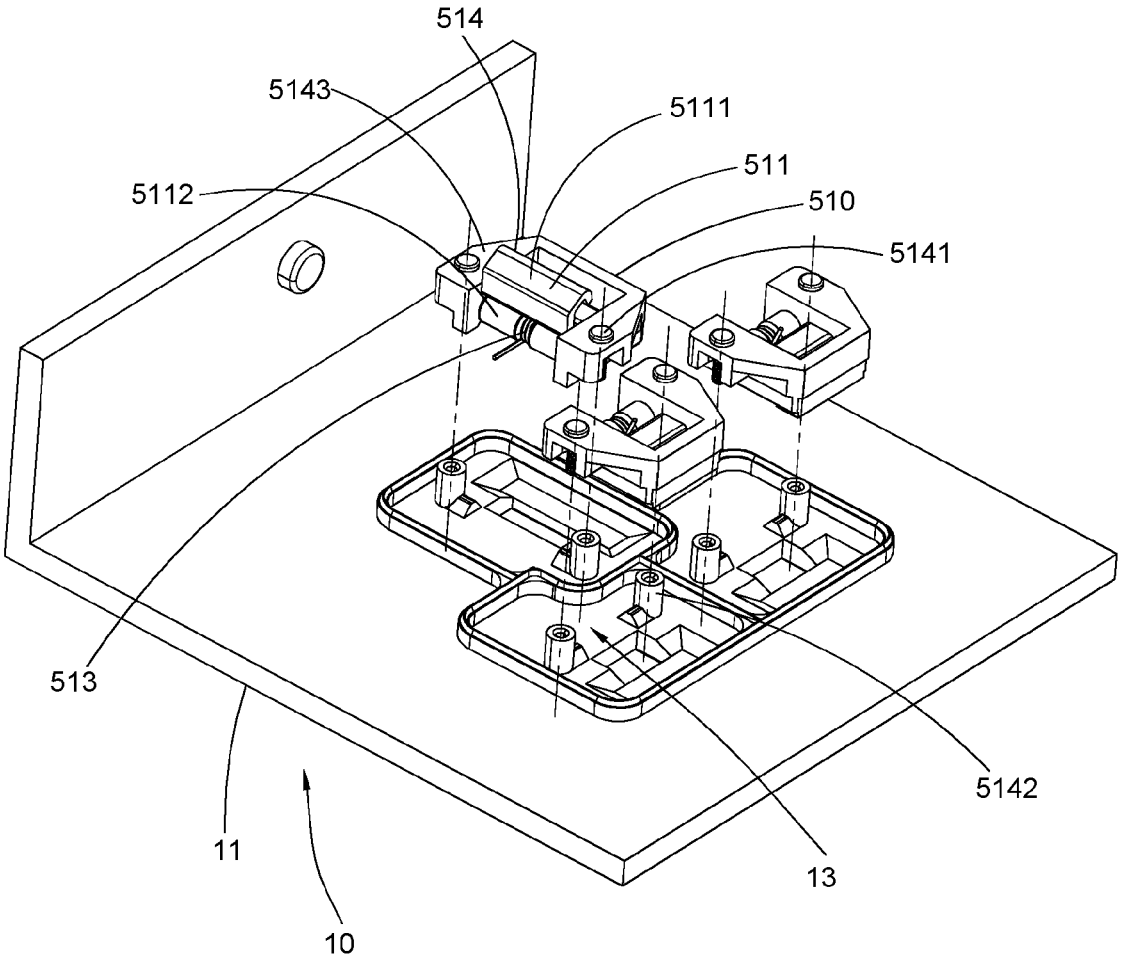
FIG. 41 is a perspective view of a safety socket according to a fourth preferred embodiment of the present invention, illustrating a mounting position of a protecting member of a socket body thereof

Referring to the FIGS. 35, 36A and 36B, another alternative mode of the safety socket 10 according to the second preferred embodiment of the present invention is illustrated. The safety socket 10 of this alternative mode has a similar structure with the safety socket 10 of the above alternative mode. Only the corresponding switching on and switching off of the switches are modified.

Specifically, in this alternative mode, similarly, the first actuating element 3412 of the first locking control unit 341 further comprises an staring element 3415 for simultaneously switching on and off the first live wire connection switch 314 and the first neutral wire connection switch 324. Accordingly, the second actuating element 3422 of the second locking control unit 342 further comprises a staring element 3425 for simultaneously switching on and off the second live wire connection switch 315 and the second neutral wire connection switch 325. As shown in FIGS. 36A and 36B, the first actuating element 3412 further comprises two starting arms 3417, which extend transversely or aslant from the corresponding staring element 3415. The two starting arms 3417 are spacedly disposed to switch on and off the first live wire connection switch 314 and the first neutral wire connection switch 324. Accordingly, the second actuating element 3422 further comprises two starting arms 3427, which extend transversely or obliquely from the corresponding staring element 3425. The two starting arms 3427 are spacedly disposed to switch on and off the second live wire connection switch 315 and the second neutral wire connection switch 325.

Similarly, for the first live wire connection switch 314 and the first neutral wire connection switch 324 as examples, the first live wire connection switch 314 and the first neutral wire connection switch 324 can be embodied as conductive members such as conductive plates, conductive columns and so on. More specifically, for example, the first live wire connection switch 314 comprises two connection ends 3141 and connection ends 3142 which are made of conductive materials such as coppers and contact to each other in the working state. The first neutral wire connection switch 324 comprises two connection ends 3241 and connection ends 3242 which are made of conductive materials such as coppers and contact to each other in the working state.

According to the preferred embodiment of the present invention, the connection ends 3141 and the connection ends 3241 have a predetermined elasticity. As shown in FIG. 36B, when the first pushing element 3411 drives the first actuating element 3412 to move, the two starting arms 3417 connected to the staring element 3415 respectively drive the connection ends 3141 and the connection ends 3241 to move so as to contact to the other corresponding connection ends 3142 and the connection ends 3242, such that the first live wire connection switch 314 and the first neutral wire connection switch 324 are connected with the corresponding live wire connection circuit and the neutral wire connection circuit. Furthermore, in the working state, conductive connections are formed between the connection ends 3141 and the connection ends 3142 and between the connection ends 3241 and the connection ends 3242 respectively, and further comprise conductive bumps respectively disposed on the contacting end, such that the conductive bumps respectively disposed on the contacting end contact to each other to form a point-to-point contacting conductive structure.

The second live wire connection switch 315 and the second neutral wire connection switch 325 may have a similar structure with the first live wire connection switch 314 as shown in FIG. 35, and, therefore, the detail structure is not repeated here again. Accordingly, the displacements of the two starting arms 3427 of the connection ends 3242 are enough to ensure the switching on and switching off of the second live wire connection switch 315 and the second neutral wire connection switch 325.

Referring to FIG. 37 to FIG. 40, a safety socket of a third preferred embodiment of the present invention is illustrated. The safety socket comprises one, two, three or multiple socket bodies 400, similar to the above second preferred embodiment, the socket body 400 comprises a live wire receptacle 411 and a neutral wire receptacle 421, and has a similar circuit connection structure and connection switches. While in this third preferred embodiment of the present invention, what is distinguished with the above second preferred embodiment is the locking and controlling mechanism 440, while the other structures are similar, and therefore, the structure of the locking and controlling mechanism 440 is mainly described in this embodiment.

Accordingly, the locking and controlling mechanism 440 includes a first locking control unit 441, a second locking control unit 442 and a braking unit 443. The first locking control unit 441 comprises a first pushing member 4411, a first actuating member 4412 and a first reset member 4413. The first reset member 4413 and second reset member 4423 can be embodied as reset springs and are respectively adapted for returning to their initial state from the working state under the elastic restoring force.

According to this preferred embodiment of the present invention, the braking unit 443 connects the first actuating member 4412 with the second actuating member 4422. More specifically, the braking unit 443 comprises a positioning member 4431, a first connection member 4432 and a first connection member 4432. One end of each of the first connection member 4432 and the second connection member 4433 is pivotally mounted to the positioning member 4431, and, respectively, each of the other end of the first connection member 4432 and the second connection member 4433 is pivotally mounted to the first actuating member 4412 and the second actuating member 4422.

Moreover, the socket body 400 further comprises a guide member 470 having a guide groove 471. Preferably, the guide member 470 is integrally protruded from the outer side wall of one of the socket body 400. The positioning member 4431 is adapted for sliding in the guide groove 471 of the guide member 470 such that the socket body 400 switches between the operation state and the idle state.

In this preferred embodiment of the present invention, the first connection member 4432 comprises a first connecting end portion 4434 and a first coupling end portion 4435. The second connection member 4433 comprises a second connecting end portion 4436 and a second coupling end portion 4437. The first connecting end portion 4434 of the first connection member 4432 is assembled with the second connecting end portion 4436 of the second connection member 4433 by the positioning member 4431. Accordingly, the first connecting end portion 4434 and the second connecting end portion 4436 can be provided with positioning holes respectively, wherein the positioning member 4431 penetrates through the positioning holes of the first connecting end portion 4434 and the second connecting end portion 4436. As shown in FIG. 35, the second connecting end portion 4436 has a blocking groove 4438 and the first connecting end portion 4434 is received in the blocking groove 4438 so as to from a solid connection structure Furthermore, in the preferred embodiment of the present invention, the first coupling end portion 4435 of the first connection member 4432 has a similar structure with the second coupling end portion 4437 of the second connection member 4433 and is respectively used for the connection of the first actuating member 4412 and the second actuating member 4422. More specifically, each of the first coupling end portion 4435 and the second coupling end portion 4437 has a blocking joint groove 4439. Each of the first actuating member 4412 and the second actuating member 4422 comprises an installing member 4410, formed in the end portion thereof. The installing member 4410 and the installing member 4420 are respectively received in the blocking joint groove 4439 and are connected together by a pivot member 4430.

It is worth mentioning that one skilled in the art may think of other configurations of the first connection member 4432 and the second connection member 4433 under the inspiration of the preferred embodiment of the present invention. For example, the blocking joint groove 4439 can be formed in the first actuating member 4412 and the second actuating member 4422. The above detail structures of the first connection member 4432 and the second connection member 4433 are exemplary only and are not intended to be limiting in this aspect.

When the live wire pin 201 and the neutral wire pin 202 are respectively and simultaneously inserted into the live wire receptacle 411 and the neutral wire receptacle 421 of the socket body 400, the live wire pin 201 and the neutral wire pin 202 respectively push the first pushing member 4411 and the first actuating member 4412 such that the first pushing member 4411 and the second actuating member 4422 respectively drive the corresponding first actuating member 4412 and the second actuating member 4422 to move, and that the first actuating member 4412 and the second actuating member 4422 then respectively drive the first connection member 4432 and the second connection member 4433 to move simultaneously, such that the positioning member 4431 is driven to slide in the guide groove 471 and the braking unit 443 is in the working state. As the first actuating member 4412 and the second actuating member 4422 both have normal displacements to respectively switch on the circuit connection switches, the live wore connection circuit and the neutral wire connection circuit are electrically connected such that the socket body 400 works normally.

When the first actuating member 4412 and the second actuating member 4422 move simultaneously, the force which is transmitted to the positioning member 4431 from the first connection member 4432 focuses along the direction of the guide groove 471, while acting forces of the first actuating member 4412 and the second actuating member 4422 which are respectively vertical to the direction of the guide groove 471 are canceled out, such that the positioning member 4431 only slides in the guide groove 471. And in return, the displacements of the first actuating member 4412 and the second actuating member 4422 are further allowed such that the first actuating member 4412 and the second actuating member 4422 switch on the corresponding circuit switches.

However, when an electrical conductive object is inserted into only one receptacle of the live wire receptacle 411 and the neutral wire receptacle 421 of the socket body 400, the live wire connection circuit and the neutral wire connection circuit of the socket body 400 are all electrically disconnected so as to prevent electrical shock accident. More specifically, for example, when a conductive object is inserted into only the live wire receptacle 411 of the socket body 400 and the pushing force is not enough to push the first pushing member 4411, the pushing force is further transmitted to the first actuating member 4412 and the positioning member 4431, but the positioning member 4431 is only pulled on one side, wherein the positioning member 4431 cannot properly reach the normal working state along the guide groove 471.

More specifically, when a conductive object is inserted into only the live wire receptacle 411 of the socket body 400 and the first actuating member 4412 applies acting force on the positioning member 4431, as the second connection member 4433 connects the positioning member 4431 to the second locking control unit 442, the second actuating member 4422 of the second locking control unit 442 and the second reset member 4423 apply opposite acting forces on the positioning member 4431 so as to prevent the further motion of the first actuating member 4412, such that the corresponding connection circuit will not be electrically connected to prevent electric shock accident.

Thus, in this preferred embodiment of the present invention, the locking and controlling mechanism 440 has three states, that are the idle state, the self-locking state and the operating state. Accordingly, an application method of the safety socket 10 according to the preferred embodiment of the present invention is provided, wherein the safety socket 10 comprises at least one socket body 400. The socket body 400 has a live wire receptacle 411 and a neutral wire receptacle 421 and comprises a live connection circuit 412, a neutral connection circuit 422 and a locking and controlling mechanism 440. The method comprises the following steps:

(i) When the locking and controlling mechanism 240 is in the ideal state, the live wire connection circuit 212 and the neutral wire connection circuit 222 are electrically disconnected.

(ii) When an electrical conductive object is independently inserted into one receptacle of the live wire receptacle 411 and the neutral wire receptacle 421, and the corresponding locking and controlling mechanism 440 is in the a self-locking state, the locking and controlling mechanism 440 prevents the live connection circuit 412 and the neutral connection circuit 422 from electrically connecting so that electric shock accident is prevented.

(iii) When the live wire pin 201 and the neutral wire pin 202 of the electric appliance 20 are simultaneously inserted into the live wire receptacle 411 and the neutral wire receptacle 421, the locking and controlling mechanism 440 is activated by the live wire pin 201 and the neutral wire pin 202 and in the operation state, such that the locking and controlling mechanism 440 electrically connects the live connection circuit 412 and the neutral connection circuit 422 and the electric appliance 20 works normally under the electricity supply of the power supply 30 through the socket body 400 electrically connecting to the power supply 30.

In the above step (i), when no conductive object or other object is inserted into the live wire receptacle 411 and the neutral wire receptacle 421, the locking and controlling mechanism 440 is in the idle state, or when a conductive object is inserted into the live wire receptacle 411 or the neutral wire receptacle 421 but the shape, the size and the magnitude of the pushing force of the conductive object is not enough to activate the locking and controlling mechanism 440, the locking and controlling mechanism 440 is still in the idle state.

In the step (ii), different with the second embodiment in which the braking unit 243 of the locking and controlling mechanism 240 achieves the self-locking, however, since in this preferred embodiment of the present invention embodiment, the first actuating member 4412 and second actuating member 4422 are electrically connected by the braking unit 443, such that when only one of the first locking control unit 441 and the second locking control unit 442 is in the activating state, the other locking control unit prevents the activating of the one locking and controlling unit by the braking unit 443 so as to prevent electric shock accident. In other words, when the first locking control unit 441 is activated, the second locking control unit 442 prevents further motions of the first actuating member 4412 of the first locking control unit 441 to achieve the self-locking purpose. Similarly, when the first locking control unit 441 is activated, the first locking control unit 441 prevents further motions of the second actuating member 4422 to achieve the self-locking purpose.

In the step (iii), the first locking control unit 441 and the 4442 are under the simultaneously actions of the live wire pin 201 and the neutral wire pin 202 of the appliance plug 21, and the first locking control unit 441 and the second locking control unit 442 are simultaneously activated. The direction of the resultant force of the acting forces of the first locking control unit 441 and the second locking control unit 442 is consistent. In other words, the component forces of the motions of the positioning members in perpendicular directions are canceled with each other, such that two ends of the positioning member 4431 of the braking unit 443 bear force together and the positioning member 4431 will bear averaged force such that the corresponding connection switches are switched on, wherein the live connection circuit 412 and the neutral connection circuit 422 are in a connection state, thereby the socket body 400 works normally.

In the preferred embodiment of the present invention, the first locking control unit 441 and the second locking control unit 442 can respectively control a set of connection switches comprising one or more connection switches. For example, the first locking control unit 441 can control the switch on and off of one live wire connection switch, and can also control the switch on and off of one live wire connection switch and one neutral wire connection. Accordingly, the second locking control unit 442 can control the switch on and off of one neutral wire connection switch, and can also control the switch on and off of one live wire connection switch and one neutral wire connection.

Referring to FIG. 41 to FIG. 44, a safety socket of a fourth preferred embodiment of the present invention is illustrated. The safety socket 10 comprises one, two, three or multiple the socket bodies 500. The socket body 500 has two or more receptacles 501 and each receptacle 501 has a receptacle opening 502. The safety socket further comprises a socket shell 11. The socket shell 11 forms two or more jacks 13 corresponding to the socket body 500. The live wire pin 201 of the appliance plug 21 reaches the receptacle opening 502 through the jacks 13 and further is inserted into the receptacle 501 of the socket body 500.

In this preferred embodiment of the present invention, each of the socket body 500 of the safety socket 10 further comprises two or more protecting assemblies 510 adapted for switching between a protecting position and a working position. In the protecting position, the protecting assembly 510 is adapted to seal the receptacle openings 502 so as to prevent any conductive object from inserting into the receptacles 501. Only when the live wire pin 201 of the electric appliance 20 is inserted into the jacks 13 and the pushing force is big enough, the protecting assembly 510 switches to the working position from the protecting position, such that the live wire pin 201 of the appliance plug 21 is inserted into the receptacles 501.

More specifically, the protecting assembly 510 comprises a protecting member 511, a rotation shaft 512 and a reset member 513. The protecting member 511 is adapted to rotate around the rotation shaft 512 so as to switch between the protecting position and the working position. And, when the live wire pin 201 of the electric appliance 20 is removed from the receptacles 501 and is removed from the safety socket 10 through the jacks 13, the resetting effect of the reset member 513 makes the protecting member 511 returning to the initial position, so that the protecting assembly 510 switches back to the protecting position from the working position.

Figure 42A:
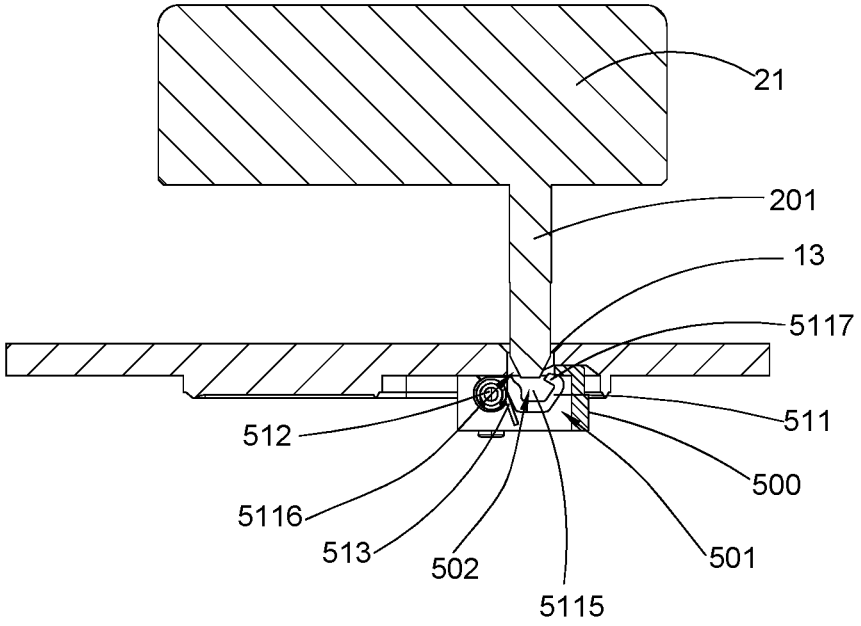
FIG. 42A is a perspective view of the safety socket according to the above preferred embodiment of the present invention.
Figure 42B:
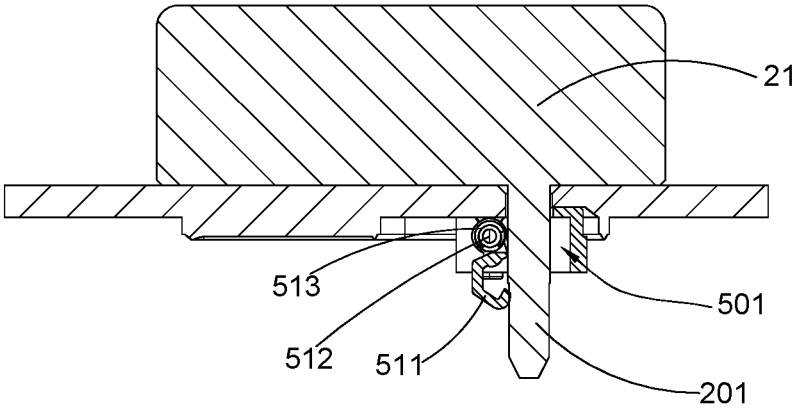
FIG. 42B is a perspective view of the safety socket according to the above preferred embodiment of the present invention.

As shown in FIG. 42A, in the protecting position, the protecting member 511 seals the receptacle openings 502 to hide the receptacles 501. As shown in FIG. 42B, the protecting member 511 is rotated to switch to the working position to expose the receptacle openings 502, so that the live wire pin 201 of the appliance plug 21 is inserted into the receptacles 501. More specifically, as shown in the drawings, the protecting member 511 is rotated clockwise from the initial horizontal position to a vertical position, thereby the live wire pin 201 of the appliance plug 21 is allowed to be inserted into the receptacles 501.

The protecting assembly 510 is disposed in the receptacles 501 and is mounted on the inner wall of the receptacles 501 or attached to the inner surface of the socket shell socket shell 11 of the safety socket 10. In this preferred embodiment of the present invention, the protecting assembly 510 is mounted on the inner surface of the socket shell socket shell 11 of the safety socket 10. More specifically, the protecting assembly 510 further comprises a mounting member 514 comprising at least one first connecting member 5141 and at least one second connecting member 5142 and adapting for fixed connection on the inner surface of the socket shell socket shell 11. For example, the first connecting member 5141 and second connecting member 5142 can be connected with each other by screwing, and the first connecting member 5141 is a screw rod with an external thread, and the second connecting member 5142 is a nut with internal thread. It is worth mentioning that the mounting member 514 can be integrally formed with the socket shell 11.

The mounting member 514 further comprises a main body section 5143 having a mounting concave groove 5144 for receiving the protecting member 511. The protecting member comprises a protecting body 5111 and a base portion 5112. The protecting body 5111 is fixedly connected to or integrally extends from the base portion 5112. The base portion 5112 further has perforations 5113 and mounting grooves 5114. The rotation shaft 512 penetrates through the perforations 5113 and is assembled with the base portion 5112, such that the protecting member 511 is adapted to rotate around the rotation shaft 512 to perform a rotational motion.

According to the preferred embodiment of the present invention, the reset member 513 can be embodied as a reset torsion spring and comprises a spring body 5131, a first presser foot 5132 extending integrally from the spring body 5131 and a second presser foot 5133. The spring body 5131 has a center hole 5134, wherein the reset member 513 is assembled to the mounting grooves 5114 of the base portion 5112 so as to correspond the center hole 5134 of the spring body 5131 to the perforations 5113 of the rotation shaft 512, wherein the rotation shaft 512 penetrates through the perforations 5113 of the base portion 5112 and the center hole 5134 of the spring body 5131, wherein the rotation shaft 512 assembles the base portion 5112 with the reset member 513 and the rotation shaft 512 is preferable in a steady state without the occurrence of movement. It is understanding that the reset member 513 can also have other structures, and the specific reset torsion spring above is exemplary only and not intended to be limiting in this aspect.

In the protecting position, the first presser foot 5132 applies an acting force on the inner surface of the protecting body 5111, thereby preventing conductive objects pulling the protecting body 5111 to open. When the live wire pin 201 of the appliance plug 21 contacts the protecting body 5111 and the pushing force is sufficient to overcome the pressure the first presser foot 5132 applied, the protecting body 5111 switches from the protecting position to the working position. The second presser foot 5133 may be pressed in the inner wall of the receptacles 501. When the live wire pin 201 of the appliance plug 21 is removed from the receptacles 501 and further away from the socket body 500, the stress of the reset member 513 stored is released, so that the protecting body 5111 returns to its original protecting position by the first presser foot 5132 pressing on the protecting body 5111.

Figure 43:
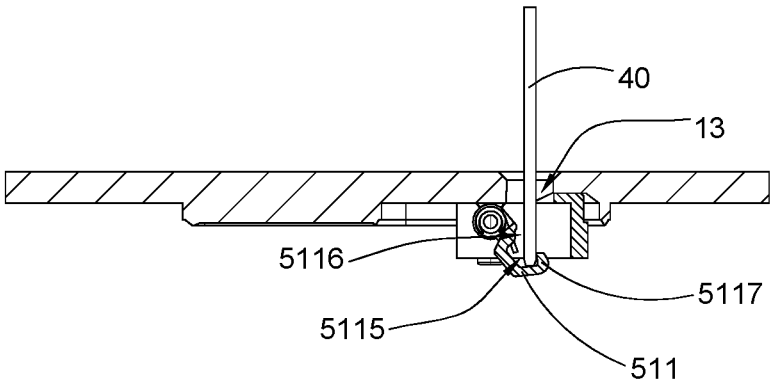
FIG. 43 is a perspective view of the safety socket according to the above preferred embodiment of the present invention when a conductive object is inserted into a receptacle opening of the socket body.
Figure 44:
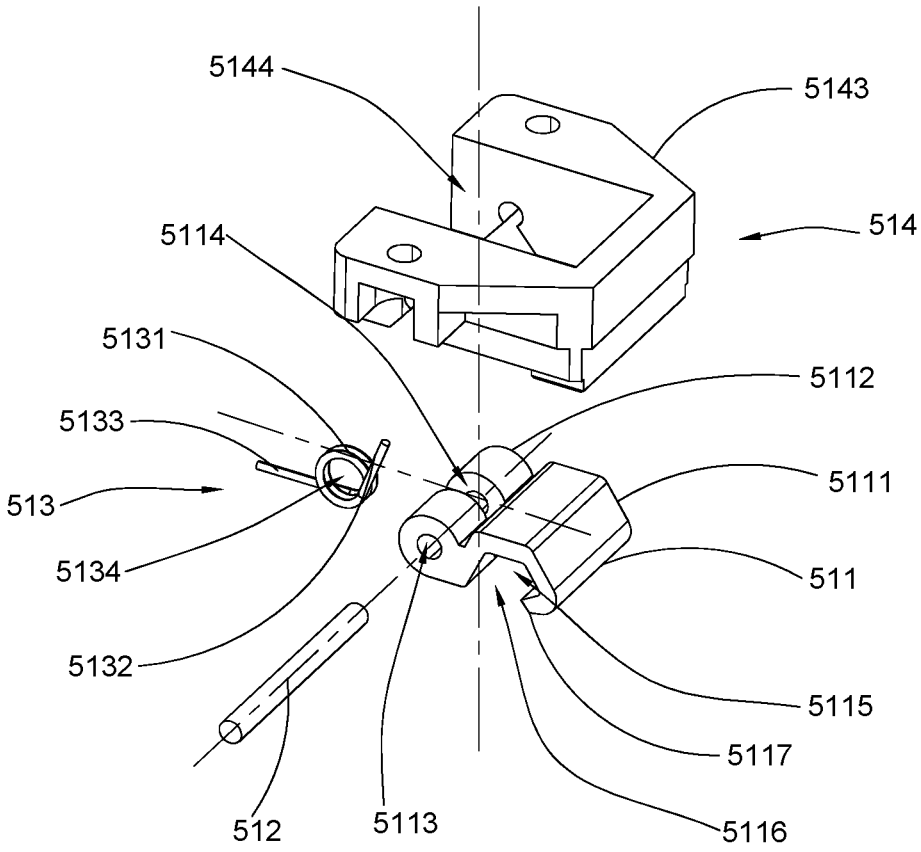
FIG. 44 is an exploded view of the safety socket according to the above preferred embodiment of the present invention.

In addition, according to the preferred embodiment of the present invention, the protecting body 5111 is further hook-shaped and has a jack slot 5115. As shown in FIG. 43, when an electrical conductive object 40, such as a thin iron wire, a metal rod and etc., is inserted into the jacks 13, the conductive object 40 enters into the jack slot 5115, and the protecting body 5111 makes the conductive object 40 to retain in the jack slot 5115 and cannot enter the receptacles 501 so as to further prevent electric shock accident.

Preferably, an opening 5116 of the jack slot 5115 can be slightly smaller than the size of the jacks 13 of the safety socket, wherein a tail end 5117 of the protecting body 5111 can appropriately extend into the jacks 13, which also allows the live wire pin 201 of the appliance plug 21 to push open the protecting body 5111, so that the protecting body 5111 will not interfere the normal working of the live wire pin 201 of the appliance plug 21.

It is worth mentioning that the protecting member 511 is provided so that the protecting body 5111 is able to seal the receptacle openings, such that dust is prevented from entering thereinto and water or other conductive liquid is not easily entering into the receptacles 501, thereby preventing short circuits. Moreover, since the jack slot 5115 and the mounting concave groove 5144 of the main body section 5143 are provided, water droplets which fall into the jack slot 5115 from the corresponding jacks 13 will be detained in the jack slot 5115 and will not enter into the receptacles 501, such that a further waterproof effect is ensured.

Referring to FIG. 45 to FIG. 48, a fifth preferred embodiment of a safety socket 10 of the present invention is illustrated. The safety socket 10 comprises one or more socket body 600 assembled in the socket shell 11. The socket body 600 has two, three or more receptacles, thereby forming a two-hole jacks socket, a three-hole jacks socket or multi-hole jacks socket. For example, in this embodiment, the socket body 600 has two receptacles, including a live wire receptacle 611 and a neutral wire receptacle 621. The socket shell 11 correspondingly forms two jacks 13. The socket body 600 is adapted for electrically connecting an electric appliance to a DC or an AC power source. The preferred embodiment of the present invention will be further described in the improved technical solution of the waterproof structure specific to the above four preferred embodiments.

Since, in the above embodiments, some certain receptacles are provided with action holes for mounting a corresponding locking and controlling mechanism, it is necessary to provide waterproof measures to prevent the water entering the receptacles or other conductive liquid entering into the isolation cavities of the safety socket through the corresponding action holes. Such receptacles and action holes are illustrated above such as the earth wire receptacle 131 and the action hole 134 of the embodiment, the receptacles and action holes of the second and the third embodiment such as the live wire receptacle 211, the live wire action hole 216, the neutral wire receptacle 221, and the neutral wire action hole 226.

In the preferred embodiment of the present invention, for a two-hole jackets socket as an example, the socket body 600 has a live wire receptacle 611 and a neutral wire receptacle 621. A live wire action hole 616 and a neutral wire action hole 626 are respectively in the side walls of the live wire receptacle 611 and the neutral wire receptacle 621 which are adapted to respectively install a pushing element 6411 of a first locking control unit 641 and a pushing member 6421 of a second locking control unit 642 of a locking and controlling mechanism 640.

Correspondingly, the socket body 600 forms the two receptacles, including the live wire receptacle 611 and the neutral wire receptacle 621 which are independent and isolated with each other. In other words, each of the receptacles are not communication with another, so that water or other conductive fluid enters into one receptacle but will not enter into other receptacles, thereby preventing an electric shock resulting from a short circuit.

In the preferred embodiment, each of the two receptacles has two wiring terminals for respectively connecting to the live wire circuit and the neutral wire circuit of the AC power. Certainly, when the socket body 600 of the present invention has three jacks, the electric appliance can be connected to the live wire circuit, the neutral wire circuit and the earth wire circuit of the AC power.

Side walls of each the live wire receptacle 611 and the neutral wire receptacle 621 are also provided with a water port 617 and a water port 627. Preferably, the water ports 617, 627 can be respectively formed on peripheral walls 610, 620 of each of the live wire receptacle 611 and the neutral wire receptacle 621. Thus, when water or other conductive fluid enters the side wall of the receptacle, the water or other conductive fluid will be discharged through the water ports 617, 627, such that the water or other conductive fluid will not be detained in the live wire receptacle 611 and the neutral wire receptacle 621 and the short circuit which results from overflowed water will be prevented. It is worth mentioning that the water ports 617, 627 can be provided at the bottom end of the peripheral walls 121 so as to completely discharge water or other conductive fluid. The water ports 617, 627 are formed at the same side of the live wire receptacle 611 and the neutral wire receptacle 621 and adjacent to each other.

Because of that each the live wire receptacle 611 and the neutral wire receptacle 621 also has the corresponding live wire action hole 616 and the neutral wire action hole 626, the water port 617 and the live wire action hole 616 can be provided in the opposite sides of the live wire receptacle 611, or the two adjacent sides. The water port 627 and the neutral wire action hole 626 can be provided in the opposite sides of the neutral wire receptacle 621, or the two adjacent sides. Thus, not only the normal working of the corresponding locking control unit is ensured, but also the water or other conductive fluid within the live wire receptacle 611 and the neutral wire receptacle 621 can be discharged in time.

Figure 45:
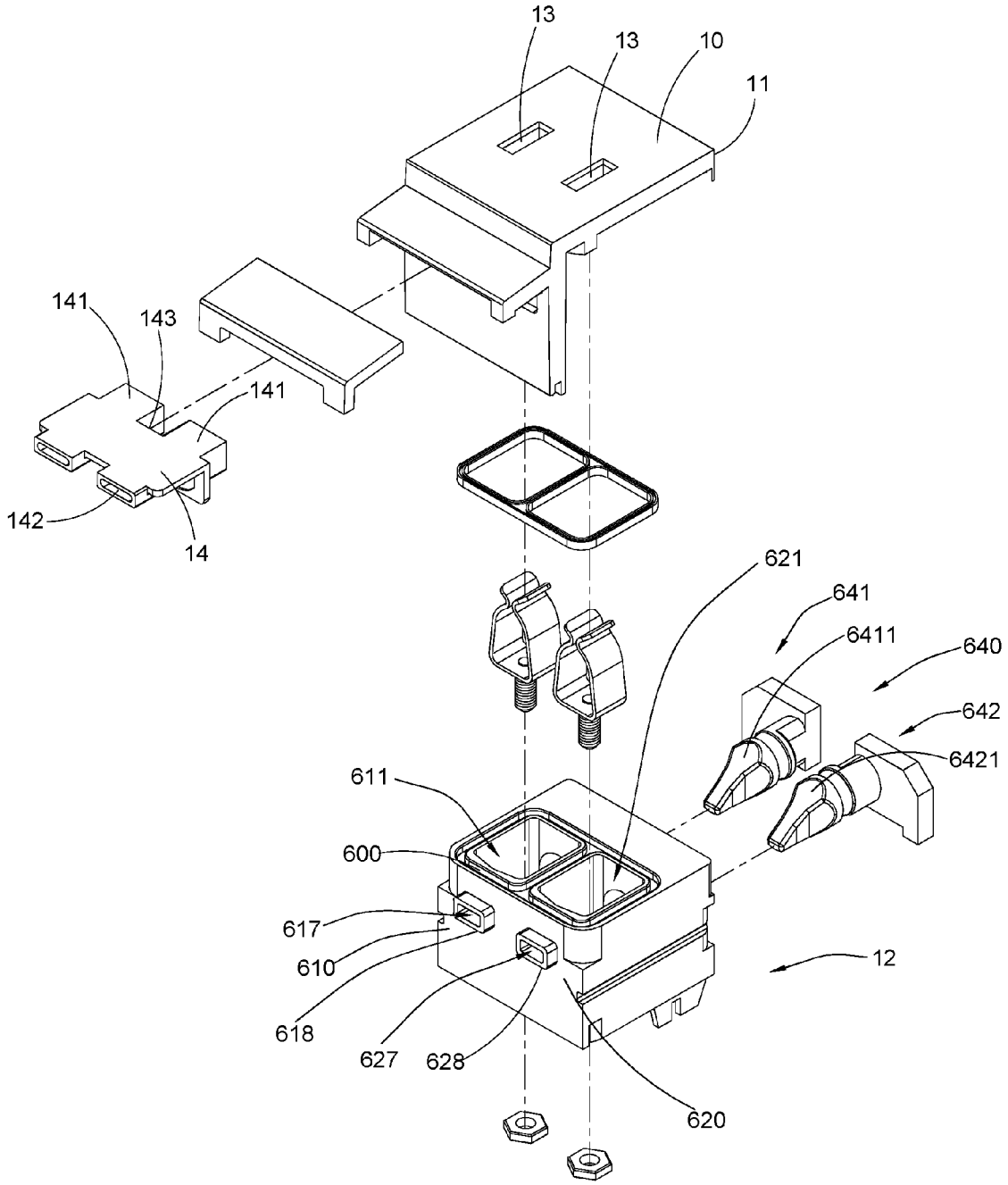
FIGS. 45 and 46 are an exploded view of a safety socket according to a fifth preferred embodiment of the present invention.
Figure 46:
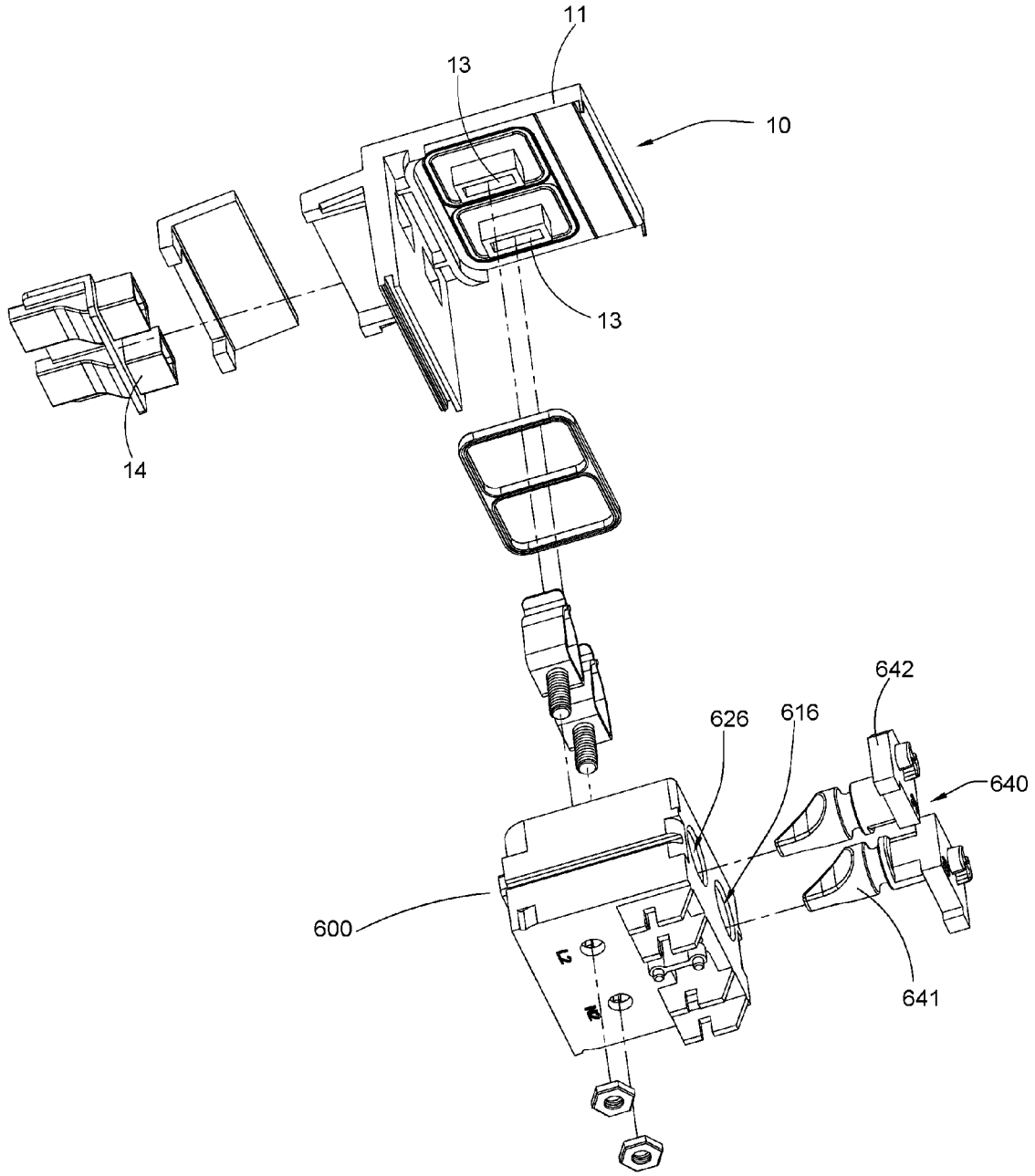
Figure 47:
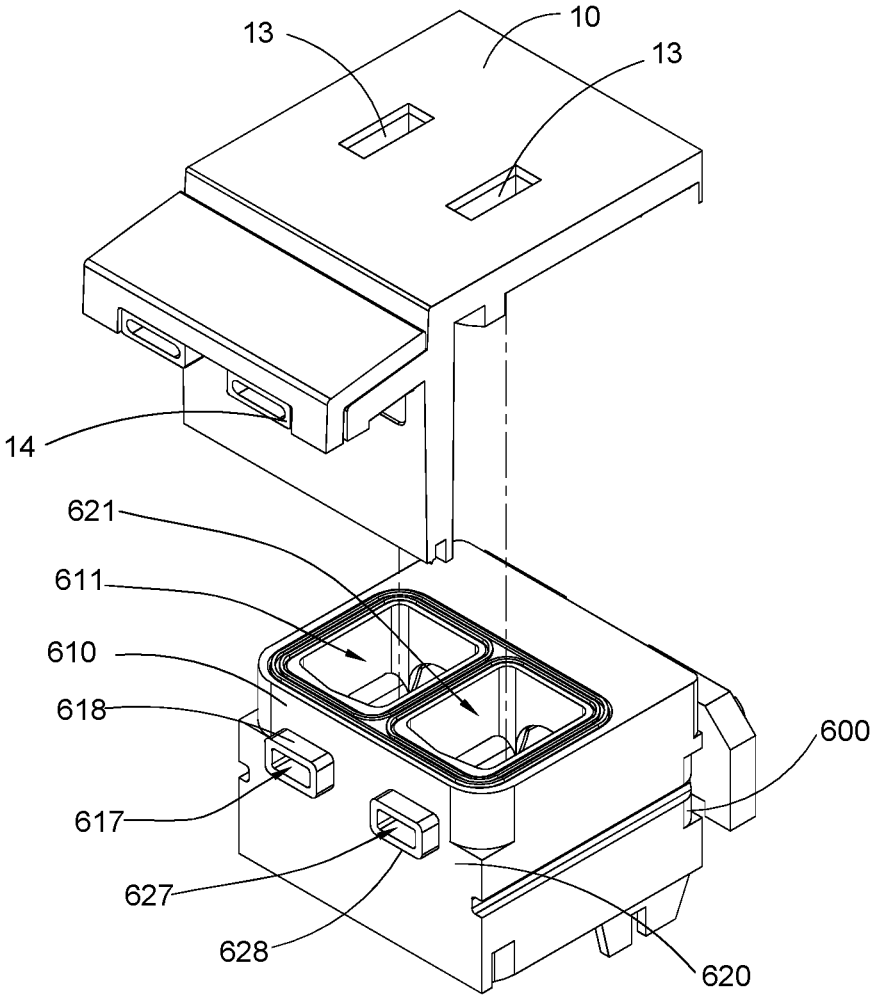
FIG. 47 is a perspective view of the safety socket according to the above preferred embodiment of the present invention.

Furthermore, as shown in FIG. 45 and FIG. 46, drainage portions 618, 628 are respectively formed in the water ports 617, 627. The drainage portion 618 and the drainage portion 628 respectively protrude and extend from the peripheral walls 610, 620. The safety socket 10 further comprises a drainage arrangement 14 which is connected with the drainage portion 618 and the drainage portion 628 and adapted for guiding water or other conductive fluid to flow out of the safety socket 10. According to the embodiment, the drainage arrangement 14 can be an integrally formed member, which comprises two guide portions 141 respectively form two guide channels 142 for respectively exporting the water or other conductive fluid within the socket shell 11 of the safety socket 10. The two guide portions 141 are integrally assembled together by a connection portion 143.

According to the embodiment, the safety socket 10 comprises the socket shell 11 and one or more socket bodies 600. The jacks 13 is formed in the socket shell 11. Each of the live wire receptacle 611 and the neutral wire receptacle 621 is formed inside of the socket body 600. It is worth mentioning that the drainage arrangement 14 can be integrally extended from the peripheral wall 610 of the live wire receptacle 611 and the peripheral wall 620 of the neutral wire receptacle 621, such that the drainage portion 618 and the drainage portion 628 are not need to be provided. It is worth mentioning that the two water ports 617, 627 respectively cooperate with the two actuating elements 142 for exporting the water within the receptacle out of the safety socket 10. Each of the drainage arrangement 14 is extended into the socket body 600 and is communicated with the water ports 617, 627 of the socket body 600.

Figure 48:
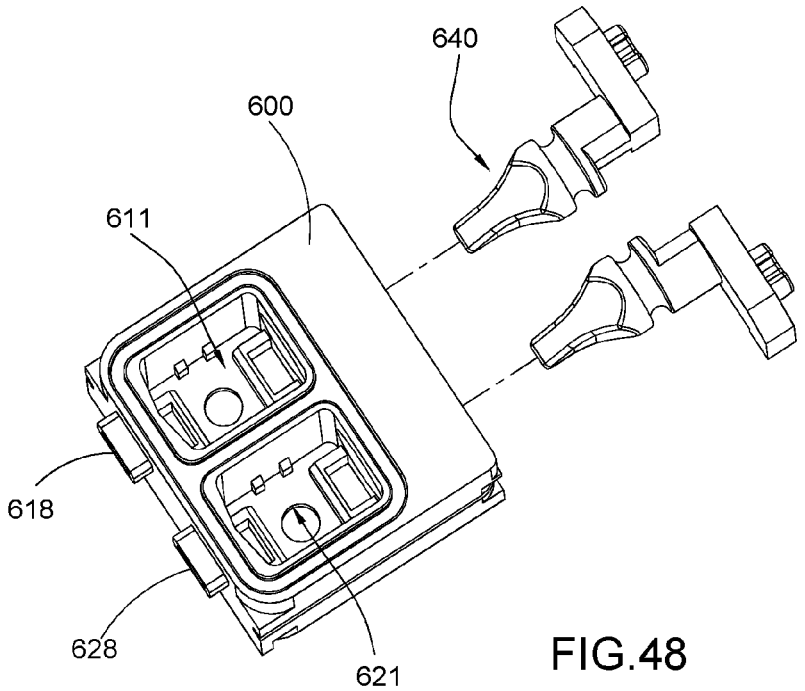
FIG. 48 is an exploded view of a receptacle of the safety socket according to the above preferred embodiment of the present invention.

Furthermore, as shown in FIG. 48, the internal circuit structure of the socket body 600 is completely sealed and isolated with the live wire receptacle 611 and the neutral wire receptacle 621, so that when water or other conductive fluid enters the receptacles, the water or other conductive fluid will not enter into the interior of the socket body 600 so as to prevent electric shock accident resulting from short circuit of the internal circuit structure.

In other word, the safety socket 10 of the present invention provides a drainage path, wherein when water enters into the safety socket 10 and enters into the live wire receptacle 611 or the neutral wire receptacle 621 via the jacks 13, the water enters into the guide channels 142 of the drainage arrangement 14 via the water port 617 of the live wire receptacle 611 or the drainage portion 628 of the neutral wire receptacle 621, wherein the water is discharged out of the safety socket 10 eventually so as to prevent a short circuit which can result in electric shock accident.

The water can be a movable socket to be fixed in a variety of environments such as being pasted or fixed using screws, rivets and others. For example, the back surface of the safety socket 10 can be directly pasted on the wall. Or, the socket shell 11 of the waterproof socket is provided with mounting holes and a fixing element penetrates through the mounting holes to fix the socket on the wall. In the preferred embodiment of the present invention, the safety socket 10 embodied as a wall socket can more effectively play its drainage effect. Of course, the wall socket in the embodiment is exemplary only and not intended to be limiting in this aspect. It is needed to be pointed out that the safety sockets in the first to fourth embodiments are not limited to wall sockets, but can be applied to a variety of possible situations.

As shown in FIG. 49 to FIG. 53, a safety socket 10 according to a sixth preferred embodiment of the present invention is illustrated. The safety socket 10 is adapted to be placed in a variety of environmental surfaces, such as the wall surface, the surface of furniture, the floor, and etc. According to this embodiment of the present invention, the safety socket 10 also comprises a fixed plate 15, which is used to fix the safety socket 10 to the environmental surface.

Similarly, the safety socket 10 comprises one or more socket bodies 700 assembled in the socket shell 11, the socket body 700 has two, three or more receptacles, thereby forming a two-hole jacks socket, a three-hole jacks socket or multi-hole jacks socket.

Correspondingly, each of the receptacles of the socket body 700 is independent and isolated with the other. In other words, the receptacles are not communication with each other, so that when water or other conductive fluid enters into one receptacle but will not enter into other receptacles, thereby preventing electric shock resulted from short circuit.

In the preferred embodiment of the present invention, for a two-hole jackets socket as an example, the socket body 700 has a live wire receptacle 711 and a neutral wire receptacle 721. The socket shell 11 forms two jacks 13 corresponding to the live wire receptacle 711 and the neutral wire receptacle 721. Each receptacles communicate with each corresponding jacks. In other words, the pins of the electrical appliance penetrate through the jacks and are inserted into the corresponding receptacles. More specifically, each of the receptacles has wiring terminals for electrically connecting the electric circuit between the pins of the electrical appliance and the power supply.

Similarly, take the live wire receptacle 711 as an example, the live wire receptacle 711 is provided with a water port 717 which is disposed in a drainage portion 718. The drainage portion 718 protrudes and extends from the live wire receptacle 711 and the neutral wire receptacle 721.

Figure 51:
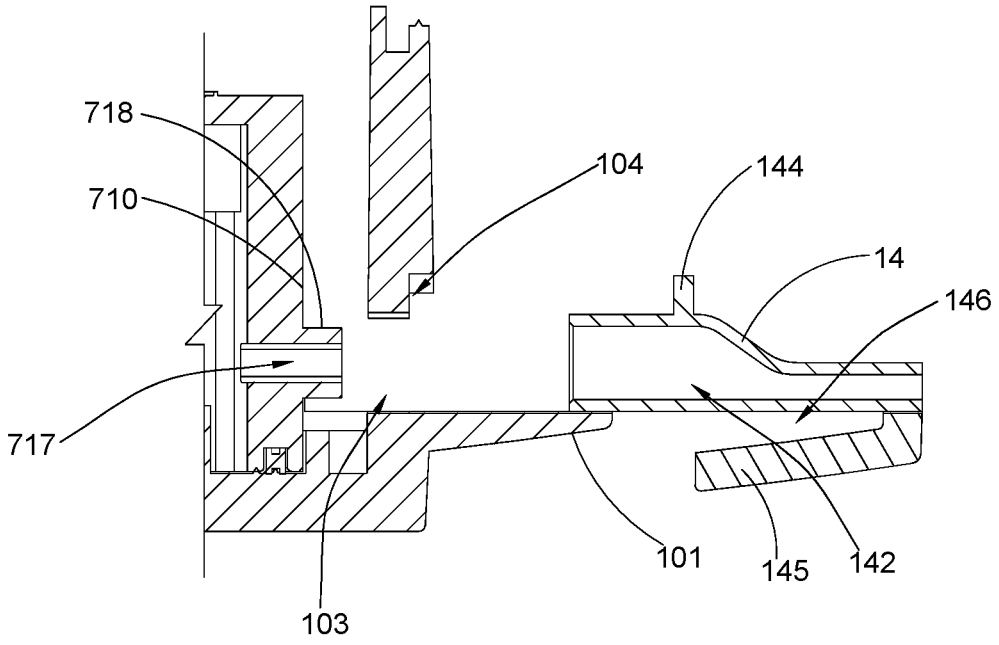
FIG. 51 is a cross-sectional view of the safety socket according to the above preferred embodiment of the present invention.
Figure 52:
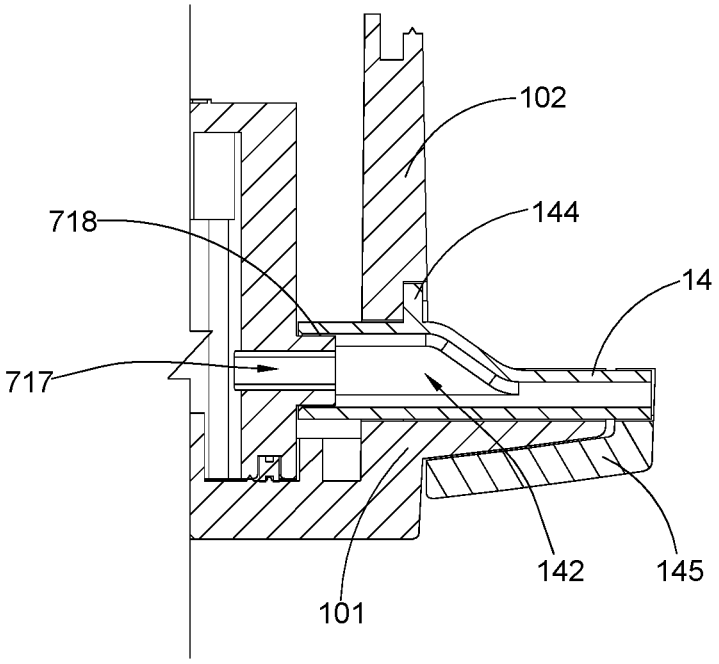
FIG. 52 is an exploded view of the safety socket according to the above preferred embodiment of the present invention.

The safety socket 10 further comprises a drainage arrangement 14 connecting with the drainage portion 718. As shown in FIG. 51 and FIG. 52, when the drainage arrangement 14 is not installed, the water port 717 is visible. The socket shell 11 has a support portion 101, a fixed portion 102 in a position adjacent to the water port 717 and an installing hole 103 which is formed between the support portion 101 and the fixed portion 102 for installing the drainage arrangement 14.

As shown in FIG. 51 and FIG. 52, the drainage arrangement 14 slides toward the drainage portion 718 to be installed in the installing hole 103. The support portion 101 is adapted for supporting the drainage arrangement 14. The drainage arrangement 14 further has an installing portion 144 for assembling with the fixed portion 102 of the socket shell 11. For example, the installing portion 144 bonds with the fixed portion 102 via waterproof glues. The fixed portion 102 can be provided with a groove 105 which matches the size and shape of the fixed portion 102, and the installing portion 144 is received in the groove 105 during assembly.

In addition, the drainage arrangement 14 can also comprise a positioning portion 145 and a neck slot 146 formed between the guide portions 141 and the positioning portion 145. The shape and size of the neck slot 146 match with that of support portion 101, such that the support portion 101 is adapted to be received in the neck slot 146 which is formed between the positioning portion 145 and the pushing element 141 and further has a firmly positioning effect.

Figure 49:
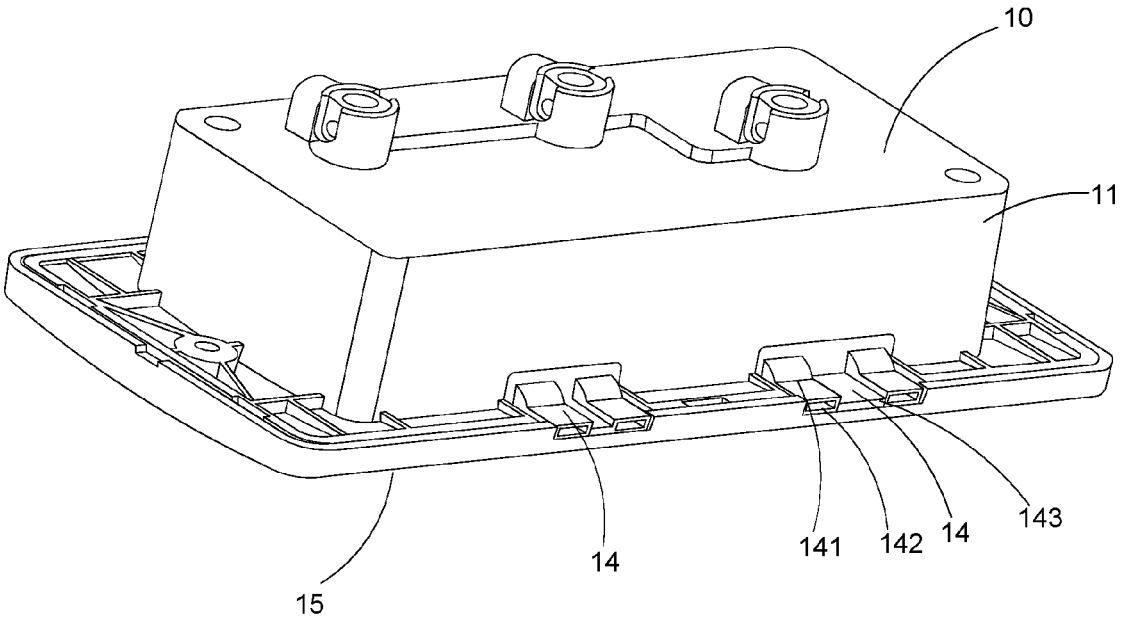
FIG. 49 is a front perspective view of a safety socket according to a sixth preferred embodiment of the present invention.
Figure 50:
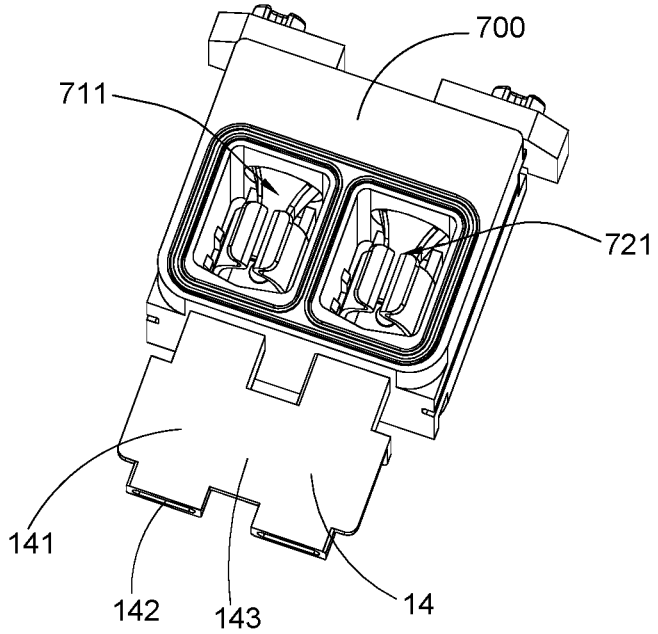
FIG. 50 is a rear perspective view of the safety socket according to the above preferred embodiment of the present invention.

It is worth mentioning that, when the safety socket 10 is mounted on environmental surfaces such as wall surfaces, the water port 717 is toward the direction conforming to gravity, so that water will not enter the live wire receptacle 711 via the water port 717, thereby essentially providing double protection. As shown in FIG. 49, when the safety socket 10 is mounted on an environmental surface such as wall surface, the drainage arrangement 14 is parallel to the wall surface so as to ensure that the drainage arrangement 14 will not be buried in the wall hole which resulting in the blocking of the actuating element 142 of the drainage arrangement 14 by the wall.

Figure 53:
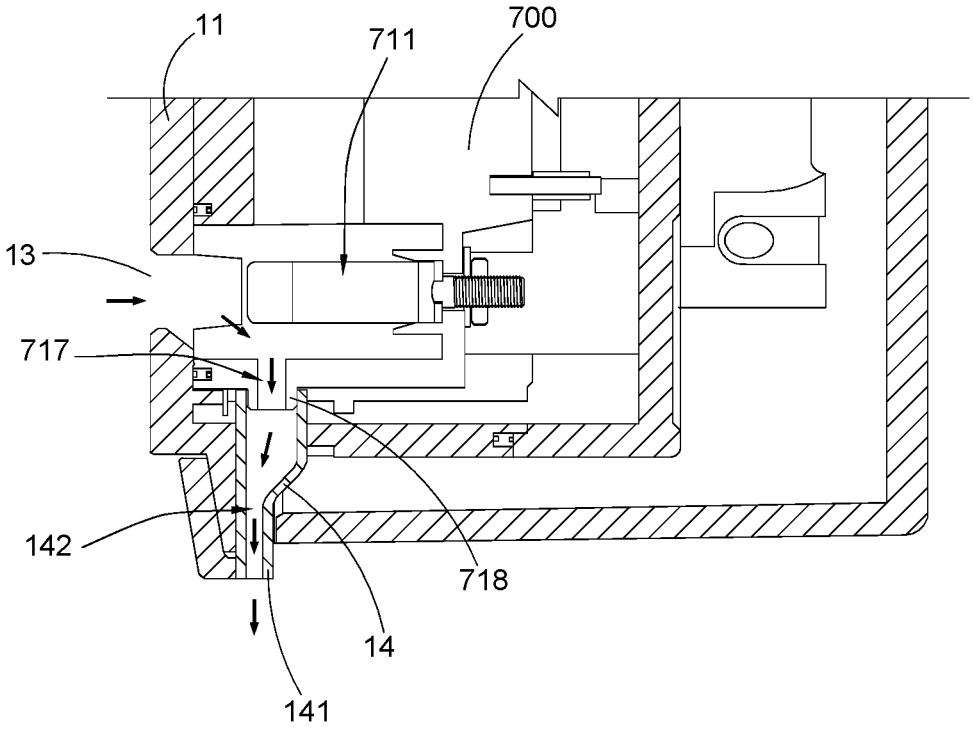
FIG. 53 is a schematic view of the safety socket according to the above preferred embodiment of the present invention when the safety socket is in use.
Figure 54:
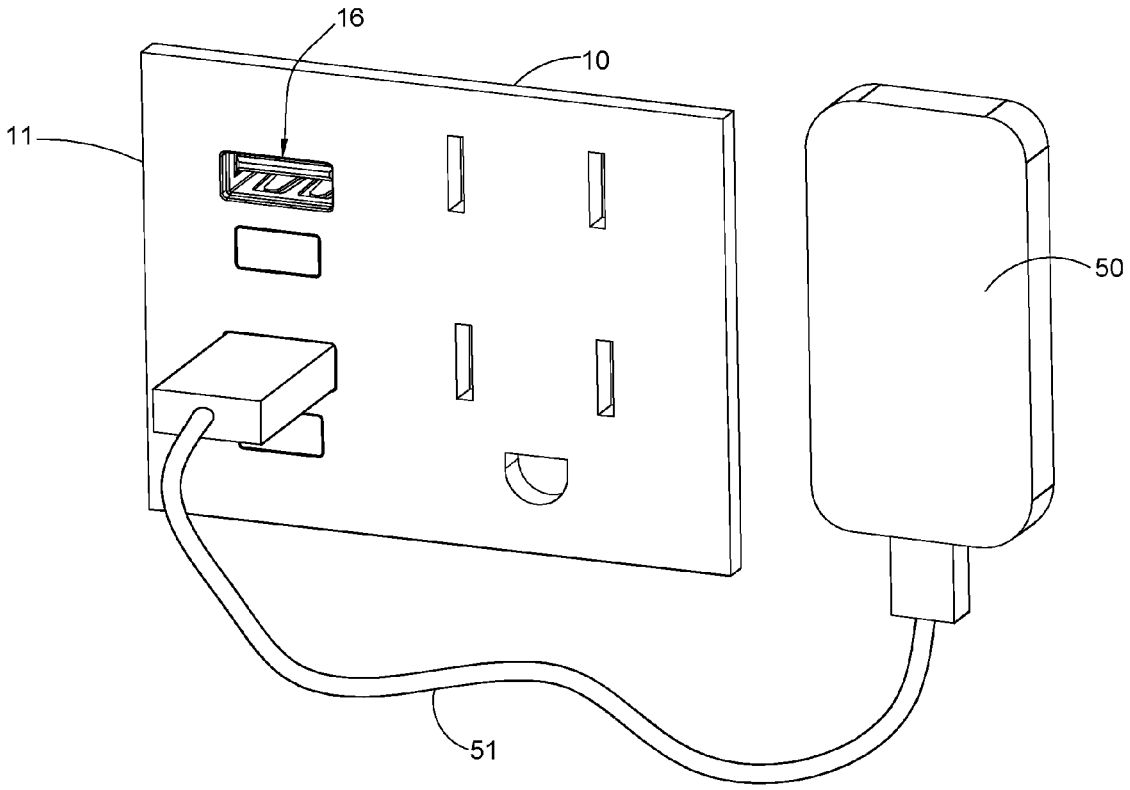
FIG. 54 is a perspective view of a safety socket according to a seventh preferred embodiment of the present invention.

As shown in FIG. 53, a schematic diagram of the safety socket 10 mounted on the wall surface of the present invention is illustrated. When the safety socket 10 is mounted on the wall in a vertical direction by the fixed plate 15, the pins of the electrical appliance can only be inserted into the receptacles in a horizontal direction. Take the live wire receptacle 711 as an example, water can only enter into the live wire receptacle 711 via the jacks 13 in the horizontal direction. The water port 717 and the guide channels 142 of the drainage arrangement 14 are disposed in the vertical direction. Thus, when water enters into the live wire receptacle 711, the water will be discharged out of the safety socket 10 in the vertical direction because of gravity It is worth mentioning that as the live wire receptacle 711 is disposed in the vertical direction after installation, the water port 717 does not have to be arranged in the innermost side of the live wire receptacle 711, but is disposed adjacent to the jacks 13. In other words, the water port 717 can be arranged in the live wire receptacle 711 adjacent to the jacks 13, so that when the water enters into the live wire receptacle 711 from the jacks 13, the water will be immediately discharged from the water port 717. The interpolation principle of the 721 and the interpolation principle of the live wire receptacle 711 above are the same. It is understanding that this improved drainage structure can also be adapted to apply on the earth wire receptacle of the three-hole jacks socket.

Referring to FIG. 54 to FIG. 57, a safety socket 10 according to a seventh preferred embodiment of the present invention is illustrated. Similarly, the safety socket 10 comprises a socket shell 11 and one or more socket bodies. In this preferred embodiment, the safety socket 10 also provides one or more USB terminal elements 16. An intelligent digital device 50 such as a mobile phone, a tablet computer, a personal digital assistant, a MP3, a MP4, a mobile power, a digital camera, and etc., can be connected to the USB terminal element 16 by a USB data cable 51, such that the intelligent digital device 50 is charged by means of electrically connecting the safety socket 10 to a power source.

In other words, the safety socket 10 according to the preferred embodiment of the present invention integrates the functions of ordinary power sockets and USB power sockets, and can not only connect electrical applications to the AC power source which is provided by the grids, but also can provide a DC power source for small electrical equipment such as the intelligent digital device 50 mentioned above. The intelligent digital device 50 can directly connect with the safety socket 10 for being charged via the USB terminal element 16, such that conversions or other charging devices are not needed and the safety socket of the present invention meets the electricity needs of modern people on the power supply combination.

Figure 55:
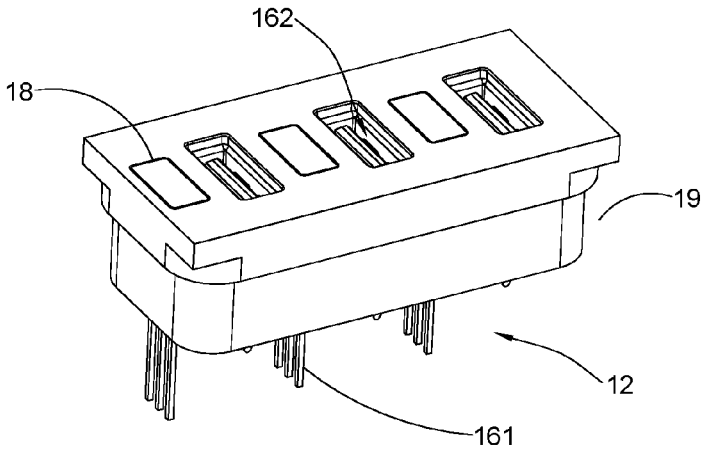
FIG. 55 is a perspective view of the safety socket with a USB terminal element according to the above preferred embodiment of the present invention.
Figure 56:
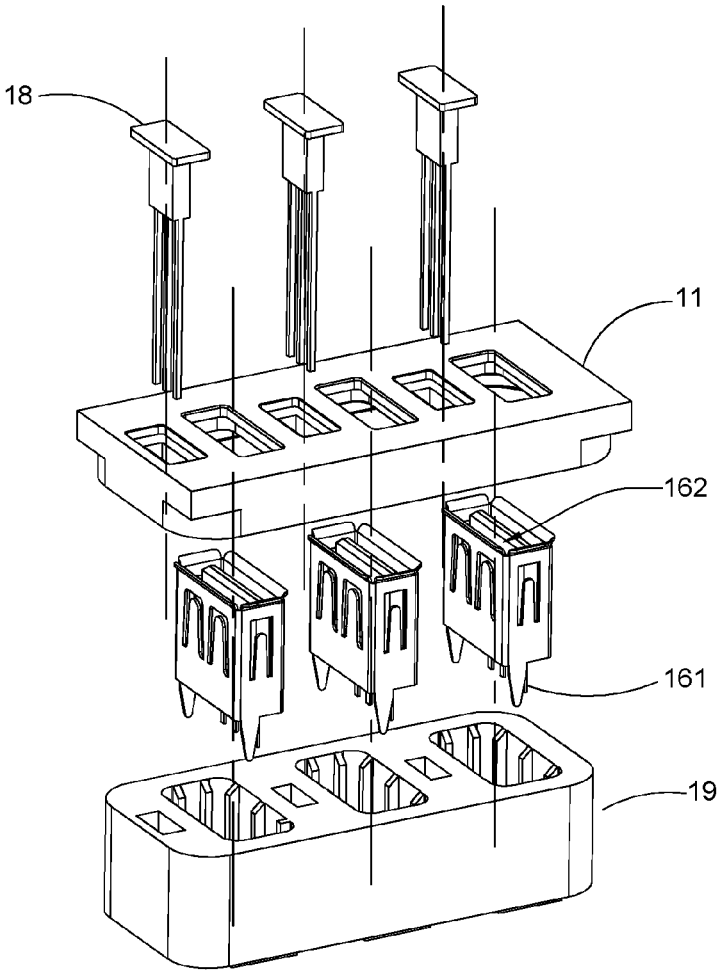
FIG. 56 is an exploded schematic view of the safety socket according to the above preferred embodiment of the present invention.
Figure 57:
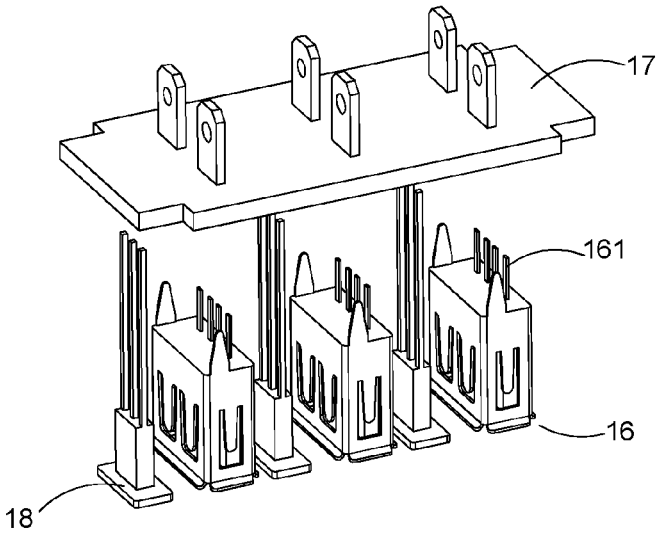
FIG. 57 is a perspective view of the safety socket according to the above preferred embodiment of the present invention, illustrating a pin of the USB terminal element and a circuit board.

As shown in FIG. 55 to FIG. 57, the USB terminal element 16 of the safety socket 10 comprises a pin 161 and has a USB receptacle 162 provided in the socket shell 11. The USB terminal element 16 and the socket shell 11 are integrally formed, such as being integrally formed by injection molding process. Or the USB terminal element 16 is integrally formed with a plastic member 19, then the plastic member 19 with the USB terminal element 16 assembles with the socket shell 11 of the safety socket 10 by ultrasound and other alternative methods. One skilled in the art should understand that the methods described above are exemplary only and not intended to be limiting.

It is worth mentioning that, similar to the first to third embodiments described above, the isolation cavity 12 is formed in the safety socket 10, wherein the isolation cavity 12 and the receptacles of the socket body are isolated so as to provide waterproof feature. According to this preferred embodiment, the isolation cavity 12 and the USB receptacle 162 of the USB terminal element 16 are not communicated with each other such that water or other liquid within the USB receptacle 162 will not enter into the isolation cavity 12.

In addition, the safety socket 10 further comprises a circuit board 17. The USB receptacle 162 of the USB terminal element 16 is soldered to the circuit board 17. The safety socket 10 further comprises an indicator light 18 electrically connected to the circuit board 17. If necessary, the circuit board 17 can also set a power switch, wherein when the power switch is switched on, the circuit board is in a working state. Because of the connection of the safety socket 10 and the power supply, the indicator light connecting to the circuit board 17 emits light, and then a user can insert the pins of the USB data cable 51 into the USB receptacle 162 of the USB terminal element 16, such that the intelligent digital device 50 is charged via the safety socket 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A safety socket for an appliance plug having two or more pins, comprising:

at least one socket body having two or more receptacles isolated with each other, and comprising a live wire connection circuit, a neutral wire connection circuit and a locking and controlling mechanism, wherein said locking and controlling mechanism is activated to an operation state when said two or more pins of said appliance plug are inserted into said corresponding receptacles of said socket body, and that said live wire connection circuit and said neutral wire connection circuit are electrically disconnected when said locking and controlling mechanism is in an idle state, thereby preventing electric shock, wherein said receptacles of said socket body include a live wire receptacle, a neutral wire receptacle and an earth wire receptacle while said pins of said appliance plug include a live wire pin, a neutral wire pin and an earth wire pin, wherein when said live wire pin, said neutral wire pin and said earth wire pin of said appliance plug are respectively and simultaneously inserted into said corresponding live wire receptacle, said neutral wire receptacle and said earth wire receptacle, said locking and controlling mechanism is activated by said earth wire pin inserted into said earth wire receptacle to electrically connect said live wire connection circuit and said neutral wire connection circuit, wherein said earth wire receptacle has a sidewall, wherein an action hole is provided in said sidewall of said earth wire receptacle, wherein said locking and controlling mechanism comprises a pushing element, an actuating element and a reset element, wherein said pushing element has a first end and a second end, wherein said first end of said pushing element transverses said action hole and extends to said earth wire receptacle to be driven by said earth wire pin, wherein said second end opposite to said first end of said pushing element is connected to said actuating element, wherein said actuating element electrically connects said live wire connection circuit and said neutral wire connection circuit in said operation state, wherein said reset element is connected to one of said pushing element and said actuating element in such a manner that when said earth wire pin is removed from said earth wire receptacle, said locking and controlling mechanism is switched to said initial idle state, wherein said socket body comprises a live wire connection switch controlling electrical connection and disconnection of said live wire connection circuit, and a neutral wire connection switch controlling electrical connection and disconnection of said neutral wire connection circuit, wherein said actuating element of said locking and controlling mechanism simultaneously switches on said live wire connection switch and said neutral wire connection switch under said action of said pushing element so as to electrically connect said live wire connection circuit with said neutral wire connection circuit, wherein said actuating element comprises a connector element and two actuating blocks connected to two sides of said connector element, wherein each of said two actuating blocks has an actuating surface applying pushing force to act on said live wire connection switch and said neutral wire connection switch so as to electrically connect said live wire connection circuit and said neutral wire connection circuit.

2. The safety socket, as recited in claim 1, wherein each of said actuating blocks further has a receiving slot provided therein, wherein an inside wall of said receiving slot forms said actuating surface, wherein each of said live wire connection switch and said neutral wire connection switch has two switch elements accommodated in said corresponding receiving slot, wherein each of said two switch elements comprises an contacting end portion, and that said contacting end portion of one switch element of said two switch elements is adapted to move under actions of said actuating element and to contact to said contacting end portion of the other switch element so as to switch on said corresponding connection switch.

3. The safety socket, as recited in claim 2, wherein each of said contacting end portions of said two switch elements of each said live wire connection switch and said neutral wire connection switch has a conductive protrusion, wherein the position of said conductive protrusion of one of said switch elements is higher than the position of said other conductive protrusion of said other switch element, wherein one of said contacting end portions of said respective switch element rotates under action of said actuating surface, such that said conductive protrusions of said two switch elements contact with each other to form a point-to-point contacting configuration.

4. The safety socket, as recited in claim 3, wherein an upper wall of said receiving slot forms an inclined guiding surface and said contacting end portion of said respective switch element slides along said inclined guiding surface under action of said actuating surface, rendering said two switch elements in contact with each other.

5. The safety socket, as recited in claim 1, wherein an isolation cavity is formed on outside of two or more said receptacles of said safety socket, wherein said socket body further comprises a sealing member to prevent water or other conductive liquid in said earth wire receptacle from entering said isolation cavity via said action hole.

6. The safety socket, as recited in claim 5, wherein said sealing member comprises a sealer, which is fixed to said outside of said earth wire receptacle, comprising a sealing body, wherein a through-hole is provided in said sealing body, wherein said through-hole is positioned corresponding to said action hole of said earth wire receptacle, and that said through-hole is sized and shaped to match with said pushing element, so as to enable said pushing element penetrating through said through-hole fittingly.

7. The safety socket, as recited in claim 6, wherein said earth wire receptacle has an outer side wall which forms a locating slot and said sealing member further comprises a fixator comprising a fixator body having an opening formed in said fixator body, wherein said opening allows said pushing element to penetrate through and said fixator body is fixed to said outer side wall of said earth wire receptacle to seal said locating slot, so as to ensure that said sealer is securely and tightly mounted in said locating slot.

8. A safety socket for an appliance plug having two or more pins, comprising:

at least one socket body having two or more receptacles isolated with each other, and comprising a live wire connection circuit, a neutral wire connection circuit and a locking and controlling mechanism, wherein said locking and controlling mechanism is activated to an operation state when said two or more pins of said appliance plug are inserted into said corresponding receptacles of said socket body, and that said live wire connection circuit and said neutral wire connection circuit are electrically disconnected when said locking and controlling mechanism is in an idle state, thereby preventing electric shock, wherein said two or more receptacles of said socket body include a live wire receptacle and a neutral wire receptacle, and said two or more pins of said appliance plug include a live wire pin and a neutral wire pin, wherein when said live wire pin and said neutral wire pin of said appliance plug are respectively and simultaneously inserted into said corresponding live wire receptacle and said neutral wire receptacle, said locking and controlling mechanism is activated by said live wire pin inserted into said live wire receptacle and said neutral wire pin inserted into said neutral wire receptacle to electrically connect said live wire connection circuit and said neutral wire connection circuit, wherein said locking and controlling mechanism comprises two locking control units, wherein each of said live and neutral wire receptacles has a side wall, wherein a live wire action hole is provided in said sidewall of said live wire receptacle, and a neutral wire action hole is provided in said sidewall of said neutral wire receptacle, wherein said two locking control units are respectively positioned and mounted through said live wire action hole and said neutral wire action hole, wherein when said live wire pin and said neutral wire pin of said appliance plug are respectively inserted into said live wire receptacle and said neutral wire receptacle at the same time, said live wire pin and said neutral wire pin simultaneously activate said two locking control units, wherein only when said two locking control units are simultaneously activated, said live wire connection circuit and said neutral wire connection circuit are electrically connected.

9. The safety socket, as recited in claim 8, wherein each of said two locking control units comprises a pushing element having a sloped surface on one end thereof and penetrating through said live wire action hole or said neutral wire action hole, an actuating element connected to said pushing element and electrically connecting said live wire connection circuit and said neutral wire connection circuit in said operation state, and a reset element mounted on said pushing element or said actuating element, wherein when said live wire pin and said neutral wire pin of said appliance plug are respectively inserted into said live wire receptacle and said neutral wire receptacle at the same time, said live wire pin and said neutral wire pin respectively push said pushing elements to move so as to further drive said actuating elements to move, and thus said two locking control units are in said operation state, and that when said live wire pin and said neutral wire pin of said appliance plug are removed from said live wire receptacle and said neutral wire receptacle, said two locking control units are in said initial idle state under a reset effect of said reset elements.

10. The safety socket, as recited in claim 9, wherein said socket body comprises two sets of live wire connection switch and neutral wire connection switch, wherein in said operation state, said actuating elements of said two locking control units switch on said two sets of live wire connection switch and neutral wire connection switch respectively so as to electrically connect said live wire connection circuit and said neutral wire connection circuit.

11. The safety socket, as recited in claim 9, wherein said locking and controlling mechanism further comprises a braking unit, wherein when said two locking control units are simultaneously activated, said braking unit allows said two locking control units to work in a normal working state, and that when only one of said two locking control units is activated, said braking unit prevents said other locking control unit from operating so as to ensure an electrical disconnection of said live wire connection circuit and said neutral wire connection circuit for preventing electric shock.

12. The safety socket, as recited in claim 11, wherein said braking unit comprises a braking element, a restraining element and a rotating shaft, wherein said braking element is adapted for linear motions under said mutual actions of said two actuating elements when switching to said operation state, wherein when said live wire pin and said neutral wire pin of said appliance plug are respectively removed from said live wire receptacle and said neutral wire receptacle, said braking element returns to said initial idle state under said reset effect of said restraining element, wherein when only one of said two locking control units is activated, said braking element rotates around said rotating shaft and prevents said other locking control unit from operating so as to ensure an electrical disconnection of said live wire connection circuit and said neutral wire connection circuit for preventing electric shock.

13. The safety socket, as recited in claim 12, wherein two ends of said braking element have two effect surfaces provided thereon respectively, wherein each of said two actuating elements comprises an actuating body, and that said actuating body applies acting forces on said two effect surfaces, rendering said braking element to move selectively along a vertical direction or a horizontal direction.

14. The safety socket, as recited in claim 13, wherein said two effect surfaces are sloped surfaces and provided on the same side of said braking element, wherein said actuating bodies of said two actuating elements are provided on the same side of said braking element and adapted to apply acting forces on said two effect surfaces along said same and parallel directions respectively.

15. The safety socket, as recited in claim 13, wherein said two effect surfaces are sloped surfaces and provided on opposite sides of said braking element, wherein said actuating bodies of said two actuating elements are provided on two opposite sides of said braking element and adapted to apply acting forces on said two effect surfaces along parallel but opposite directions respectively.

16. The safety socket, as recited in claim 13, wherein each of said actuating elements respectively comprises a starting element in such a manner that one of said two starting elements is used to simultaneously switch on and switch off one set of live wire connection switch and neutral wire connection switch, and the other one of said two starting elements is used to simultaneously switch on and switch off the other set of live wire connection switch and neutral wire connection switch.

17. The safety socket, as recited in claim 16, wherein positions of said actuating bodies of said each two actuating elements are provided that, when only one locking control unit of said two locking control units is started, one actuating body of said locking control unit applies on one of said effect surfaces in such a manner that said braking element rotates clockwise or counterclockwise around said rotating shaft, so as to ensure that the other effect surface and said actuating body of said other locking control unit are in a dislocation state, and thus said braking element prevents starting of said other locking control unit.

18. The safety socket, as recited in claim 9, wherein an isolation cavity is formed outside of said two or more receptacles of said socket body of said safety socket, wherein said socket body further comprises a sealing member for preventing water or other electrical conductive liquid entered said earth wire receptacle from entering into said isolation cavity via said live wire action hole or said neutral wire action hole.

19. The safety socket, as recited in claim 18, wherein each of said pushing elements has grooves formed therein, wherein said sealing member comprises sealing rings which are respectively provided in said grooves and located in said corresponding live wire action hole and said neutral wire action hole so as to tightly and closely contact to inner surfaces of said live wire action hole and said neutral wire action hole respectively.

20. The safety socket, as recited in claim 18, wherein a side of each of said outer side walls of said live wire receptacle and said neutral wire receptacle, adjacent to these of said isolation cavity, forms a fixation groove, wherein said sealing member comprises sealing rings respectively mounted on said fixation grooves and inner surfaces of said sealing rings are tightly and closely in contact with said outer surface of said pushing element.

21. The safety socket, as recited in claim 20, wherein said sealing member further comprises a fixing member comprising a fixing member body, wherein two openings are formed in said fixing member body, wherein said two openings respectively allow each said pushing element to penetrate therethrough, wherein said fixing member is fixed to outer side walls of said live wire receptacle and said neutral wire receptacle to seal said corresponding fixation grooves so as to ensure that said sealing rings are tightly, firmly and closely mounted in said fixation grooves.

22. The safety socket, as recited in claim 8, wherein said locking and controlling mechanism further comprises a braking unit connecting to said two locking control units, wherein when said live wire pin and said neutral wire pin of said appliance plug are respectively inserted into said corresponding live wire receptacle and said neutral wire receptacle at the same time, said two locking control units are activated by said live wire pin and said neutral wire pin to drive said braking unit to switch to said operation state so as to electrically connect said live wire connection circuit and said neutral wire connection circuit, wherein when only one of said two locking control units is activated, said other locking control unit connected to said braking unit prevents said locking control unit from operating for preventing electric shock.

23. The safety socket, as recited in claim 22, wherein each of said two locking control units has a pushing member, an actuating member and a reset member, said pushing member having a sloped surface at one end thereof and penetrating through said live wire action hole or said neutral wire action hole, said actuating member connecting with said pushing member, said reset member mounting on said pushing member or said actuating member, wherein said actuating member is used to electrically connect said live wire connection circuit with said neutral wire connection circuit in said operation state, wherein when said live wire pin and said neutral wire pin of said appliance plug are respectively inserted into said live wire receptacle and said neutral wire receptacle at the same time, said live wire pin and said neutral wire pin respectively push said pushing members to move so as to further drive said actuating members to move, and that said two locking control units are in said operation state, and thus when said live wire pin and said neutral wire pin of said appliance plug are removed from said live wire receptacle and said neutral wire receptacle, said two locking control units are in said initial idle state under a reset effect of said reset members.

24. The safety socket, as recited in claim 23, wherein said socket body comprises a live wire connection switch and a neutral wire connection switch, wherein in said operation state, one actuating element switches one set of said live wire connection switch and said neutral wire connection switch while said other actuating element switches the other set of said live wire connection switch and said neutral wire connection switch, so as to electrically connect said live wire connection circuit with said neutral wire connection circuit.

25. The safety socket, as recited in claim 23, wherein said braking unit comprises a positioning member and two connection members, wherein one end of each of said connection members is pivotally mounted to said positioning member, and the other end of each of said connection members is respectively pivotally mounted to said actuating member.

26. The safety socket, as recited in claim 25, wherein said socket body further comprises a guide member having a guide groove, wherein said guide member is integrally protruded from said outer side wall of said respective receptacle of said socket body, wherein said positioning member is adapted for sliding in said guide groove of said guide member.

27. The safety socket, as recited in claim 26, wherein each of said connection members comprises a connecting end portion and a coupling end portion, wherein said two connecting end portions are assembled by said positioning member and each of said connecting end portions forms a blocking joint groove, wherein said actuating member has an installing member provided in said end portion, wherein said installing members are respectively received in said blocking joint grooves and connected with said corresponding coupling end portions by a pivot member.

28. The safety socket, as recited in claim 22, wherein an isolation cavity is formed outside of two or more receptacles of said socket body of said safety socket, wherein said socket body further comprises a sealing member for preventing water or other electrical conductive liquid entered said earth wire receptacle from entering into said isolation cavity via said live wire action hole or said neutral wire action hole.

29. A safety socket for an appliance plug having two or more pins, comprising:

at least one socket body having two or more receptacles isolated with each other, and comprising a live wire connection circuit, a neutral wire connection circuit and a locking and controlling mechanism, wherein said locking and carnelian mechanism is activated to an operation state when said two or more pins of said appliance plug are inserted into said corresponding receptacles of said socket body, and that said live wire connection circuit and said neutral wire connection circuit are electrical disconnected when said locking and controlling mechanism is in an idle state, thereby preventing electric shock, wherein each of said receptacles has an receptacle opening, wherein each of said receptacles is provided with a protecting assembly disposed on a position adjacent to said receptacle opening of said receptacle to seal said receptacle opening in a protecting position and to open said receptacle opening in an working position, such that said pins of said appliance plug are inserted into said corresponding receptacles, wherein said protecting assembly comprises a protecting member, a rotation shaft and a reset member, wherein said protecting member is adapted to rotate around said rotation shaft so as to switch between said protecting position and said working position, whereby when said pins of said appliance plug are removed from said receptacles, a resetting effect of said reset member makes said protecting assembly switching back to said protecting position from said working position.

30. A safety socket for an appliance plug having two or more pins, comprising:

at least one socket body having two or more receptacles isolated with each other, and comprising a live wire connection circuit, a neutral wire connection circuit and a locking and controlling mechanism, wherein said locking and controlling mechanism is activated to an operation state when said two or more pins of said appliance plug are inserted into said corresponding receptacles of said socket body, and that said live wire connection circuit and said neutral wire connection circuit are electrically disconnected when said locking and controlling mechanism is in an idle state, thereby preventing electric shock, wherein said safety socket further comprises one or more chargeable USB terminal elements for connecting with one or more intelligent digital devices by one or more USB data cables for providing Dower to said intelligent digital devices, wherein said safety socket further comprises a socket shell and a circuit board, wherein said socket shell and said socket body form an isolation cavity which is not communicating with said receptacles, wherein said circuit board is received in said isolation cavity and each of said USB terminal elements has a USB receptacle and one or more pins connected to said circuit board, wherein each of said USB terminal elements is integrally formed in said socket shell, wherein said USB receptacles and said isolation cavity are not communicating with each other for preventing water or other electrical conductive liquid from entering into said isolation cavity via said receptacles and said USB receptacles.

31. A safety socket for an appliance plug having two or more pins, comprising:

at least one socket body having two or more receptacles isolated with each other, and comprising a live wire connection circuit, a neutral wire connection circuit and a locking and controlling mechanism, wherein said locking and controlling mechanism is activated to an operation state when said two or more pins of said appliance plug are inserted into said corresponding receptacles of said socket body, and that said live wire connection circuit and said neutral wire connection circuit are electrically disconnected when said locking and controlling mechanism is in an idle state, thereby preventing electric shock, wherein said socket body comprises:

a first live wire connection switch and a second live wire connection switch adapted for connecting or disconnecting with said live wire connection circuit, a first neutral wire connection switch and a second neutral wire connection switch adapted for connecting or disconnecting with said neutral wire connection circuit, wherein said locking and controlling mechanism comprising a first locking control unit and a second locking control unit, wherein when said first locking control unit and said second locking control unit are activated at the same time, said first locking control unit switches on said first live wire connection switch and said first neutral wire connection switch and, simultaneously, said second locking control unit switches on said second live wire connection switch and said second neutral wire connection switch, and thus said live wire connection circuit and said neutral wire connection circuit are electrically connected to ensure a normal working condition of said socket body.

32. The safety socket, as recited in claim 31, wherein said socket body further has a live wire receptacle and a neutral wire receptacle, wherein each of said live and neutral wire receptacle has a side wall, wherein said socket body further has a live wire action hole provided in said sidewall of said live wire receptacle and a neutral wire action hole provided in said sidewall of said neutral wire receptacle, wherein said first locking control unit is positioned and mounted through said live wire action hole and said second locking control unit is positioned and mounted through said neutral wire action hole, wherein when a live wire pin and a neutral wire pin of said appliance plug are respectively and simultaneously inserted into said live wire receptacle and said neutral wire receptacle, said live wire pin activates said first locking control unit and said neutral wire pin activates said second locking control unit, thus said live wire connection circuit and neutral wire connection circuit are electrically connected only when said two locking control units are simultaneously activated.

* * * * *